US010056088B2

(12) United States Patent
Moriya et al.

(10) Patent No.: US 10,056,088 B2
(45) **Date of Patent: *Aug. 21, 2018**

(54) ENCODING METHOD, DECODING METHOD, ENCODER APPARATUS, DECODER APPARATUS, AND RECORDING MEDIUM FOR PROCESSING PITCH PERIODS CORRESPONDING TO TIME SERIES SIGNALS

(71) Applicant: NIPPON TELEGRAPH AND TELEPHONE CORPORATION, Tokyo (JP)

(72) Inventors: Takehiro Moriya, Kanagawa (JP); Noboru Harada, Kanagawa (JP); Yutaka Kamamoto, Kanagawa (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/725,682

(22) Filed: Oct. 5, 2017

(65) Prior Publication Data

US 2018/0047402 A1 Feb. 15, 2018

Related U.S. Application Data

(63) Continuation of application No. 13/518,525, filed as application No. PCT/JP2011/050186 on Jan. 7, 2011, now Pat. No. 9,812,141.

(30) Foreign Application Priority Data

Jan. 8, 2010 (JP) ..... 2010-002494

(51) Int. Cl.
*G10L 19/00* (2013.01)
*G10L 19/09* (2013.01)

(52) U.S. Cl.
CPC ..... *G10L 19/09* (2013.01)

(58) Field of Classification Search
USPC ..... 704/200–230, 500–504
See application file for complete search history.

(56) References Cited

U.S. PATENT DOCUMENTS 3,566,035 A 2/1971 Noll et al.
5,396,576 A 3/1995 Miki et al.
(Continued)

FOREIGN PATENT DOCUMENTS

CN 1484823 A 3/2004
CN 101615395 A 12/2009
(Continued)

OTHER PUBLICATIONS

Hess, Wolfgang, "Pitch Determination of Speech Signals," Springer Science & Business Media, 2012. pp. 88-90.
(Continued)

*Primary Examiner* — Huyen Vo
(74) *Attorney, Agent, or Firm* — Oblon, McClelland, Maier & Neustadt, L.L.P.

(57) ABSTRACT

In encoding, pitch periods for time series signals in a predetermined time interval are calculated, and a code corresponding thereto is output. In that encoding, the resolutions for expressing the pitch periods and/or a pitch period encoding mode are switched according to whether an index indicating a periodicity and/or stationarity level of the time series signals satisfies a condition indicating high or low in periodicity and/or stationarity. In that decoding, according to whether an index indicating a periodicity and/or stationarity level, the index being included in or obtained from an input code corresponding to the predetermined time interval, satisfies a condition indicating high periodicity and/or stationarity, a decoding mode for a code, included in the input
(Continued)

code, corresponding to pitch periods is switched to decode the code corresponding to the pitch periods to obtain the pitch periods corresponding to the predetermined time interval.

10 Claims, 17 Drawing Sheets

(56) References Cited

U.S. PATENT DOCUMENTS

| | | | | |
|---|---|---|---|---|
| 5,596,676 | A | 1/1997 | Swaminathan et al. | |
| 5,794,185 | A | 8/1998 | Bergstrom et al. | |
| 6,052,658 | A | 4/2000 | Wang et al. | |
| 6,418,408 | B1 | 7/2002 | Udaya Bhaskar et al. | |
| 6,581,032 | B1 | 6/2003 | Gao | |
| 6,636,829 | B1 | 10/2003 | Benyassine et al. | |
| 6,757,654 | B1 | 6/2004 | Westerlund | |
| 6,898,566 | B1 | 5/2005 | Benyassine et al. | |
| 7,146,309 | B1 | 12/2006 | Benyassine et al. | |
| 2002/0016711 | A1 | 2/2002 | Manjunath et al. | |
| 2002/0147583 | A1 | 10/2002 | Gao | |
| 2002/0173951 | A1* | 11/2002 | Ehara | G10L 19/07 704/219 |
| 2003/0023433 | A1 | 1/2003 | Erell | |
| 2003/0074192 | A1 | 4/2003 | Choi et al. | |
| 2004/0002856 | A1 | 1/2004 | Bhaskar et al. | |
| 2005/0154584 | A1 | 7/2005 | Jelinek et al. | |
| 2006/0100859 | A1 | 5/2006 | Jelinek et al. | |
| 2006/0277036 | A1 | 12/2006 | Bessette et al. | |
| 2007/0110042 | A1 | 5/2007 | Li et al. | |
| 2007/0217579 | A1 | 9/2007 | Sobti et al. | |
| 2008/0027711 | A1 | 1/2008 | Rajendran et al. | |
| 2008/0071530 | A1 | 3/2008 | Ehara | |
| 2008/0082343 | A1 | 4/2008 | Maeda | |
| 2009/0094024 | A1 | 4/2009 | Yamanashi et al. | |
| 2010/0063806 | A1 | 3/2010 | Gao | |
| 2010/0241425 | A1* | 9/2010 | Eksler | G10L 19/08 704/220 |
| 2010/0286805 | A1 | 11/2010 | Gao et al. | |
| 2012/0265525 | A1 | 10/2012 | Moriya et al. | |
| 2013/0317814 | A1 | 11/2013 | Moriya et al. | |

FOREIGN PATENT DOCUMENTS

| | | | |
|---|---|---|---|
| EP | 2 335 522 | A1 | 11/2011 |
| JP | 63-23200 | A | 1/1988 |
| JP | 5-289697 | | 11/1993 |
| JP | 11-3098 | A | 1/1999 |
| JP | 11-184500 | | 7/1999 |
| JP | 2002-268696 | | 9/2002 |

OTHER PUBLICATIONS

Office Action dated Jan. 29, 2013, in Japanese patent Application No. 2011-549035 with English Translation.

3GPP TS 26.090 V4.0.0, "3'd Generation Partnership Project; Technical Specification Group Services and System Aspects; Mandatory Speech Codec speech processing functions; AMR speech codec; Transcoding functions," Global System for Mobile Communications, pp. 1-56, (Mar. 2001).

ITU, "Coding of Speech at 8 kbit/s Using Conjugate-Structure Algebraic-Code-Excited Linear-Prediction (CS-ACELP)," ITU-Telecommunication Standardization Sector, Recommendation G.729, pp. 1-35, (Mar. 1996).

International Search Report dated Feb. 15, 2011 in PCT/JP11/050186 Filed Jan. 7, 2011.

Combined Chinese Office Action and Search Report dated May 29, 2013 in Chinese Patent Application No. 201180005221.2 with English translation.

* cited by examiner

INTEGER PART
FRACTIONAL PART
INTEGER PART
FRACTIONAL PART
INTEGER PART
FRACTIONAL PART
INTEGER PART
FRACTIONAL PART

INTEGER PART
FRACTIONAL PART
UPPER PART
LOWER PART
UPPER PART
LOWER PART
UPPER PART
LOWER PART
UPPER PART
LOWER PART

INTEGER PART
FRACTIONAL PART
UPPER PART
LOWER PART
UPPER PART
LOWER PART
UPPER PART
LOWER PART
UPPER PART
LOWER PART

ENCODING METHOD, DECODING METHOD, ENCODER APPARATUS, DECODER APPARATUS, AND RECORDING MEDIUM FOR PROCESSING PITCH PERIODS CORRESPONDING TO TIME SERIES SIGNALS

CROSS-REFERENCE TO RELATED APPLICATIONS

The present application is a continuation of and claims the benefit of priority under 35 U.S.C. § 120 from U.S. application Ser. No. 13/518,525, filed Jun. 22, 2012, the entire contents of which is hereby incorporated herein by reference and which is a national stage of International Application No. PCT/JP2011/050186, filed Jan. 7, 2011, which is based upon and claims the benefit of priority under 35 U.S.C. § 119 from prior Japanese Patent Application No. 2010-002494, filed Jan. 8, 2010.

TECHNICAL FIELD

The present invention relates to an encoding technique, and more specifically, to a pitch period encoding technique.

BACKGROUND ART

Conventional systems for encoding time series signals, such as speech signals and acoustic signals, with a small number of bits include an encoding system that obtains the pitch periods of the targets to be encoded and performs encoding (see Non-patent literature 1, for example). A code-excited linear prediction (CELP) system, which is used for mobile phones and the like, will be described as an example of the conventional encoding system in which the pitch periods are obtained and encoding is performed.

FIG. 1 shows a block diagram illustrating an example of the conventional CELP system.

An encoder 91 receives time series signals x(n) (n=0, . . . , L−1; L is an integer equal to 2 or larger), such as speech signals and acoustic signals, divided in units of frames, which are predetermined time intervals. A linear prediction analysis unit 911 performs linear prediction analysis of the time series signals x(n) (n=0, . . . , L−1) at respective points in time n=0, . . . , L−1 included in the current frame to generate linear prediction information LPC info for identifying an all-pole synthesis filter 915 used for the current frame. For example, the linear prediction analysis unit 911 calculates linear prediction coefficients $\alpha(m)$= 1, . . . , P; P is a linear prediction order, which is a positive integer) for the time series signals x(n) (n=0, . . . , L−1) in the current frame, converts the linear prediction coefficients $\alpha(m)$ (m=1, . . . , P) to line spectrum pair coefficients LSP, and outputs the quantized values of the line spectrum pair coefficients LSP as the linear prediction information LPC info.

A fixed codebook 914 outputs signal components c(n) (n=0, . . . , L−1) formed of one or more signals each having a value formed of a non-zero individual pulse and its positive or negative sign and one or more signals each having a value of zero, under the control of a search unit 913. An adaptive codebook 912 stores excitation signals generated at past points in time, and the adaptive codebook 912 outputs adaptive signal components v(n) (n=0, . . . , L−1) obtained by using excitation signals delayed in accordance with pitch periods T obtained by the search unit 913. The excitation signals of the current frame corresponding to the signal components c(n) (n=0, . . . , L−1) from the fixed codebook 914 and the adaptive signal components v(n) (n=0, . . . , L−1) from the adaptive codebook 912 can be expressed as follows:

$$u(n)=g_p \cdot v(n)+g_c \cdot c(n) \quad (n=0, \ldots, L-1) \tag{1}$$

Here, $g_p$ is a pitch gain given to the adaptive signal components v(n), and $g_c$ is a fixed-codebook gain given to the signal components c(n).

The search unit 913 searches for pitch periods T, signal components c(n) (n=0, . . . , L−1), pitch gains $g_p$, and fixed-codebook gains $g_c$ so as to minimize values obtained by applying a perceptual weighting filter 916 to the differences between the input time series signals x(n) (n=0, . . . , L−1; n will be referred to as a sample point) and synthesis signals x'(n) (n=0, . . . , L−1) obtained by applying the all-pole synthesis filter 915 identified with the linear prediction information LPC info to the excitation signals u(n) (n=0, . . . , L−1). The search unit 913 outputs excitation parameters that include the pitch periods T, code indexes $C_f$ identifying the signal components c(n) (n=0, . . . , L−1), the pitch gains $g_p$, and the fixed-codebook gains $g_c$.

Here, the linear prediction information LPC info is updated in each frame, and the pitch periods T, the code indexes $C_f$, the pitch gains $g_p$, and the fixed-codebook gains $g_c$ are updated in each subframe included in the frame. If each frame has a single subframe, the amount of information, such as the excitation parameters, is small, but the temporal changes of the time series signals x(n) (n=0, . . . , L−1) cannot be followed, causing large coding distortion. The opposite effect is produced if each frame has a large number of subframes. Too many subframes cause the improvement in quality to become saturated, and increase the amount of information only. In an example described below, a single frame is divided into four equal subframes. Code indexes $C_f$ obtained in first, second, third, and fourth subframes counted from the top of the frame (referred to as the first, second, third, and fourth subframes) are expressed as $C_{f1}$, $C_{f2}$, $C_{f3}$, and $C_{f4}$. Pitch gains $g_p$ and fixed-codebook gains $g_c$ obtained in the first, second, third, and fourth subframes are expressed respectively as $g_{p1}$, $g_{p2}$, $g_{p3}$, and $g_{p4}$ and $g_{c1}$, $g_{c2}$, $g_{c3}$, and $g_{c4}$, and the pitch gains and fixed-codebook gains are collectively called excitation gains. The pitch periods T obtained in the first, second, third, and fourth subframes are expressed as $T_1$, $T_2$, $T_3$, and $T_4$. The pitch period T is expressed simply by an integral multiple of the interval between sample points n (integer resolution) or by a combination of an integral multiple of the interval between sample points n and a fractional value (fractional resolution). With a fractional resolution in which a fractional value is expressed with two bits, for example, there are four expressions of pitch periods T: $T_{int}-1/4$, $T_{int}$, $T_{int}+1/4$, $T_{int}+1/2$ ($T_{int}$ is an integer). When the adaptive signal components v(n) are expressed by using pitch periods T at fractional resolution, an interpolation filter for performing weighted averaging of a plurality of excitation signals delayed in accordance with the pitch periods T is used.

The excitation parameters that include the pitch periods T, the code indexes $C_f$, the pitch gains $g_p$, and the fixed-codebook gains $g_c$ are input to a parameter encoding unit 917, and the parameter encoding unit 917 generates a bit stream BS formed of codes corresponding to the parameters and outputs it. The pitch gains $g_p$ and the fixed-codebook gains $g_c$ may be encoded by vector quantization which selects optimum codes for pairs of the pitch gains and the fixed-codebook gains.

FIG. 2A is a view showing an example structure of a bit stream BS when pitch periods T at fractional resolution are used, and FIG. 2B is a view illustrating codes corresponding to the pitch periods T at fractional resolution. FIG. 3 is a view illustrating resolutions for expressing a pitch period T (period resolutions).

When pitch periods T at fractional resolution are used, as shown in FIGS. 2A and 2B, codes corresponding to the integer parts and the fractional parts of the pitch periods $T=T_1$, $T_2$, $T_3$, $T_4$ are generated. In the example shown in FIGS. 2A and 2B, nine bits are assigned to the pitch periods in the first and third subframes, and the values of the pitch periods $T_1$ and $T_3$ in the first and third subframes (differences from the smallest value of the pitch periods) are encoded separately by an encoding system independent of the pitch periods of the other subframes (pitch period parts). Independent encoding of the pitch period of a given subframe by an encoding system independent of the pitch periods of the other subframes is referred to as independent encoding in each subframe. Generally, it is preferable to express a shorter pitch period T at fractional resolution. In the example shown in FIG. 3, when the integer part of the pitch period T is equal to or larger than the minimum value $T_{min}$ and smaller than $T_A$, the pitch period T is expressed at fractional resolution in which the fractional value is expressed with two bits (quadruple fractional resolution); when the integer part of the pitch period T is from $T_A$ to $T_B$, the pitch period T is expressed at fractional resolution in which the fractional value is expressed with one bit (double fractional resolution); and, when the integer part of the pitch period T is from $T_B$ to the maximum value $T_{max}$, the pitch period T is expressed just as an integral multiple of the interval between sample points n (integer resolution).

In the second and fourth subframes (FIGS. 2A and 2B), the differences between the integer parts of the pitch periods $T_2$ and $T_4$ in the second and fourth subframes and the integer parts of the pitch periods $T_1$ and $T_3$ in the first and third subframes are separately encoded with four bits (difference integer parts), and the values after the decimal point (fractional parts) of the pitch periods $T_2$ and $T_4$ are encoded separately with two bits (quadruple fractional resolution) irrespective of the values of the difference integer parts. The pitch periods $T_2$ and $T_4$ have been searched in the range in which the differences between their integer parts and the integer parts of the pitch periods $T_1$ and $T_3$ respectively can be encoded with four bits. In other words, the pitch periods $T_2$ and $T_4$ have been searched in a range such that the values of the corresponding integer parts range from the values of the integer parts of the pitch periods $T_1$ and $T_3$ minus 8 to the values of the integer parts of the pitch periods $T_1$ and $T_3$ plus 7, respectively.

The bit stream BS output from the parameter encoding unit 917 of the encoder 91 (FIG. 1) is input to a parameter decoding unit 927 of a decoder 92. The parameter decoding unit 927 decodes the bit stream BS and outputs the code indexes $C_f=C_{f1}$, $C_{f2}$, $C_{f3}$, $C_{f4}$, pitch gains $g_p'=g_{p1}'$, $g_{p2}'$, $g_{p3}'$, $g_{p4}'$, fixed-codebook gains $g_c'=g_{c1}'$, $g_{c2}'$, $g_{c3}'$, $g_{c4}'$, pitch periods $T'=T_1'$, $T_2'$, $T_3'$, $T_4'$, and the linear prediction information LPC info, obtained by decoding.

A fixed codebook 924 outputs signal components c'(n) (n=0, . . . , L−1) identified by the code indexes $C_f$, and an adaptive codebook 922 outputs adaptive signal components v'(n) (n=0, . . . , L−1) identified by the pitch periods T'. Then, excitation signals u'(n) (n=0, . . . , L−1), which are the sums of the products obtained by multiplying the signal components c'(n) (n=0, . . . , L−1) by the fixed-codebook gains $g_c'$ and the products obtained by multiplying the adaptive signal components v'(n) (n=0, . . . , L−1) by the pitch gains $g_p'$, are added to the adaptive codebook 922. An all-pole synthesis filter 925 identified with the linear prediction information LPC info is applied to the excitation signals u'(n) (n=0, . . . , L−1), and synthesis signals x'(n) (n=0, . . . , L−1) generated as a result are output.

PRIOR ART LITERATURE

Non-Patent Literature

Non-patent literature 1: 3rd Generation Partnership Project (3GPP), Technical Specification (TS) 26.090, "AMR speech code; Transcoding functions", Version 4.0.0 (2001 March)

SUMMARY OF THE INVENTION

Problems to be Solved by the Invention

In the conventional CELP system, encoding is performed with fixed bits being assigned to a code for pitch periods in each frame. This is not limited to the CELP system but is also employed in the other conventional systems where the pitch periods of the targets to be encoded are obtained and encoding is performed.

In the present invention, an encoding method for pitch periods is devised to improve compression efficiency.

Means to Solve the Problems

In the encoding of the present invention, pitch periods corresponding to time series signals included in a predetermined time interval are calculated, and a code corresponding to the pitch periods are output. In that encoding, resolutions used to express the pitch periods and/or a pitch period encoding mode are switched according to whether an index that indicates the level of periodicity and/or stationarity of the time series signals satisfies a condition that indicates high periodicity and/or high stationarity or a condition that indicates low periodicity and/or low stationarity.

In decoding corresponding to this encoding, according to whether an index that indicates the level of periodicity and/or stationarity, which is included in or obtained from an input code corresponding to a predetermined time interval, satisfies a condition that indicates high periodicity and/or high stationarity or a condition that indicates low periodicity and/or low stationarity, a decoding mode for a code, included in the input code, corresponding to pitch periods is switched to decode the code corresponding to the pitch periods to obtain the pitch periods corresponding to the predetermined time interval.

Effects of the Invention

In the present invention, in a system in which the pitch periods of the targets to be encoded are obtained and then encoding is performed, since resolutions used to express the pitch periods and/or a pitch period encoding mode are switched according to the level of periodicity or stationarity of the time series signals, the compression efficiency of the pitch periods can be improved.

DETAILED DESCRIPTION OF THE EMBODIMENTS

Now, embodiments of the present invention will be described with reference to the drawings. The present invention can be applied generally to encoding systems that obtain the pitch periods of the targets to be encoded and that perform encoding. An example of applying the present invention to a CELP system will be described below. In the example described below, a single frame is divided into four equal subframes, but this will not confine the present invention. Mainly the differences from the description given earlier will be described, and already described items will not be described again.

First Embodiment

A first embodiment of the present invention will be described next. In a frame in which the time series signals x(n) (n=0, . . . , L−1) have low stationarity (are non-stationary), the time series signals x(n) (n=0, . . . , L−1) also have low periodicity (are non-periodic), and the periodic components contribute just a little to the entire code. Therefore, a lowered resolution used to express a pitch period T or a lowered encoding frequency (frequency at which the frame is encoded) does not much lower the coding quality (quality of the decoded synthesis signal with respect to the time series signals to be encoded). In the first embodiment, therefore, the resolutions used to express the pitch periods T and the encoding frequency are lowered in non-stationary (non-periodic) frames. This reduces the average code am omit per frame. As a result, the average bit rate can be reduced, or the quality can be improved by assigning the reduced amount of information, for example, to increase the length of the codes of signal components from the fixed codebook.

<Configuration>

Figure 4:
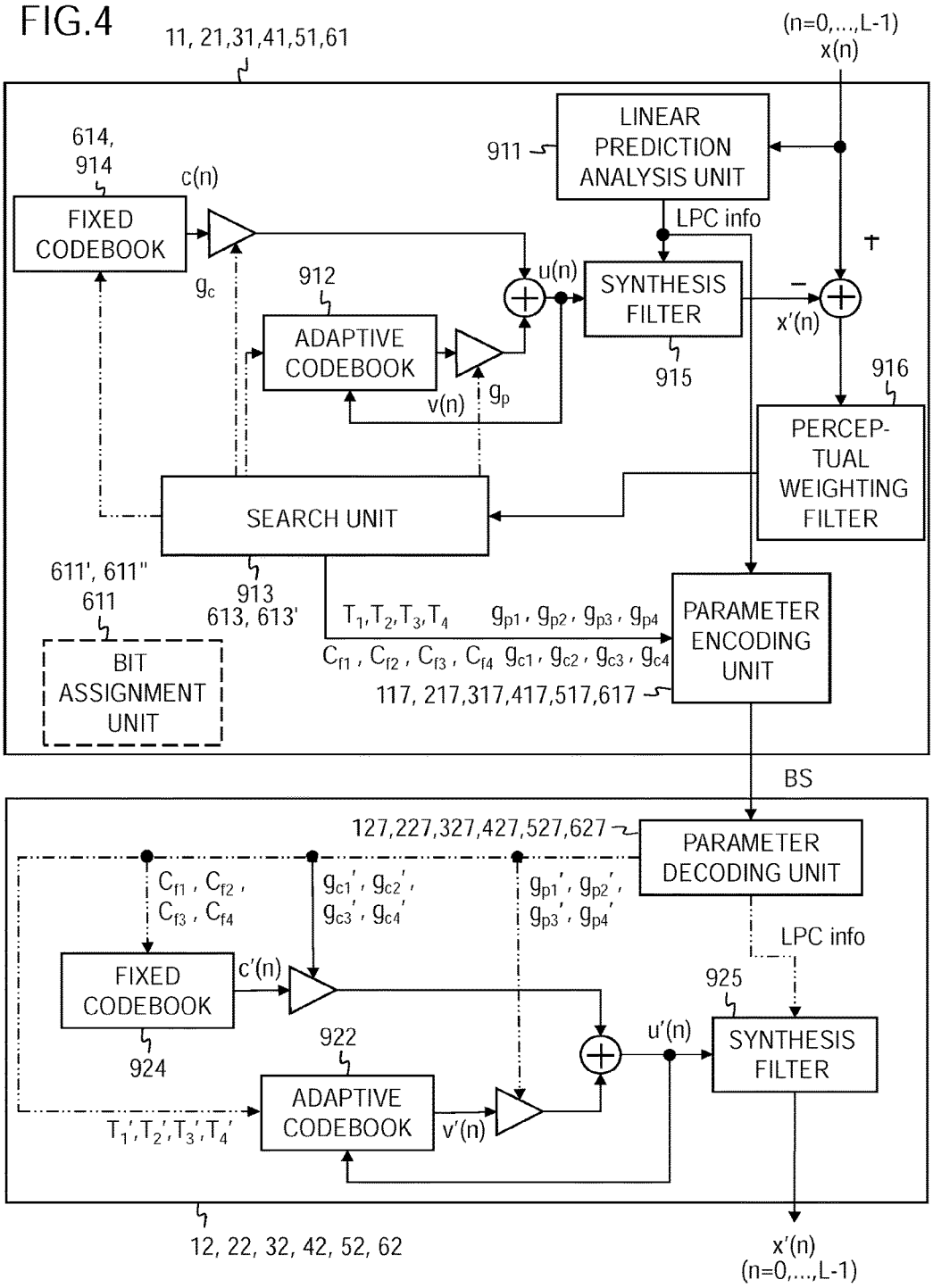
FIG. 4 is a block diagram illustrating an encoder and a decoder according to embodiments.
Figure 5:
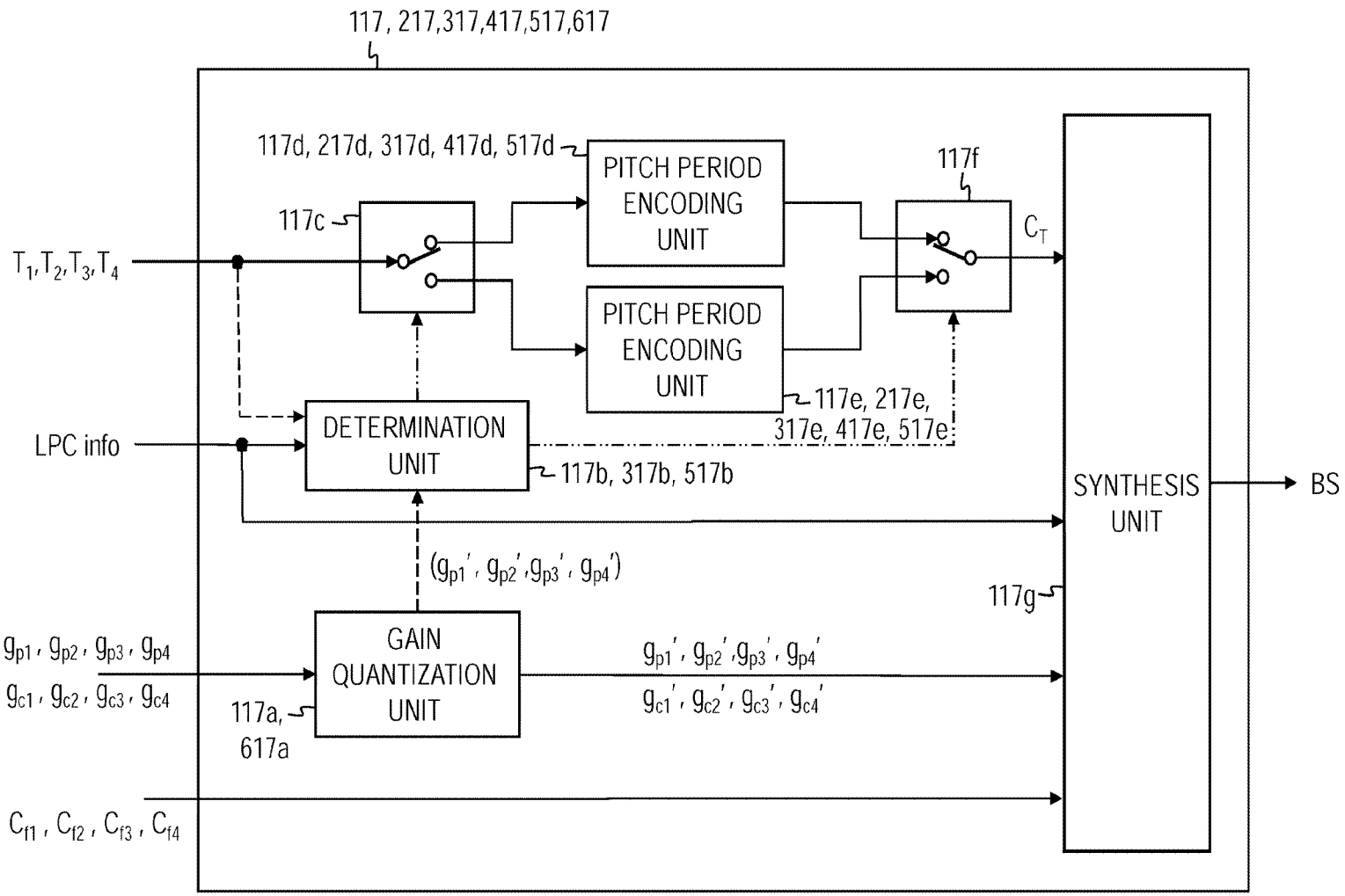
FIG. 5 is a block diagram illustrating a parameter encoding unit according to the embodiments.
Figure 6:
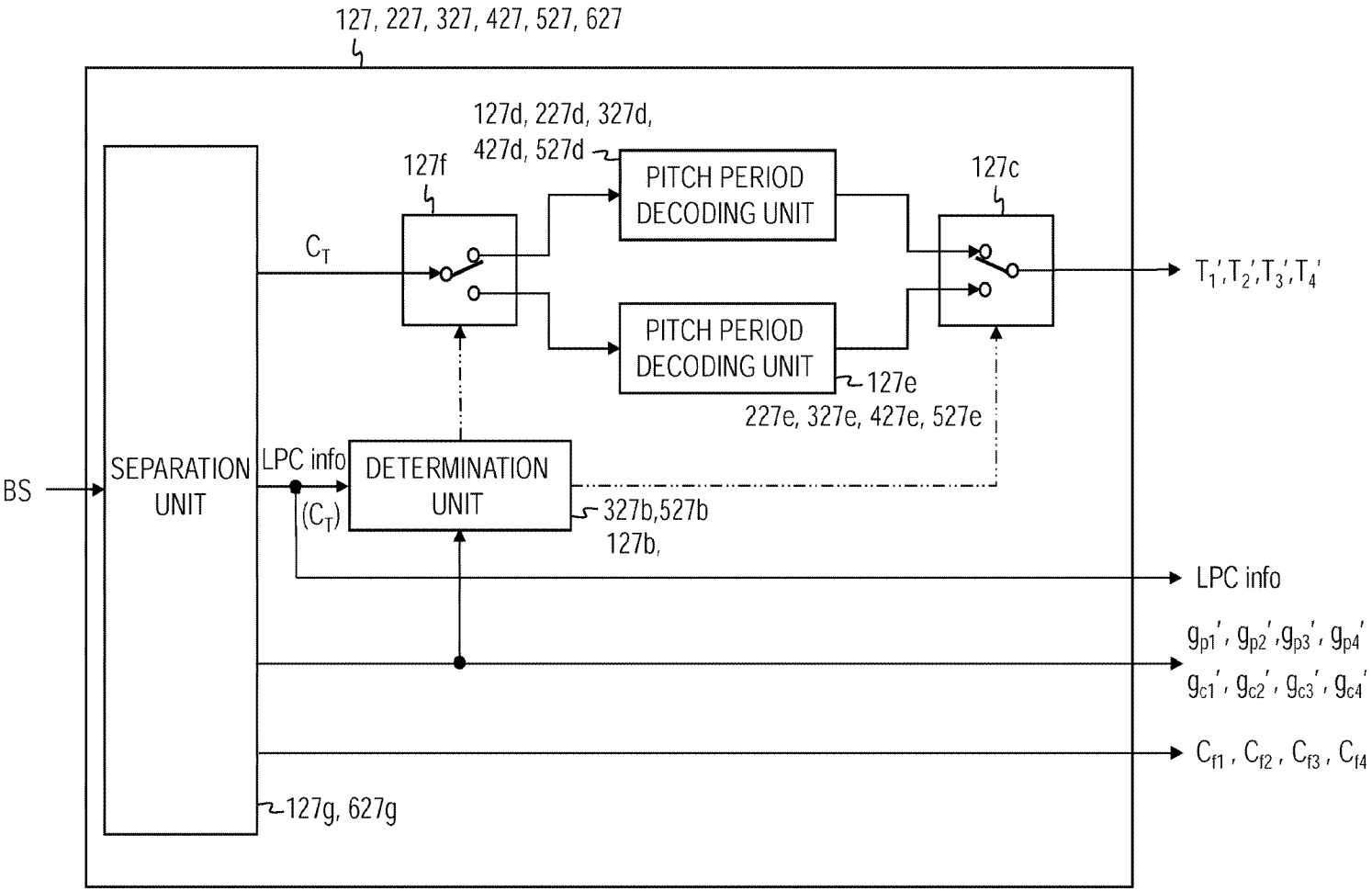
FIG. 6 is a block diagram illustrating a parameter decoding unit according to the embodiments.

FIG. 4 is a block diagram illustrating an encoder and a decoder according to the embodiments. FIG. 5 is a block diagram illustrating a parameter encoding unit of the embodiments. FIG. 6 is a block diagram illustrating a parameter decoding unit of the embodiments.

As shown in FIGS. 4 to 6 as examples, an encoder 11 in the first embodiment differs from the conventional encoder 91 in that the parameter encoding unit 917 is replaced with a parameter encoding unit 117. A decoder 12 in the first embodiment differs from the conventional decoder 92 in that the parameter decoding unit 927 is replaced with a parameter decoding unit 127.

As shown in FIG. 5 as an example, the parameter encoding unit 117 in the present embodiment includes a gain quantization unit 117*a*, a determination unit 117*b*, switches 117*c* and 117*f*, pitch period encoding units 117*d* and 117*e*, and a synthesis unit 117*g*. As shown in FIG. 6 as an example, the parameter decoding unit 127 in the present embodiment includes a determination unit 127*b*, switches 127*c* and 127*f*, pitch period decoding units 127*d* and 127*e*, and a separation unit 127*g*.

The encoder 11 and the decoder 12 in the present embodiment are particular apparatuses configured by loading programs and data into special-purpose computers or known computers that include a central processing unit (CPU), a random-access memory (RAM), a read-only memory (ROM), and the like. At least some of the processing units in the encoder 11 and the decoder 12 may be configured by hardware, such as an integrated circuit.

<Encoding Method>

Figure 7A:
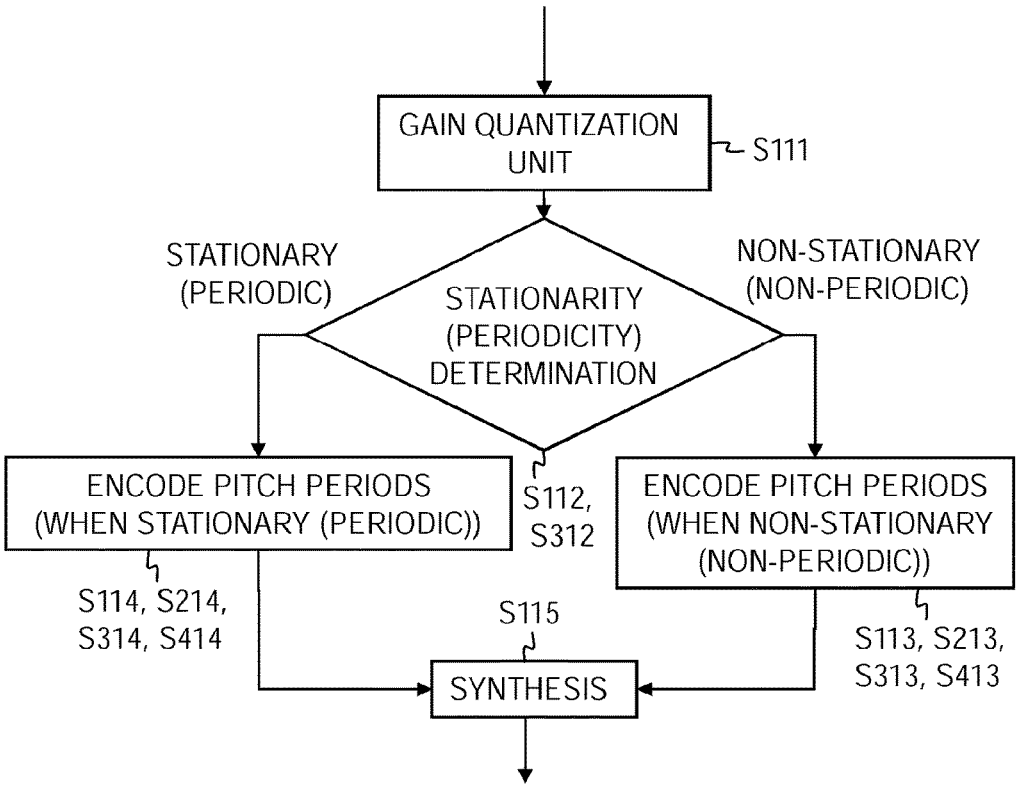
FIG. 7A is a flowchart illustrating an encoding method of embodiments.

FIG. 7A is a flowchart illustrating an encoding method according to embodiments. Mainly the differences from the conventional technique will be described.

Linear prediction information LPC info generated for the current frame by the linear prediction analysis unit 911, code indexes $C_f=C_{f1}$, $C_{f2}$, $C_{f3}$, $C_{f4}$, pitch gains $g_p=g_{p1}$, $g_{p2}$, $g_{p3}$, $g_{p4}$, fixed-codebook gains $g_c=g_{c1}$, $g_{c2}$, $g_{c3}$, $g_{c4}$, and pitch periods $T=T_1$, $T_2$, $T_3$, $T_4$, generated for the first to fourth subframes included in the current frame by the search unit 913 are input to the parameter encoding unit 117 (FIG. 5).

The gain quantization unit 117*a* of the parameter encoding unit 117 quantizes the pitch gains $g_p=g_{p1}$, $g_{p2}$, $g_{p3}$, $g_{p4}$, and the fixed-codebook gains $g_c=g_{c1}$, $g_{c2}$, $g_{c3}$, $g_{c4}$, and outputs codes such as indexes identifying quantized pitch gains $g_p'=g_{p1}'$, $g_{p2}'$, $g_{p3}'$, $g_{p4}'$, and codes such as indexes identifying quantized fixed-codebook gains $g_c'=g_{c1}'$, $g_{c2}'$, $g_{c3}'$, $g_{c4}'$.

The pitch gains $g_p=g_{p1}$, $g_{p2}$, $g_{p3}$, $g_{p4}$, and the fixed-codebook gains $g_c=g_{c1}$, $g_{c2}$, $g_{c3}$, $g_{c4}$, may be quantized separately. Alternatively, the combination of a pitch gain and the fixed-codebook gain may be vector-quantized. In vector quantization of the combination of the pitch gain and the fixed-codebook gain, a code such as an index is assigned to the combination of the quantized value of the pitch gain (quantized pitch gain) and the quantized value of the fixed-codebook gain (quantized fixed-codebook gain). The combination of the quantized pitch gain and the quantized fixed-codebook gain obtained by such vector quantization is referred to as a quantized gain vector, and a code obtained by vector quantization is referred to as a vector-quantized gain code (VQ gain code). In such vector quantization, a single VQ gain code may be assigned to each combination of the quantized value of the pitch gain and the quantized value of the fixed-codebook gain corresponding to an identical subframe; a single VQ gain code may be assigned to each combination of the quantized values of the pitch gains and the quantized values of the fixed-codebook gains corresponding to each of a plurality of subframes; or a single VQ gain code may be assigned to each combination of the quantized values of the pitch gains and the quantized values of the fixed-codebook gains corresponding to the same frame.

In such vector quantization, a table (two-dimensional codebook) for identifying a VQ gain code corresponding to the combination of the quantized value of the pitch gain and the quantized value of the fixed-codebook gain is used, for example. An example of the two-dimensional codebook is a table in which the combination of the quantized value of a pitch gain and the quantized value of the fixed-codebook gain is associated with a VQ gain code. Another example of the two-dimensional codebook is a table in which the combination of the quantized value of a pitch gain and the quantized value of a value corresponding to the fixed-codebook gain is associated with a VQ gain code. An example of the value corresponding to the fixed-codebook gain is a correction factor representing the ratio of an estimated value of the fixed-codebook gain in the current subframe (or frame) predicted on the basis of the energy of the signal components from the fixed codebook 914 in a past subframe (or frame) to the fixed-codebook gain in the current subframe (or frame). An example of the correction factor is γ included in "3.9 Quantization of the gains" in Reference literature 1 'ITU-T Recommendation G729, "Coding of Speech at 8 kbit/s using Conjugate-Structure Algebraic-Code-Excited Linear-Prediction (CS-ACELP)'". For example, the fixed-codebook gain $g_{cj}$ in a subframe j (j=1, . . . , 4), the correction factor γ, and an estimated value $pg_{cj}$ of the fixed-codebook gain in the subframe j (j=1, . . . , 4) have the relation as expressed below:

$$g_{cj}=\gamma\times pg_{cj}$$

The two-dimensional codebook may be formed by a single table or may be formed by a plurality of tables, like the two-stage conjugate structured codebook in Reference literature 1. If the two-dimensional codebook is formed by a plurality of tables, the VQ gain code corresponding to the combination of the quantized value of the pitch gain and the quantized value of the fixed-codebook gain corresponds to the combination of indexes determined in the tables constituting the two-dimensional codebook with respect to the combination of the quantized value of the pitch gain and the quantized value of the fixed-codebook gain, for example (step S111).

The determination unit 117*b* then determines whether the time series signals x(n) (n=0, . . . , L−1) of the current frame are stationary or not (step S112). The determination in step S112 is based on whether an index that indicates the level of stationarity of the time series signals x(n) (n=0, . . . , L−1) satisfies a condition in which the time series signals are regarded as being highly stationary. Example specific determination methods will be described below.

[Specific Case 1 of Step S112]

In a specific case 1 of step S112, as an index that indicates the level of stationarity of the time series signals x(n) (n=0, . . . , L−1), an index that indicates the ratio of the magnitude of the time series signals x(n) (n=0, . . . , L−1) to the magnitude of the prediction residuals obtained by linear prediction analysis of the time series signals x(n) (n=0, . . . , L−1) is used. Used as the condition that indicates high stationarity of the time series signals x(n) (n=0, . . . , L−1) is a condition in which the index that indicates the ratio of the magnitude of the time series signals x(n) (n=0, . . . , L−1) to the magnitude of the prediction residuals obtained by linear prediction analysis of the time series signals x(n) (n=0, . . . , L−1) is larger than a specified value. This is because highly effective linear prediction is possible in a stationary frame, the prediction residuals become small, increasing the ratio of the magnitude of the time series signals x(n) (n=0, . . . , L−1) to the magnitude of the prediction residuals.

An example of the index that indicates the ratio of the magnitude of the time series signals x(n) (n=0, . . . , L−1) to the magnitude of the prediction residuals obtained by linear prediction analysis of the time series signals x(n) (n=0, . . . , L−1) is an estimated value of the prediction gain, which is the ratio of the energy of the time series signals x(n) (n=0, . . . , L−1) to the energy of the prediction residuals as follows:

$$E = 1 \Big/ \prod_{m=1}^{P} (1 - k_m^2) \tag{2}$$

In Equation (2), $k_m$ is an m-th order PARCOR coefficient determined from the linear prediction information LPC info. In this case, for example, the linear prediction information LPC info is input to the determination unit 117*b*, and the determination unit 117*b* determines whether the estimated value E of the prediction gain obtained from the linear prediction information LPC info is larger than a specified value. When the estimated value E of the prediction gain is larger than the specified value, the time series signals x(n) (n=0, . . . , L−1) of the current frame are determined to be stationary; otherwise, the time series signals x(n) (n=0, . . . , L−1) of the current frame are determined to be not stationary (to be non-stationary).

Alternatively, the determination may be made by using the prediction gain, the ratio of the absolute values of the time series signals x(n) (n=0, . . . , L−1) to the absolute values of the prediction residuals, or an estimated value of the ratio of the absolute values of the time series signals x(n) (n=0, . . . , L−1) to the absolute values of the prediction residuals, instead of the estimated value E of the prediction gain.

Whether the index is larger than the specified value may be determined by checking whether the condition "index">"specified value" is satisfied. Alternatively, whether the index is larger than the specified value may be determined by checking whether the condition "index"≥("specified value"+"constant") is satisfied. In that case, the specified value may be specified as a processing threshold, or ("specified value"+"constant") may be specified as a processing threshold. The same applies to the determination of whether an index is larger than a specified value, described below.

[Specific Case 2 of Step S112]

In specific case 2 of step S112, the quantized pitch gain is used as an index that indicates the level of stationarity of the time series signals x(n) (n=0, . . . , L−1). As a condition indicating that the time series signals x(n) (n=0, . . . , L−1) have a high stationarity, a condition in which the quantized pitch gain is larger than a specified value is used. This is because, in a stationary frame, the pitch periods have a high periodicity and the pitch gains are large.

In this case, for example, the quantized pitch gains $g_p'=g_{p1}'$, $g_{p2}'$, $g_{p3}'$, $g_{p4}'$ are input to the determination unit 117*b*, and the determination unit 117*b* determines whether the average of the quantized pitch gains $g_p'=g_{p1}'$, $g_{p2}'$, $g_{p3}'$, $g_{p4}'$, is larger than the specified value. If the average of the quantized pitch gains $g_p'=g_{p1}'$, $g_{p2}'$, $g_{p3}'$, $g_{p4}'$, is larger than the specified value, the time series signals x(n) (n=0, . . . , L−1) in the current frame are determined to be stationary; otherwise, the time series signals x(n) (n=0, . . . , L−1) in the current frame are determined to be not stationary (to be non-stationary). Instead of the average of the quantized pitch gains $g_p'=g_{p1}'$, $g_{p2}'$, $g_{p3}'$, $g_{p4}'$, the average of quantized pitch gains (average of $g_{p1}'$ and $g_{p3}'$, for example) in some subframes or the quantized pitch gain ($g_{p1}'$, for example) in a single subframe may be used in the determination. The determination based on the quantized pitch gain in a single subframe would be improved in performance if the smallest one of the quantized pitch gains of all the subframes in the frame were used for the determination. Alternatively, the signals may be determined to be stationary when all the quantized pitch gains $g_p'=g_{p1}'$, $g_{p2}'$, $g_{p3}'$, $g_{p4}'$, are larger than the specified value, and the signals may be determined not to be stationary (to be non-stationary) when at least a part of the quantized pitch gains $g_p'=g_{p1}'$, $g_{p2}'$, $g_{p3}'$, $g_{p4}'$ are not larger than the specified value. Alternatively, the signals may be determined to be stationary when a predetermined number of quantized pitch gains $g_p'=g_{p1}'$, $g_{p2}'$, $g_{p3}'$, $g_{p4}'$, or more are larger than the specified value; otherwise, the signals may be determined not to be stationary (to be non-stationary).

[Specific Case 3 of Step S112]

In specific case 3 of step S112, as an index that indicates the level of stationarity of the time series signals x(n) (n=0, . . . , L−1), the ratio between a value corresponding to the quantized pitch gain and a value corresponding to the quantized fixed-codebook gain is used. An example of the criterion for determination using this index will be shown below. The criterion for determination is based on the fact that, in a stationary frame, the pitch periods have a high periodicity, and the ratio of the value corresponding to the pitch gain to the value corresponding to the fixed-codebook gain is large.

Determination criterion: When the ratio of the value corresponding to the quantized pitch gain to the value corresponding to the quantized fixed-codebook gain is not smaller than a specified value or when the ratio of the value corresponding to the quantized fixed-codebook gain to the value corresponding to the quantized pitch gain is not larger than a specified value, it is determined that the time series signals x(n) (n=0, . . . , L−1) are stationary. Examples of the value corresponding to the quantized fixed-codebook gain include the quantized fixed-codebook gain itself, and a quantized value of the correction factor, described earlier. Examples of the value corresponding to the quantized pitch gain include the quantized pitch gain itself, the average of quantized pitch gains, and the value of a weakly monotonically increasing function of the quantized pitch gain.

In this case, for example, the combination of the value corresponding to the quantized pitch gain and the value corresponding to the quantized fixed-codebook gain is input to the determination unit 117*b*, and the determination unit 117*b* determines, in accordance with the determination criterion, whether the time series signals x(n) (n=0, . . . , L−1) are stationary (periodic). For example, the determination unit 117*b* makes this determination by using the combination of the value corresponding to the quantized pitch gain and the value corresponding to the quantized fixed-codebook gain in a single subframe (first subframe, for example), to determine whether the time series signals x(n) (n=0, . . . , L−1) are stationary (periodic). Alternatively, the determination unit 117*b* may make the determination in each subframe by using the combination of the value corresponding to the quantized pitch gain and the value corresponding to the quantized fixed-codebook gain in a plurality of subframes included in a single frame in accordance with the determination criterion, and whether the time series signals x(n) (n=0, . . . , L−1) are stationary (periodic) may be determined according to the results of determination. When the results of all determinations made by using the combinations of the values corresponding to the quantized pitch gains and the values corresponding to the quantized fixed-codebook gains in the subframes indicate that the signals are stationary (periodic), it may be determined that the time series signals x(n) (n=0, . . . , L−1) are stationary (periodic). Alternatively, when the results of determinations made by using the combinations of the values corresponding to the quantized pitch gains and the values corresponding to the quantized fixed-codebook gains in a predetermined number, or more, of subframes indicate that the signals are stationary (periodic), it may be determined that the time series signals x(n) (n=0, . . . , L−1) are stationary (periodic). When the determination criterion is not satisfied, it is determined that the time series signals x(n) (n=0, . . . , L−1) are not stationary (are non-stationary).

[Specific Case 4 of Step S112]

In specific case 4 of step S112, a value corresponding to the quantized pitch gain and a value corresponding to the quantized fixed-codebook gain are used as indexes that indicate the level of stationarity of the time series signals x(n) (n=0, . . . , L−1) and are compared with a first specified value and a second specified value, respectively.

In a stationary frame, the pitch periods usually have a high periodicity and the pitch gains are high. In a frame in a rising part of speech, however, the pitch periods have a low periodicity from the preceding frame and the pitch gains are low, but the pitch periods have a high periodicity within the frame. In the frame in the rising part of speech, estimated values $pg_{cj}$ of the fixed-codebook gains of the current frame, estimated by using the preceding frame, are small. Since the quantized fixed-codebook gains $g_c'$ of the current frame are determined to be $g_c'=\gamma_{gc}\hat{}\times pg_{cj}$ ($\gamma_{gc}\hat{}$ are quantized correction factors), $\gamma_{gc}\hat{}$ (values corresponding to the quantized fixed-codebook gains) become large in the frame in the rising part of speech. Therefore, even when the values corresponding to the pitch gains are small, if the values corresponding to the quantized fixed-codebook gains are large, the frame can be regarded as being stationary. Conversely, when the values corresponding to the pitch gains are small, if the values corresponding to the quantized fixed-codebook gains are small, the frame can be regarded as not being stationary. Examples of determination criteria using these indexes will be shown below.

Determination criterion 1: When the value corresponding to the quantized pitch gain is smaller than the first specified value and when the value corresponding to the quantized fixed-codebook gain is smaller than the second specified value, the time series signals x(n) (n=0, . . . , L−1) are determined not to be stationary (to be non-stationary).

Determination criterion 2: When the value corresponding to the quantized pitch gain is smaller than the first specified value and when the value corresponding to the quantized fixed-codebook gain is larger than the second specified value, the time series signals x(n) (n=0, . . . , L−1) are determined to be stationary.

Examples of values corresponding to the quantized pitch gains include the quantized pitch gains themselves, the average of the quantized pitch gains, and values of a weakly monotonically increasing function of the quantized pitch gains. An example of the quantized pitch gains is $\hat{g}_p$ (quantified adaptive codebook gains) in Non-patent literature 1. Examples of values corresponding to the quantized fixed-codebook gains include the quantized fixed-codebook gains themselves and the quantized correction factors $\hat{\gamma}_{gc}$. An example of the quantized correction factors $\hat{\gamma}_{gc}$ is $\hat{\gamma}_{gc}$ (optimum values for $\gamma_{gc}$) in Non-patent literature 1.

In this case, for example, a combination of the value corresponding to the quantized pitch gain and the value corresponding to the quantized fixed-codebook gain is input to the determination unit 117*b*, and the determination unit 117*b* determines, in accordance with the determination criterion 1 or 2, whether the time series signals x(n) (n=0, . . . , L−1) are not stationary (periodic) (alternatively, whether the time series signals x(n) (n=0, . . . , L−1) are stationary (periodic)). The determination unit 117*b* makes this determination by using the combination of the value corresponding to the pitch gain quantized in a given subframe (first subframe, for example) and the value corresponding to the quantized fixed-codebook gain, for example, and determines whether the time series signals x(n) (n=0, . . . , L−1) are not stationary (periodic) (alternatively, whether the time series signals x(n) (n=0, . . . , L−1) are stationary (periodic)). Alternatively, the determination unit 117*b* makes a determination based on the determination criterion 1 or 2 by using the combination of the value corresponding to the pitch gain quantized in each of the plurality of subframes included in the same frame and the value corresponding to the quantized fixed-codebook gain, for example, and determines accordingly whether the time series signals x(n) (n=0, . . . , L−1) are stationary (periodic) or not. When the results of all determinations made by using the combinations of the values corresponding to the quantized pitch gains and the values corresponding to the quantized fixed-codebook gains in the subframes indicate that the signals are stationary (periodic), the time series signals x(n) (n=0, . . . , L−1) may be determined to be stationary (periodic). Alternatively, when the results of determination made by using the combinations of the values corresponding to the quantized pitch gains and the values corresponding to the quantized fixed-codebook gains in a specified number of subframes or more indicate that the signals are stationary (periodic), the time series signals x(n) (n=0, . . . , L−1) may be determined to be stationary (periodic). Another condition may be added to the determination criterion 1 or 2, and an actual difference may be added to the determination criteria.

[Specific Case 5 of Step S112]

Specific case 5 of step S112 is used when a combination of a pitch gain and a fixed-codebook gain is vector-quantized, and the combination of the quantized pitch gain and the quantized fixed-codebook gain is associated with a VQ gain code in step S111. In this case, the VQ gain code is used as an index that indicates the level of stationarity of the time series signals x(n) (n=0, . . . , L−1). For example, the determination made in specific cases 2, 3, or 4 of step S112 is made by using the VQ gain code as the index. An example determination method using the VQ gain code as the index will be described below.

As described earlier, the VQ gain code has a one-to-one correspondence with the combination of the quantized value of the pitch gain and the quantized value of the fixed-codebook gain or the combination of the quantized value of the pitch gain and the quantized value of the value corresponding to the fixed-codebook gain. Therefore, each determination result in specific cases 2 to 4 of step S112, described above, can be associated with the VQ gain code. More specifically, in specific case 2 of step S112, since the determination is made by using the quantized pitch gain as the index, the VQ gain code corresponding to the quantized pitch gain (value corresponding to the quantized pitch gain) used as the index can be associated with the determination result. In specific case 3 of step S112, since the determination is made by using the ratio between the value corresponding to the quantized pitch gain and the value corresponding to the quantized fixed-codebook gain as the index, the VQ gain code corresponding to the ratio used as the index and the determination result can be associated with each other. In specific case 4 of step S112, since the determination is made by using the value corresponding to the quantized pitch gain and the value corresponding to the quantized fixed-codebook gain as the indexes, the VQ gain code corresponding to the combination of the value corresponding to the quantized pitch gain and the value corresponding to the quantized fixed-codebook gain used as the indexes and the determination result can be associated with each other. Therefore, it is possible that the determinations of whether the signals are not stationary (are non-stationary) are made in advance based on any of specific cases 2 to 4 of step S112, described earlier, and a table associating such determination results with the VQ gain codes corresponding to the determination results is stored in the determination unit 117*b*. The determination unit 117*b* can obtain the determination result corresponding to the input VQ gain code with reference to the table. Alternatively, since the resolutions used to express the pitch periods and/or the pitch period encoding mode are determined in accordance with such determination result, a table associating VQ gain codes with resolutions used to express the pitch periods and/or pitch period encoding modes can be stored in the determination unit 117*b*. Then, the determination unit 117*b* can obtain the resolution used to express the pitch period and/or the pitch period encoding mode corresponding to the input VQ gain code, with reference to the table (end of description of specific cases 1 to 5 of step S112).

Figure 1:
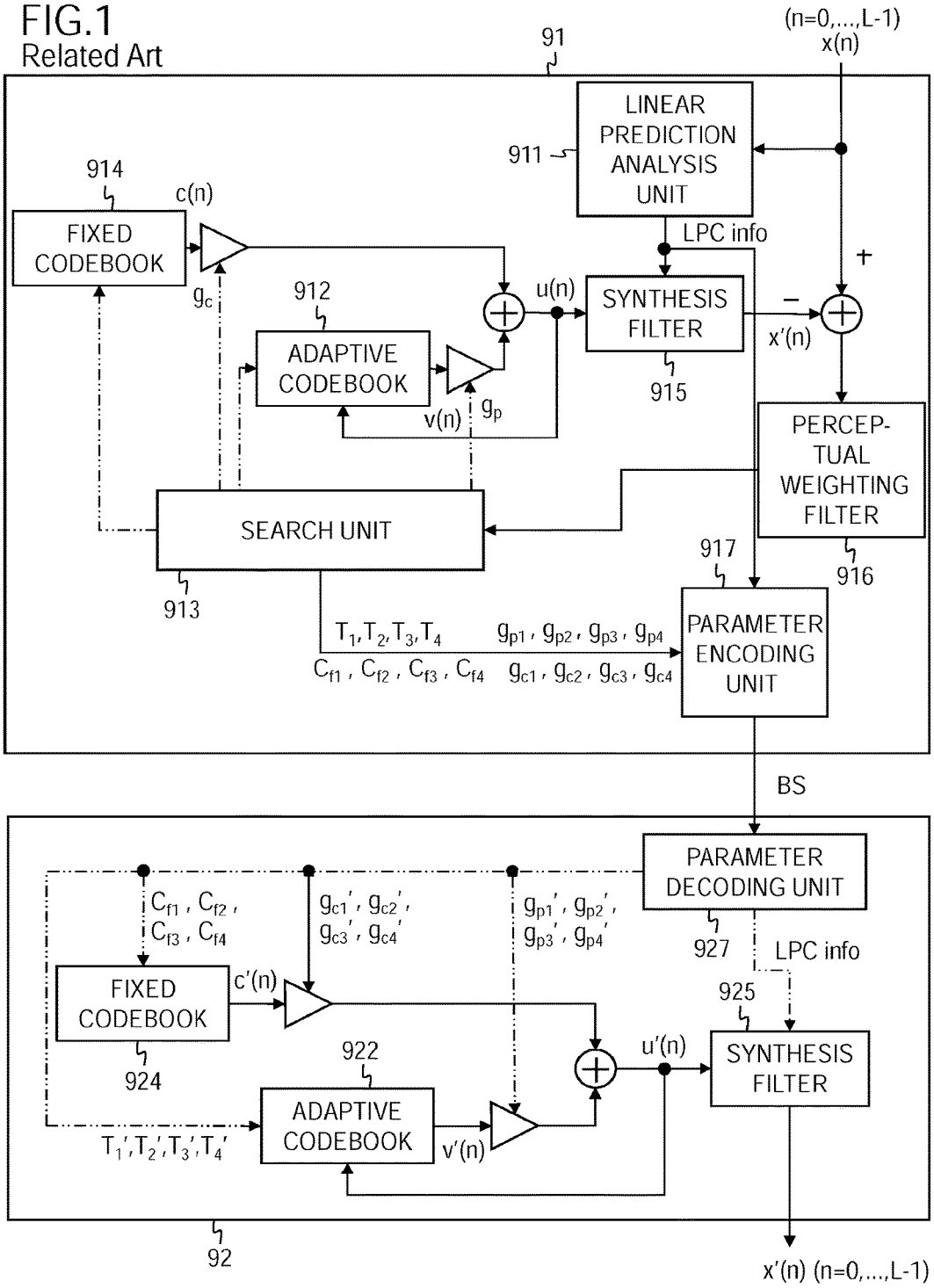
FIG.1 Related Art
FIG. 1 is a block diagram illustrating an example of a conventional CELP system.
Figure 2A:
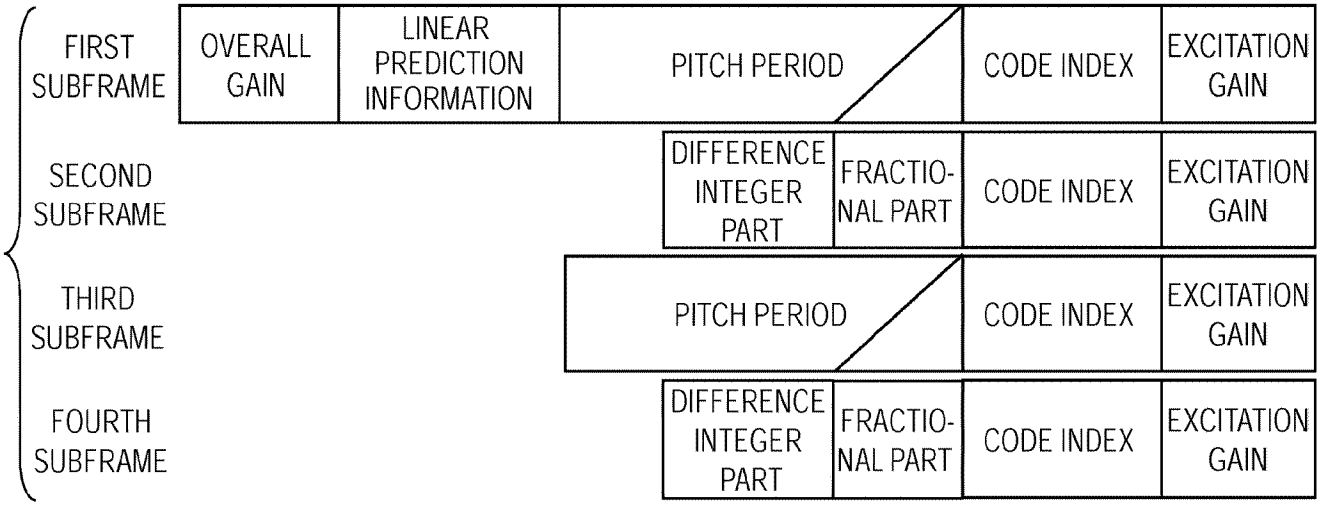
FIG.2A Related Art
FIG. 2A is a view showing an example structure of a bit stream BS when pitch periods T having fractional resolution are used.

If it is determined in step S112 that the index that indicates the stationarity of the time series signals x(n) (n=0, . . . , L−1) does not satisfy the condition that indicates high stationarity of the time series signals x(n) (n=0, . . . , L−1) (if it is determined that the signals are non-stationary), the switch 117*c* sends the pitch periods $T=T_1$, $T_2$, $T_3$, $T_4$ to the pitch period encoding unit 117*d* under the control of the determination unit 117*b*. The pitch period encoding unit 117*d* outputs a code obtained by encoding, at every first time interval, the pitch period expressed at the first resolution, as will be described later (step S113). If it is determined in step S112 that the index that indicates the stationarity of the time series signals x(n) (n=0, . . . , L−1) satisfies the condition that indicates high stationarity of the time series signals x(n) (n=0, . . . , L−1) (if it is determined that the signals are stationary), the switch 117*c* sends the pitch periods $T=T_1$, $T_2$, $T_3$, $T_4$ to the pitch period encoding unit 117*e* under the control of the determination unit 117*b* (FIG. 5). The pitch period encoding unit 117*e* outputs a code obtained by encoding, at every second time interval, the pitch period expressed at the second resolution. The second resolution is higher than the first resolution, and/or the second time interval is shorter than the first time interval. For example, the pitch period encoding unit 117*e* generates a code $C_T$ corresponding to the pitch periods T of the current frame and outputs it (step S114), in the same way as in the conventional case (see FIGS. 2A and 2B).

[Specific Case 1 of Steps S113 and S114]

Figure 8A:
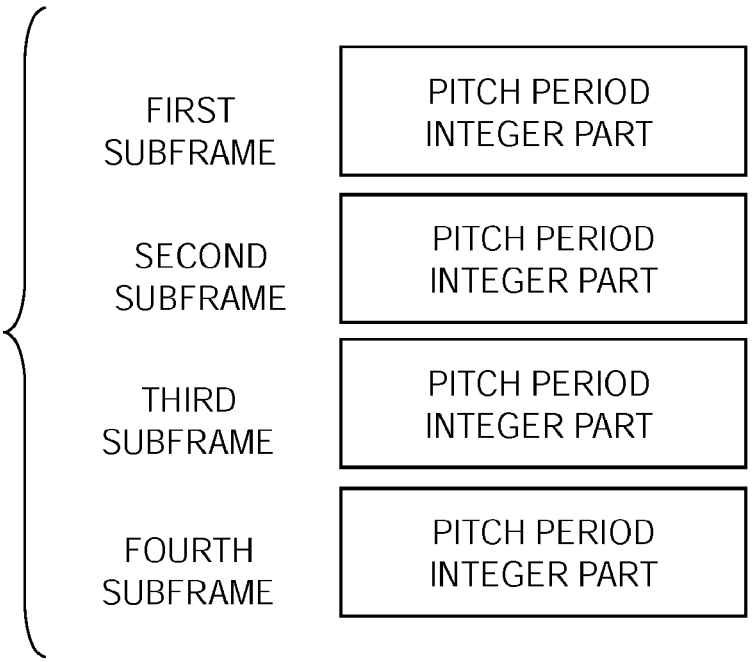
FIGS. 8A and 8B are views illustrating example structures of codes for pitch periods.

In step S113 (non-stationary) of this case, the pitch period encoding unit 117*d* limits the resolutions used to express the pitch periods $T=T_1$, $T_2$, $T_3$, $T_4$ to the integer resolution (first resolution), encodes the pitch periods T separately in each subframe, and generates a code $C_T$ corresponding to the pitch periods T of the current frame. FIG. 8A is a view illustrating an example structure of the code $C_T$ corresponding to the pitch periods T of the current frame generated in step S113. In the example shown in FIG. 8A, the pitch periods $T=T_1$, $T_2$, $T_3$, $T_4$ are expressed at the integer resolution in the first to fourth subframes, and each of the pitch periods $T=T_1$, $T_2$, $T_3$, $T_4$ is encoded with six bits (integer part of the pitch period).

In step S114 (stationary) of this case, the pitch period encoding unit 117*e* uses fractional resolution (second resolution) or the integer resolution as the resolutions used to express the pitch periods $T_1$ and $T_3$ and encodes them separately in the corresponding subframes. The pitch period encoding unit 117*e* also encodes the differences between the integer parts of the pitch periods $T_2$ and $T_4$ expressed at fractional resolution (second resolution) and the integer parts of the pitch periods $T_1$ and $T_3$. The pitch period encoding unit 117*e* further encodes the values after the decimal point (fractional parts) of the pitch periods $T_2$ and $T_4$ separately with two bits (see FIG. 2B).

[Specific Case 2 of Steps S113 and S114]

Figure 8B:
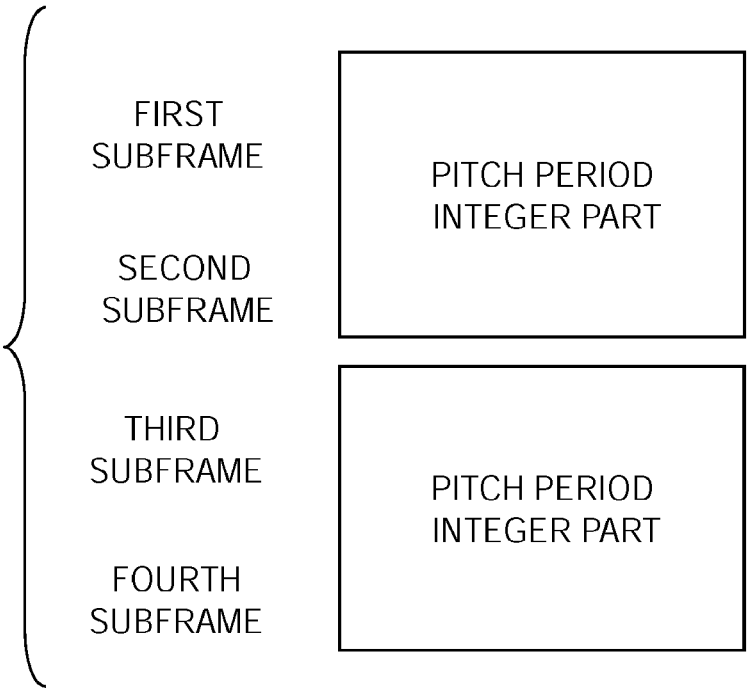

In step S113 (non-stationary) of this case, the pitch period encoding unit 117*d* obtains a code corresponding to the pitch periods in each time interval (first time interval) composed of a plurality of subframes and generates a code $C_T$ corresponding to the pitch periods T of the current frame. This means that a code is generated by using a common pitch period T for a plurality of subframes (pitch period encoding frequency is lowered). FIG. 8B is a view illustrating an example structure of the code $C_T$ corresponding to the pitch periods T of the current frame generated in step S113. In the example shown in FIG. 8B, one of the codes obtained by encoding the pitch periods $T_1$ and $T_2$ expressed at the integer resolution is used as the code of the pitch period T for both the first subframe and the second subframe, and one of the codes obtained by encoding the pitch periods $T_3$ and $T_4$ expressed at the integer resolution is used as the code of the pitch period T for both the third subframe and the fourth subframe.

In step S114 (stationary) of this case, the pitch period encoding unit 117*e* encodes each of the pitch periods $T_1$, $T_2$, $T_3$, and $T_4$ in each subframe (second time interval). In the example shown in FIG. 2B, the values of the pitch periods $T_1$ and $T_3$ are encoded separately in each subframe, the differences between the integer parts of the pitch periods $T_2$ and $T_4$ and the integer parts of the pitch periods $T_1$ and $T_3$ are encoded, and the values after the decimal point (fractional parts) of the pitch periods $T_2$ and $T_4$ are encoded separately with two bits (see FIG. 2B; end of description of specific cases 1 and 2 of steps S113 and S114]).

The code $C_T$ corresponding to the pitch periods T of the current frame, output from the pitch period encoding unit 117*d* or 117*e*, is sent to the synthesis unit 117*g* by the switch 117*f* under the control of the determination unit 117*b*. The synthesis unit 117*g* generates a bit stream BS by combining the linear prediction information LPC info, the code indexes $C_f=C_{f1}$, $C_{f2}$, $C_{f3}$, $C_{f4}$, the code $C_T$ corresponding to the pitch periods T of the current frame, codes representing the quantized pitch gains $g_p'=g_{p1}'$, $g_{p2}'$, $g_{p3}'$, $g_{p4}'$, and codes representing the quantized fixed-codebook gains $g_c'=g_{c1}'$, $g_{c2}'$, $g_{c3}'$, $g_{c4}'$, and outputs the bit stream. The bit stream BS may include indexes such as VQ gain codes instead of the codes representing the quantized pitch gains $g_p'=g_{p1}'$, $g_{p2}'$, $g_{p3}'$, $g_{p4}'$ and the codes representing the quantized fixed-codebook gains $g_c'=g_{c1}'$, $g_{c2}'$, $g_{c3}'$, $g_{c4}'$ (step S115).

<Decoding Method>

Figure 7B:
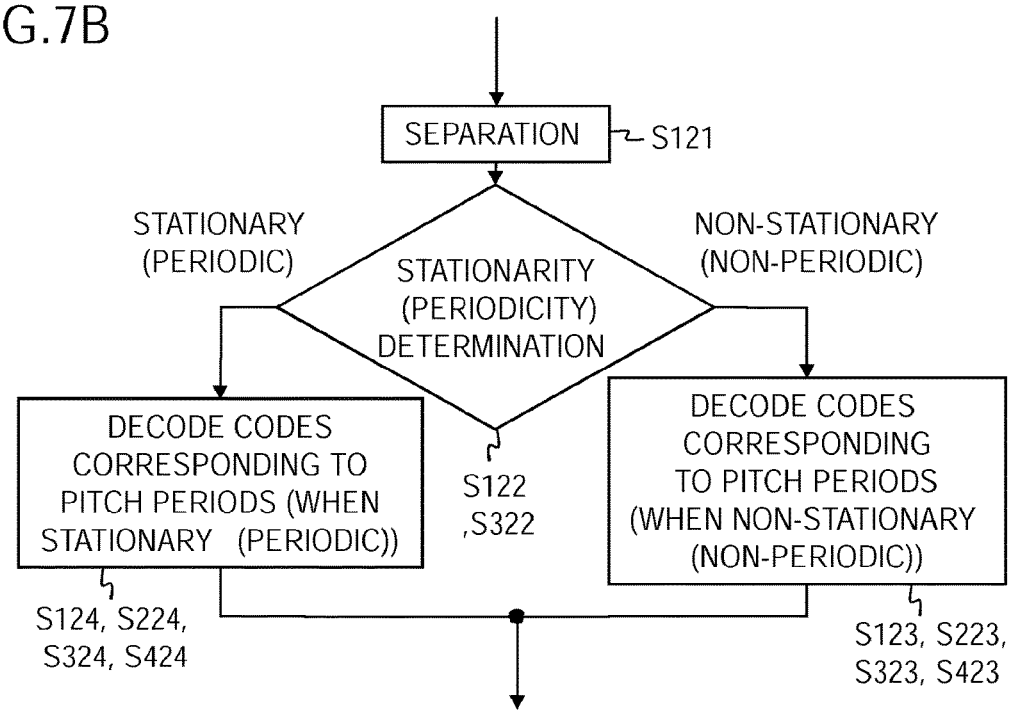
FIG. 7B is a flowchart illustrating a decoding method of embodiments.

FIG. 7B is a flowchart illustrating a decoding method of embodiments. Mainly the differences from the conventional technique will be described.

The bit stream BS is input to the parameter decoding unit 127 (FIG. 6) of the decoder 12. The parameter decoding unit 127 decodes the bit stream BS to generate, or separates from the bit stream BS, the linear prediction information LPC info, the code indexes $C_f=C_{f1}$, $C_{f2}$, $C_{f3}$, $C_{f4}$, the code $C_T$ corresponding to the pitch periods T of the current frame, the quantized pitch gains $g_p'=g_{p1}'$, $g_{p2}'$, $g_{p3}'$, $g_{p4}'$, and the quantized fixed-codebook gains $g_c'=g_{c1}'$, $g_{c2}'$, $g_{c3}'$, $g_{c4}'$, and outputs them. The quantized pitch gains $g_p'=g_{p1}'$, $g_{p2}'$, $g_{p3}'$, $g_{p4}'$ and the quantized fixed-codebook gains $g_c'=g_{c1}'$, $g_{c2}'$, $g_{c3}'$, $g_{c4}'$ are obtained by decoding the codes representing the quantized pitch gains $g_p'=g_{p1}'$, $g_{p2}'$, $g_{p3}'$, $g_{p4}'$, and the codes representing the quantized fixed-codebook gains $g_c'=g_{c1}'$, $g_{c2}'$, $g_{c3}'$, $g_{c4}'$, included in the bit stream BS or the VQ gain codes included in the bit stream BS (step S121).

Next, in order to identify the decoding mode for the code $C_T$, the determination unit 127*b* determines whether the time series signals x(n) (n=0, . . . , L−1) corresponding to the bit stream BS of the current frame was stationary or not (step S122). The determination in step S122 is based on whether the index that indicates the level of stationarity of the time series signals x(n) (n=0, . . . , L−1) satisfies the condition in which the time series signals are regarded as being highly stationary. The determination is made by using the same method as used in step S112 performed by the encoder 11.

[When Specific Case 1 of Step S112 is Used in Encoder 11]

In this case, the determination unit 127*b* also uses an index that indicates the ratio of the magnitude of the time series signals x(n) (n=0, . . . , L−1) to the magnitude of the prediction residuals obtained by linear prediction analysis of the time series signals x(n) (n=0, . . . , L−1) (a predicted value E of the prediction gain, for example), as the index that indicates the level of stationarity of the time series signals x(n) (n=0, . . . , L−1). The condition indicating that the time series signals x(n) (n=0, . . . , L−1) are highly stationary is a condition in which the index that indicates the ratio of the magnitude of the time series signals x(n) (n=0, . . . , L−1) to the magnitude of the prediction residuals obtained by linear prediction analysis of the time series signals x(n) (n=

0, . . . , L−1) is higher than a specified value. The details of the determination are the same as those described in specific case 1 of step S112.

[When Specific Case 2 of Step S112 is Used in Encoder 11]

In this case, the determination unit 127*b* also uses a quantized pitch gain as the index that indicates the level of stationarity of the time series signals x(n) (n=0, . . . , L−1). Used as the condition indicating that the time series signals x(n) (n=0, . . . , L−1) are highly stationary is a condition in which the quantized pitch gain is higher than a specified value. The details of the determination are the same as those described in specific case 2 of step S112.

[When Specific Case 3 of Step S112 is Used in Encoder 11]

In this case, the determination unit 127*b* also uses the ratio between the value corresponding to the quantized pitch gain and the value corresponding to the quantized fixed-codebook gain, as the index that indicates the level of stationarity of the time series signals x(n) (n=0, . . . , L−1). The details of the determination are the same as those described in specific case 3 of step S112.

[When Specific Case 4 of Step S112 is Used in Encoder 11]

In this case, the determination unit 127*b* also uses the value corresponding to the quantized pitch gain and the value corresponding to the quantized fixed-codebook gain as the indexes that indicate the level of stationarity of the time series signals x(n) (n=0, . . . , L−1) and compares them with the first specified value and the second specified value, respectively. The details of the determination are the same as those described in specific case 4 of step S112.

[When Specific Case 5 of Step S112 is Used in Encoder 11]

In this case, the determination unit 127*b* uses each of the VQ gain codes included in the bit stream BS as the index that indicates the level of stationarity of the time series signals x(n) (n=0, . . . , L−1). The details of the determination are the same as those described in specific case 5 of step S112. For example, a table associating the determination results described in specific case 5 of step S112 with the VQ gain codes corresponding to the determination results is stored in the determination unit 127*b*, and the determination unit 127*b* obtains the determination result corresponding to an input VQ gain code with reference to the table. As described earlier, the resolutions used to express the pitch periods and/or the pitch period encoding mode are determined in accordance with the determination result, and the corresponding decoding mode is also determined. Therefore, the determination unit 127*b* can also store a table associating the VQ gain codes with the resolutions used to express the pitch periods and/or the pitch period decoding mode. In that case, the determination unit 127*b* can obtain the resolutions used to express the pitch periods and/or the pitch period decoding mode, corresponding to the input VQ gain code, with reference to the table (end of description of the specific cases of step S122).

The decoding method for the code $C_T$ is switched in accordance with the determination result in step S122.

If it is determined in step S122 that the index that indicates the stationarity of the time series signals x(n) (n=0, . . . , L−1) corresponding to the bit stream BS does not satisfy the condition indicating that the time series signals x(n) (n=0, . . . , L−1) are highly stationary (if it is determined that the signals were non-stationary), the switch 127*f* sends the code $C_T$ of the current frame to the pitch period decoding unit 127*d* under the control of the determination unit 127*b*. The pitch period decoding unit 127*d* decodes the code $C_T$ through decoding corresponding to encoding performed in the pitch period encoding unit 117*d* (FIG. 5) and outputs the pitch periods $T'=T_1'$, $T_2'$, $T_3'$, $T_4'$ of the current frame (step S123). Specific cases of the processing in step S123 will be described below.

[When Specific Case 1 of Step S113 is Used in Encoder 11]

In this case, the pitch period decoding unit 127*d* extracts the pitch periods $T_1'$, $T_2'$, $T_3'$, and $T_4'$ of the first to fourth subframes expressed at the integer resolution (first resolution) from the code $C_T$ and outputs them.

[When Specific Case 2 of Step S113 is Used in Encoder 11]

In this case, the pitch period decoding unit 127*d* extracts each pitch period for each time interval (first time interval) formed of a plurality of subframes from the code $C_T$ and outputs them. In other words, a code corresponding to the pitch periods is decoded in a decoding mode that obtains each pitch period for each first time interval. In the example shown in FIG. 8B, where the total of the first and second subframes is the first time interval and the total of the third and fourth subframes is the first time interval, the same pitch period $T_1'$ is extracted as the pitch periods $T_1'$ and $T_2'$ of the first and second subframes, and the same pitch period $T_3'$ is extracted as the pitch periods $T_3'$ and $T_4'$ of the third and fourth subframes, and the pitch periods $T_1'$, $T_2'$, $T_3'$, and $T_4'$ are output (end of description of the specific cases of step S123).

If it is determined in step S122 that the index that indicates the stationarity of the time series signals x(n) (n=0, . . . , L−1) corresponding to the bit stream BS satisfies the condition indicating that the time series signals x(n) (n=0, . . . , L−1) are highly stationary, the switch 127*c* sends the code $C_T$ of the current frame to the pitch period decoding unit 127*e* under the control of the determination unit 127*b* (FIG. 6). The pitch period decoding unit 127*e* decodes the code $C_T$ through decoding corresponding to encoding performed in the pitch period encoding unit 117*e* (FIG. 5), and outputs the pitch periods $T'=T_1'$, $T_2'$, $T_3'$, $T_4'$ of the current frame (step S124). The pitch period decoding unit 127*e* decodes the code obtained by encoding, at every second time interval, the pitch period expressed at the second resolution. In other words, the code corresponding to the pitch periods is decoded by a decoding mode that obtains each pitch period expressed at the second resolution for each second time interval. For example, the pitch period decoding unit 127*e* decodes the code $C_T$ of the current frame and outputs the pitch periods $T'=T_1'$, $T_2'$, $T_3'$, $T_4'$ of the current frame, in the same way as in the conventional case. A specific case of step S124 will be described below.

[When Specific Case 1 or 2 of Step S114 is Used in Encoder 11]

In this case, the pitch period decoding unit 127*e* extracts the pitch period $T_1'$ of the first subframe and the pitch period $T_3'$ of the third subframe from the code $C_T$ and outputs them. The pitch period decoding unit 127*e* also extracts from the code $C_T$ the difference between the integer part of the pitch period of the second subframe and the integer part of the pitch period of the first subframe, the difference between the integer part of the pitch period of the fourth subframe and the integer part of the pitch period of the third subframe, the fractional part of the pitch period of the second subframe, and the fractional part of the pitch period of the fourth subframe.

The pitch period decoding unit 127*e* further obtains the pitch period $T_2'$ of the second subframe by adding the integer part of the pitch period of the first subframe obtained from the pitch period $T_1'$ of the first subframe, the difference between the integer part of the pitch period of the second subframe and the integer part of the pitch period of the first subframe, and the fractional part of the pitch period of the second subframe and outputs the pitch period $T_2'$ of the second subframe.

The pitch period decoding unit 127*e* further obtains the pitch period $T_4'$ of the fourth subframe by adding the integer part of the pitch period of the third subframe obtained from the pitch period $T_3'$ of the third subframe, the difference between the integer part of the pitch period of the fourth subframe and the integer part of the pitch period of the third subframe, and the fractional part of the pitch period of the fourth subframe and outputs the pitch period $T_4'$ of the fourth subframe (end of description of the specific case of step S124).

The decoded pitch periods $T'=T_1', T_2', T_3', T_4'$ of the current frame are output by the switch 127*c* under the control of the determination unit 127*b*. The parameter decoding unit 127 outputs the linear prediction information LPC info, the code indexes $C_f=C_{f1}, C_{f2}, C_{f3}, C_{f4}$, the quantized pitch gains $g_p'=g_{p1}', g_{p2}', g_{p3}', g_{p4}'$, and the quantized fixed-codebook gains $g_c'=g_{c1}', g_{c2}', g_{c3}', g_{c4}'$. Then, the decoder 12 generates synthesis signals x'(n) (n=0, . . . , L−1) and outputs the signals, in the same way as in the conventional case.

First Modification of First Embodiment

In a modification of the first embodiment described above, depending on whether the time series signals x(n) (n=0, . . . , L−1) of the current frame are determined to be stationary or non-stationary in step S112, the search unit 913 (FIG. 4) of the encoder 11 may change the search range of the pitch periods T for a future frame coming after the current frame. For example, if the signals are determined to be non-stationary, the search range of the pitch periods may be made narrower than the search range used when the signals are determined to be stationary, since the adaptive signal components contribute just a little.

Before the search unit 913 searches for the pitch periods T of the current frame, whether the time series signals x(n) (n=0, . . . , L−1) of the current frame is stationary or non-stationary may be determined by using the estimated value E of the prediction gain generated by using the linear prediction information LPC info generated for the current frame, and the search range of the pitch periods T in the current frame may be changed accordingly. For example, the search range used when the signals are determined to be non-stationary may be made narrower than the search range used when the signals are determined to be stationary.

Alternatively, the search unit 913 may perform processing on the current frame all over again, after it is determined in step S112 whether the signals are stationary or non-stationary and the search range of the pitch periods T is specified in accordance with the result.

When the signals are determined to be non-stationary and when the pitch periods T are encoded at every time interval formed of a plurality of subframes (the encoding frequency is lowered), as in specific case 2 of step S113, the frequency of calculation of the pitch periods T by the search unit 913 may be lowered in a frame in which the determination of non-stationarity is made. For example, if a single pitch period is encoded for a plurality of subframes, just a single pitch period should be calculated for the plurality of subframes.

Second Modification of First Embodiment

In a modification of the first embodiment described above, depending on whether the time series signals x(n) (n=0, . . . , L−1) of the current frame are determined to be stationary or non-stationary in step S112, the search unit 913 (FIG. 4) of the encoder 11 may change the resolutions for the pitch periods T to be calculated in a future frame coming after the current frame. For example, if the signals are determined to be non-stationary, the pitch periods T expressed at the integer resolution may be calculated, and if the signals are determined to be stationary, the pitch periods T expressed at fractional resolution may be calculated.

Before the search unit 913 calculates the pitch periods T of the current frame, whether the time series signals x(n) (n=0, . . . , L−1) of the current frame are stationary or non-stationary may be determined by using the estimated value E of the prediction gain generated by using the linear prediction information LPC info generated for the current frame, and it may be selected, in accordance with the result, whether the pitch periods T of the current frame are calculated at the integer resolution or fractional resolution. For example, when the signals are determined to be non-stationary, the pitch periods T expressed at the integer resolution may be calculated, and when the signals are determined to be stationary, the pitch periods T expressed at fractional resolution may be calculated.

Alternatively, the search unit 913 may perform processing on the current frame all over again, after it is determined in step S112 whether the signals are stationary or non-stationary and the resolutions for the pitch periods T to be calculated by the search unit 913 are specified in accordance with the result.

Third Modification of First Embodiment

In a modification of the first embodiment, the number of bits assigned to the code index $C_f$ may be varied according to whether the time series signals x(n) (n=0, . . . , L−1) of the current frame are determined to be stationary or non-stationary in step S112. For example, when the signals are determined to be non-stationary, since the amount of the code $C_T$ corresponding to the pitch periods becomes smaller than that used when the signals are determined to be stationary, if improvement in quality at a similar bit rate is emphasized rather than a decrease in bit rate, the coding quality may be improved by assigning to the code index $C_f$ the number of bits equivalent to the reduced amount of code $C_T$ corresponding to the pitch periods T.

Fourth Modification of First Embodiment

Instead of determining whether the time series signals x(n) (n=0, . . . , L−1) are stationary or not and switching the resolutions used to express the pitch periods or the pitch period encoding mode accordingly, the time series signals x(n) (n=0, . . . , L−1) may be determined to be periodic or not, and the resolutions used to express the pitch periods or the pitch period encoding mode may be switched accordingly. For the processing in this case, "stationary" is replaced with "periodic," and "non-stationary" is replaced with "non-periodic" in the description given above. Whether the time series signals x(n) (n=0, . . . , L−1) are periodic or not can also be determined by determining whether the prediction gains or quantized pitch gains are larger than a specified value. The resolutions used to express the pitch periods and/or the pitch period encoding mode may be switched in accordance with whether the index that indicates the level of periodicity and/or stationarity of the time series signals satisfies the condition that indicates high periodicity and/or high stationarity.

Fifth Modification of First Embodiment

As an index used to determine whether the time series signals x(n) (n=0, . . . , L−1) are stationary (periodic) or not, the difference between a value corresponding to the pitch period of any time interval included in a predetermined time interval (a pitch period or the integer part of the pitch period, for example) and a value corresponding to the pitch period of a past time interval before the time interval included in the predetermined time interval may be used. When the difference is smaller than a specified value, the signals may be determined to be stationary (periodic); otherwise the signals may be determined to be non-stationary (non-periodic). Whether the index is smaller than the specified value may be determined by determining whether the condition "index"<"specified value" is satisfied or by determining whether the condition "index"≤("specified value"−"constant") is satisfied. In that case, the specified value may be specified as a processing threshold, and ("specified value"−"constant") may also be specified as a processing threshold.

Sixth Modification of First Embodiment

The bit stream BS may include side information for identifying items selected by the encoder 11 in accordance with the result of determination regarding stationarity or periodicity (such as the resolutions of the pitch periods and the encoding mode). In that case, the decoder 12 can determine the items (such as the resolutions of the pitch periods and the decoding mode) to be selected in accordance with the result of determination regarding stationarity or periodicity, on the basis of the side information included in the bit stream BS.

Second Embodiment

A second embodiment is a modification of the first embodiment or the first to sixth modifications thereof. The differences between the second embodiment and the first embodiment or the first to sixth modifications thereof are the details of the pitch period encoding mode and decoding mode, which are switched according to whether the time series signals are stationary (periodic) or not.

In time series signals such as speech signals, the pitch periods change just a little in a stationary (periodic) frame, and it is highly possible that the difference between the pitch periods of the subframes included in the frame is zero or a small value. Therefore, it is effective in a stationary frame to apply variable-length encoding to the difference between the pitch periods of the subframes. In contrast, in a frame that is not stationary (not periodic), since such differences have a large variation, variable-length encoding is not effective in many cases.

Consequently, in pitch period encoding processing according to the second embodiment, when an index that indicates the level of periodicity and/or stationarity of the time series signals satisfies a condition that indicates high periodicity and/or high stationarity, the pitch period in a first predetermined time interval included in a predetermined time interval is encoded, and the difference between a value corresponding to the pitch period in a second predetermined time interval included in the predetermined time interval other than the first predetermined time interval and a value corresponding to the pitch period in a time interval other than the second predetermined time interval is variable-length encoded. In an example case described below, "the predetermined time interval" means a frame, "the first predetermined time interval" means first and third subframes, "the second predetermined time interval" means second and fourth subframes, and "the value corresponding to the pitch period" means the integer part of the pitch period. However, this case does not limit the present invention.

<Configuration>

The configurations of an encoder 21 and a decoder 22 according to the second embodiment will be described below with reference to FIGS. 4 to 6.

As shown in FIG. 4 as an example, the encoder 21 of the second embodiment differs from the encoder 11 of the first embodiment in that the parameter encoding unit 117 is replaced with a parameter encoding unit 217. The decoder 22 of the second embodiment differs from the decoder 12 of the first embodiment in that the parameter decoding unit 127 is replaced with a parameter decoding unit 227.

As shown in FIG. 5 as an example, the parameter encoding unit 217 of the second embodiment differs from the parameter encoding unit 117 of the first embodiment in that the pitch period encoding unit 117*d* is replaced with a pitch period encoding unit 217*d*, and the pitch period encoding unit 117*e* is replaced with a pitch period encoding unit 217*e*. As shown in FIG. 6 as an example, the parameter decoding unit 227 of the second embodiment differs from the parameter decoding unit 127 of the first embodiment in that the pitch period decoding unit 127*d* is replaced with a pitch period decoding unit 227*d*, and the pitch period decoding unit 127*e* is replaced with a pitch period decoding unit 227*e*.

<Encoding Method>

The encoding method of the second embodiment will be described below with reference to FIG. 7A.

In the encoding method of the second embodiment, step S213, described below, is executed instead of step S113 of the first embodiment, and step S214, described below, is executed instead of step S114 of the first embodiment. The other steps may be the same as those in the first embodiment or its modifications. Only the processing of step S213 and step S214 of the present embodiment will be described below.

[Processing of Step S213]

When it is determined in step S112 that the signals are non-stationary (non-periodic), the switch 117*c* sends the pitch periods $T=T_1$, $T_2$, $T_3$, $T_4$ to the pitch period encoding unit 217*d* (FIG. 5) under the control of the determination unit 117*b*. The pitch period encoding unit 217*d* generates a code $C_T$ corresponding to the pitch periods T of the current frame by using, for example, the same method (specific case 1 of step S213) as in the conventional case (FIGS. 2A and 2B), or the same method (specific case 2 of step S213) as in step S113 (FIG. 8) of the first embodiment and outputs the code (step S213).

[Processing of Step S214]

When it is determined in step S112 that the signals are stationary (periodic), the switch 117*c* sends the pitch periods $T=T_1$, $T_2$, $T_3$, $T_4$ to the pitch period encoding unit 217*e* under the control of the determination unit 117*b*. The pitch period encoding unit 217*e* encodes the pitch periods $T_1$ and $T_3$ (the differences from the minimum pitch period) of the first and third subframes (first predetermined time intervals) in the same way as in the conventional case (FIG. 2A, FIG. 2B, and FIG. 3) in each subframe separately. The pitch period encoding unit 217*e* also applies variable-length encoding to the difference TD(1, 2) between the integer part of the pitch period $T_2$ (value corresponding to the pitch period) of the second subframe (second predetermined time interval) and the integer part of the pitch period $T_1$ of the first subframe (time interval other than the second predetermined time interval), and applies variable-length encoding to the difference TD(3, 4) between the integer part of the pitch period $T_4$ of the fourth subframe (second predetermined time interval) and the integer part of the pitch period $T_3$ of the third subframe (time interval other than the second predetermined time interval). The difference TD(α, β) may be either (the integer part of the pitch period $T_\alpha$)−(the integer part of the pitch period $T_\beta$), or (the integer part of the pitch period $T_\beta$)−(the integer part of the pitch period $T_\alpha$), but it is necessary to use one of them both in the encoder and the decoder. The fractional parts of the pitch periods $T_2$ and $T_4$ of the second and fourth subframes are each encoded with a fixed number of bits (for example, two bits).

As described above, the pitch period encoding unit 217*e* encodes the pitch periods $T_1$ and $T_3$ of the first and third subframes in each subframe separately, applies variable-length encoding to the differences TD(1, 2) and TD(3, 4), and encodes the fractional parts of the pitch periods $T_2$ and $T_4$ with the fixed number of bits to generate a code $C_T$ corresponding to the pitch periods $T=T_1, T_2, T_3, T_4$ of the current frame and outputs it (step S214). The variable-length encoding method applied to the difference TD(1, 2) and the difference TD(3, 4) in the present embodiment will be described below as an example.

[Specific Case 1 of Variable-Length Encoding Method]

In this case, when the magnitude of the difference TD(1, 2) and the magnitude of the difference TD(3, 4) are both zero, a special bit (such as "0") is assigned as the codes corresponding to the difference TD(1, 2) and the difference TD(3, 4); and, in the other situations, a total of four bits that includes one bit (such as "1") indicating "other situations" and three bits indicating the difference TD(1, 2) and a total of four bits that includes one bit (such as "1") indicating "other situations" and three bits indicating the difference TD(3, 4) are assigned as the codes corresponding to the difference TD(1, 2) and the difference TD(3, 4).

[Specific Case 2 of Variable-Length Encoding Method]

In this case, when the difference TD(1, 2) and the difference TD(3, 4) are −1, zero, or +1, codes obtained by applying variable-length encoding to the difference TD(1, 2) and the difference TD(3, 4) are used; and, in the other situations, one bit (such as "1") indicating "other situations" and four bits indicating the difference are used as the code. For example, variable-length encoding is applied to the difference TD(1, 2) and the difference TD(3, 4) as shown below.

TABLE 1

| Code | Difference | Number of bits | Expected frequency | Code length expectation |
|---|---|---|---|---|
| "01" | 0 | 2 | 0.25 | 0.5 |
| "000" | −1 | 3 | 0.125 | 0.375 |
| "001" | +1 | 3 | 0.125 | 0.375 |
| "1" + "XXXX" | Others | 1 + 4 | 0.5 | 2.5 |
| | | | | 3.75 |

In the case of Table 1, since the amount of information increases by 25% when the difference is other than −1, 0, or +1, the number of bits is not reduced when the frequency is high, where the difference is other than −1, 0, or +1. When the code is "1"+"XXXX", since three values of −1, 0, and +1 are not designated among the 16 differences corresponding to XXXX, it is possible with XXXX to designate the 13 differences and to use the remaining three codes for another purpose such as flags for special processing. Alternatively, it is possible to further reduce the average code amount by using a correspondence table made in advance for the 13 (=16−3) differences designated by "1"+"XXXX" to express only two differences that occur highly frequently with three bits and the remaining 11 differences with four bits.

[Specific Case 3 of Variable-Length Encoding Method]

In this case, information obtained by integrating differences is variable-length encoded, where each of the differences is a difference between a value corresponding to each of the pitch periods of a plurality of second predetermined time intervals included in the predetermined time interval other than the first predetermined time intervals and a value corresponding to each of the pitch periods in time intervals other than the second predetermined time intervals included in the predetermined time interval. As described earlier, in an example case described below, "the predetermined time interval" means a frame, "the first predetermined time intervals" mean first and third subframes, "the second predetermined time intervals" mean second and fourth subframes, and "the value corresponding to the pitch period" means the integer part of the pitch period.

In this case, when the difference TD(1, 2) and the difference TD(3, 4) are both zero, a special one-bit designation code (such as "1") is assigned as the code corresponding to the difference TD(1, 2) and the difference TD(3, 4). There are four states in which either the difference TD(1, 2) or the difference TD(3, 4) is zero, and the other is either +1 or −1. In the current case, a total of four bits that include a two-bit designation code (such as "00") indicating that one of the four states has occurred and two bits ("00", "01", "10", or "11") identifying any of the four states are assigned as the code corresponding to the difference TD(1, 2) and the difference TD(3, 4). In the other situations, a total of ten bits that include a two-bit designation code (such as "01") indicating the other situations, four bits expressing the difference TD(1, 2), and four bits expressing the difference TD(3, 4) are assigned as the code corresponding to the difference TD(1, 2) and the difference TD(3, 4). For example, the difference TD(1, 2) and the difference TD(3, 4) are collectively variable-length encoded as described below.

TABLE 2

| Difference TD (1, 2) | Difference TD (3, 4) | Code |
|---|---|---|
| 0 | 0 | "1" |
| 0 | +1 | "0000" |
| 0 | −1 | "0001" |
| +1 | 0 | "0010" |
| −1 | 0 | "0011" |
| Others | | "01" + "XXXXXXXX" |

[Specific Case 4 of Variable-Length Encoding Method]

In this case, when the difference TD(1, 2) and the difference TD(3, 4), described earlier, are both zero, a special two-bit designation code (such as "01") is assigned as the code corresponding to the difference TD(1, 2) and the difference TD(3, 4). There are four states in which either the difference TD(1, 2) or the difference TD(3, 4) is zero, and the other is either +1 or −1; and there are two states in which either the difference TD(1, 2) or the difference TD(3, 4) is −1, and the other is +1. In the current case, a total of four or five bits that include a two-bit designation code (such as "00") indicating that one of a total of six states has occurred and two or three bits (such as "00", "01", "100", "101", "110" or "111") identifying each state are assigned as the code corresponding to the difference TD(1, 2) and the difference TD(3, 4). In the other situations, a total of nine bits that include a one-bit designation code (such as "1") indicating the other situations, four bits expressing the difference TD(1, 2), and four bits expressing the difference TD(3, 4) are assigned as the code corresponding to the difference TD(1, 2) and the difference TD(3, 4). For example, the difference TD(1, 2) and the difference TD(3, 4) are collectively variable-length encoded as described in FIGS. 9A and 9B and below as an example.

TABLE 3

| Difference TD (1, 2) | Difference TD (3, 4) | Code |
|---|---|---|
| 0 | 0 | "01" |
| 0 | +1 | "0000" |
| 0 | −1 | "0001" |
| +1 | 0 | "00100" |
| 1 | 0 | "00101" |
| +1 | −1 | "00110" |
| −1 | +1 | "00111" |
| Others | | "1" + "XXXXXXXX" |

In Table 3, the code lengths of the code ("00110") assigned when the difference TD(1, 2) is +1 and the difference TD(3, 4) is −1 and the code ("00111") assigned when the difference TD(1, 2) is −1 and the difference TD(3, 4) is +1 is longer than the code length of the code ("0000" or "0001) assigned when the difference TD(1, 2) is zero and the difference TD(3, 4) is either +1 or −1. This is because the frequency is small for an instance where the difference TD(1, 2) is +1 and the difference TD(3, 4) is −1 and for an instance where the difference TD(1, 2) is −1 and the difference TD(3, 4) is +1.

The expected frequency of each state will be shown below as an example.

TABLE 4

| Code | Number of bits | Expected frequency | Code length expectation for TD (1, 2) and TD (3, 4) |
|---|---|---|---|
| "01" | 2 | 0.25 | 0.25 |
| "000" + Z | 3 + 1 | 0.25 | 1.0 |
| "001" + YY | 3 + 2 | 0.1 | 0.5 |
| "1" + "XXXXXXXX" | 1 + 8 | 0.4 | 3.6 |
| | | | 5.35 |

When encoding is performed in the assignment shown in Table 3 with the expected frequency indicated in Table 4, the code length expectation for the code corresponding to the differences TD(1, 2) and TD(3, 4) is 5.35 bits on average, which is a reduction of 2.65 bits from a total code length of 8 bits obtained when the differences TD(1, 2) and TD(3, 4) are each encoded with four bits. This expected frequency is for frames having high stationarity (for example, for 40% of all frames). In frames having low stationarity, the differences TD(1, 2) and TD(3, 4) have a small imbalance, and their distributions are wide. Therefore, if encoding is performed only when the signals are stationary in the decision in step S112, described earlier, a high compression effect can be obtained in variable-length encoding. If the condition in step S112 (the condition for determining that the signals are stationary) is made too strict, since the frequency at which variable-length encoding is applied is lowered, the information reduction effect is limited. In contrast, if the condition in step S112 (the condition for determining that the signals are stationary) is made too loose, a high compression effect caused by variable-length encoding is not obtained, resulting in the possibility of increasing the average number of bits from that in the conventional case in some instances. Therefore, it is necessary to adjust the condition in step S112 appropriately.

<Decoding Method>

The decoding method of the second embodiment will be described below with reference to FIG. 7B.

In the decoding method of the second embodiment, step S223, described below, is executed instead of step S123 of the first embodiment, and step S224, described below, is executed instead of step S124 of the first embodiment. The other steps may be the same as those in the first embodiment or its modifications. Only the processing of step S223 and step S224 of the present embodiment will be described below.

[Processing of Step S223]

When it is determined in step S122 that the index that indicates the stationarity of the time series signals x(n) (n=0, . . . , L−1) corresponding to the bit stream BS does not satisfy the condition indicating that the time series signals x(n) (n=0, . . . , L−1) are highly stationary (when it is determined that the signals were non-stationary), the switch 127*f* sends the code $C_T$ of the current frame to the pitch period decoding unit 227*d* under the control of the determination unit 127*b*. The pitch period decoding unit 227*d* decodes the code $C_T$ in decoding processing corresponding to the encoding processing executed by the pitch period encoding unit 217*d* (FIG. 5) and outputs the pitch periods $T'=T_1'$, $T_2'$, $T_3'$, $T_4'$ (step S223). For example, when the encoder 21 executes the processing of the specific case 1 of step S213 to generate the code $C_T$ of the current frame (see FIGS. 2A and 2B), the pitch periods $T'=T_1'$, $T_2'$, $T_3'$, $T_4'$ of the current frame are generated from the code $C_T$ in the same technique as in the conventional case. Alternatively, for example, when the encoder 21 executes the processing of specific case 2 of step S213 to generate the code $C_T$ of the current frame, the pitch periods $T'=T_1'$, $T_2'$, $T_3'$, $T_4'$ of the current frame is generated from the code $C_T$ in the processing of step S123 of the first embodiment, which corresponds to the processing of specific case 2.

[Processing of Step S224]

When it is determined in step S122 that the index that indicates the stationarity of the time series signals x(n) (n=0, . . . , L−1) corresponding to the bit stream BS satisfies the condition indicating that the time series signals x(n) (n=0, . . . , L−1) are highly stationary (when it is determined that the signals were stationary), the switch 127*f* sends the code $C_T$ of the current frame to the pitch period decoding unit 227*e* under the control of the determination unit 127*b*. The pitch period decoding unit 227*e* decodes the code $C_T$ in decoding processing corresponding to the encoding processing executed by the pitch period encoding unit 217*e* (FIG. 5) and outputs the pitch periods $T'=T_1'$, $T_2'$, $T_3'$, $T_4'$ of the current frame (step S224).

Third Embodiment

A third embodiment is a modification of the first embodiment, the first to sixth modifications thereof, or the second embodiment. The differences between the third embodiment and the first embodiment, the first to sixth modifications thereof, and the second embodiment are the details of the pitch period encoding mode and decoding mode, which are switched according to whether the time series signals are stationary (periodic) or not.

When the signals are highly stationary (periodic), in other words, when the quantized pitch gains and prediction gains are larger than specified values, or when the differences TD(1, 2) and TD(3, 4) are smaller than specified values, the difference between the pitch period $T_1$ of the first subframe and the pitch period $T_3$ of the third subframe is also small in many cases. Therefore, in the encoding processing of the present embodiment, when the time series signals x(n) (n=0, . . . , L−1) are highly stationary (periodic), the difference TD(1, 3) between a value corresponding to the pitch period $T_3$ (for example, the integer part of the pitch period $T_3$) and a value corresponding to the pitch period $T_1$ (for example, the integer part of the pitch period $T_1$) is variable-length encoded.

In other words, also in pitch period encoding processing according to the third embodiment, when the index that indicates the level of periodicity and/or stationarity of the time series signals satisfies a condition that indicates high periodicity and/or high stationarity, the pitch period in a first predetermined time interval included in a predetermined time interval is encoded, and the difference between a value corresponding to the pitch period in a second predetermined time interval included in the predetermined time interval other than the first predetermined time interval and a value corresponding to the pitch period in a time interval included in the predetermined time interval other than the second predetermined time interval is variable-length encoded. In the present embodiment, "the predetermined time interval" means a frame, "the first predetermined time interval" means the first subframe, "the second predetermined time interval" means the third subframe, "the time interval other than the second predetermined time interval" means the first subframe, and "the value corresponding to the pitch period" means the integer part of the pitch period. However, these assignments do not limit the present invention. In the following description, the differences from the first embodiment, the first to sixth modifications thereof, and the second embodiment will be mainly described.

<Configuration>

The configurations of an encoder 31 and a decoder 32 according to the third embodiment will be described below with reference to FIGS. 4 to 6.

As shown in FIG. 4 as an example, the encoder 31 of the third embodiment differs from the encoder 11 of the first embodiment in that the parameter encoding unit 117 is replaced with a parameter encoding unit 317. The decoder 32 of the third embodiment differs from the decoder 12 of the first embodiment in that the parameter decoding unit 127 is replaced with a parameter decoding unit 327.

As shown in FIG. 5 as an example, the parameter encoding unit 317 of the third embodiment differs from the parameter encoding unit 117 of the first embodiment in that the determination unit 117*b* is replaced with a determination unit 317*b*, the pitch period encoding unit 117*d* is replaced with a pitch period encoding unit 317*d*, and the pitch period encoding unit 117*e* is replaced with a pitch period encoding unit 317*e*. As shown in FIG. 6 as an example, the parameter decoding unit 327 of the third embodiment differs from the parameter decoding unit 127 of the first embodiment in that the determination unit 127*b* is replaced with a determination unit 327*b*, the pitch period decoding unit 127*d* is replaced with a pitch period decoding unit 327*d*, and the pitch period decoding unit 127*e* is replaced with a pitch period decoding unit 327*e*.

<Encoding Method>

The encoding method of the third embodiment will be described below with reference to FIG. 7A.

In the encoding method of the third embodiment, step S312, described below, is executed instead of step S112 of the first embodiment; step S313, described below, is executed instead of step S113 of the first embodiment; and step S314, described below, is executed instead of step S114 of the first embodiment. The other steps may be the same as those in the first embodiment or its modifications. Only the processing of step S312, step S313, and step S314 of the present embodiment will be described below.

[Processing of step S312]

In step S312, the determination unit 317*b* determines whether the time series signals x(n) (n=0, . . . , L−1) of the current frame are stationary (periodic) or not (step S312). The determination in step S312 may be performed in the same way as that in step S112 of the first embodiment. In the third embodiment, a case will be described in which the magnitude of the difference between a value corresponding to the pitch period of a time interval included in the predetermined time interval and a value corresponding to the pitch period of a past time interval before the time interval, included in the predetermined time interval, is used as an index; when the index is smaller than a specified value, it is determined that the time series signals x(n) (n=0, . . . , L−1) are stationary (periodic); and if not, it is determined that the time series signals x(n) (n=0, . . . , L−1) are non-stationary (non-periodic). In the following case, the magnitude of the difference TD(1, 2) and/or the magnitude of the difference TD(3, 4) is used as the index, and it is determined whether the time series signals are stationary (periodic) or not.

[Specific Case 1 of Step S312]

In specific case 1 of step S312, the pitch periods $T_1$ and $T_2$ are input to the determination unit 317*b*. The determination unit 317*b* uses as an index the magnitude of the difference TD(1, 2), which is the difference between the integer parts of the pitch periods $T_1$ and $T_2$, and determines whether the index is smaller than a specified value. When the magnitude of the difference TD(1, 2) is smaller than the specified value, it is determined that the time series signals x(n) (n=0, . . . , L−1) of the current frame are stationary (periodic); and if not, it is determined that the time series signals x(n) (n=0, . . . , L−1) of the current frame are not stationary (not periodic).

Determining whether "index<specified value" may be used to determine whether the index is smaller than the specified value; or determining whether "index≤(specified value−constant)" may be used to determine whether the index is smaller than the specified value. In these cases, the specified value may be used as a processing threshold, or (specified value−constant) may be used as a processing threshold. The same applies to determining whether the index is smaller than the specified value, for other cases to be described below. Instead of the difference TD(1, 2), which is the difference between the integer parts of the pitch periods $T_1$ and $T_2$, the difference TD(3, 4), which is the difference between the integer parts of the pitch periods $T_3$ and $T_4$, may be used as the index.

[Specific Case 2 of Step S312]

In specific case 2 of step S312, the pitch periods $T_1$, $T_2$, $T_3$, and $T_4$ are input to the determination unit 317*b*. The determination unit 317*b* uses as indexes the magnitude of the difference TD(1, 2) and the magnitude of the difference TD(3, 4), and determines whether they are both smaller than a specified value. When the magnitude of the difference TD(1, 2) and the magnitude of the difference TD(3, 4) are both smaller than the specified value, it is determined that the time series signals x(n) (n=0, . . . , L−1) of the current frame are stationary (periodic); and if not, it is determined that the time series signals x(n) (n=0, . . . , L−1) of the current frame are not stationary (not periodic).

[Specific Case 3 of Step S312]

Also in specific case 3 of step S312, the pitch periods $T_1$, $T_2$, $T_3$, and $T_4$ are input to the determination unit 317*b*. The determination unit 317*b* determines whether the difference TD(1, 2) is smaller than a specified value A and the difference TD(3, 4) is smaller than a specified value B. When these conditions are satisfied, it is determined that the time series signals x(n) (n=0, . . . , L−1) of the current frame are stationary (periodic); and if not, it is determined that the time series signals x(n) (n=0, . . . , L−1) of the current frame are not stationary (not periodic).

[Specific Case 4 of Step S312]

Also in specific case 4 of step S312, the pitch periods $T_1$, $T_2$, $T_3$, and $T_4$ are input to the determination unit 317*b*. The determination unit 317*b* determines whether the difference TD(1, 2) is larger than a specified value A1 and smaller than a specified value A2, and the difference TD(3, 4) is larger than a specified value B1 and smaller than a specified value B2. When these conditions are satisfied, it is determined that the time series signals x(n) (n=0, . . . , L−1) of the current frame are stationary (periodic); and if not, it is determined that the time series signals x(n) (n=0, . . . , L−1) of the current frame are not stationary (not periodic).

[Specific Case 5 of Step S312]

A combination of one of the determinations used in specific cases 1 to 4 of step S312 and one of the determinations in step S112 of the first embodiment may be used to determine whether the time series signals x(n) (n=0, . . . , L−1) of the current frame are stationary (periodic) or not.

[Processing of Step S313]

When it is determined in step S312 that the signals are nonstationary (non-periodic), the switch 117*c* sends the pitch periods $T=T_1$, $T_2$, $T_3$, $T_4$ to the pitch period encoding unit 317*d* (FIG. 5) under the control of the determination unit 317*b*. The pitch period encoding unit 317*d* generates a code $C_T$ corresponding to the pitch periods T of the current frame by using, for example, the same method (specific case 1 of step S313) as in the conventional case (FIGS. 2A and 2B) or the same method (specific case 2 of step S313) as in step S113 (FIG. 8B) of the first embodiment and outputs the code (step S313).

[Processing of Step S314]

Figures 10A, 10B, 10C:
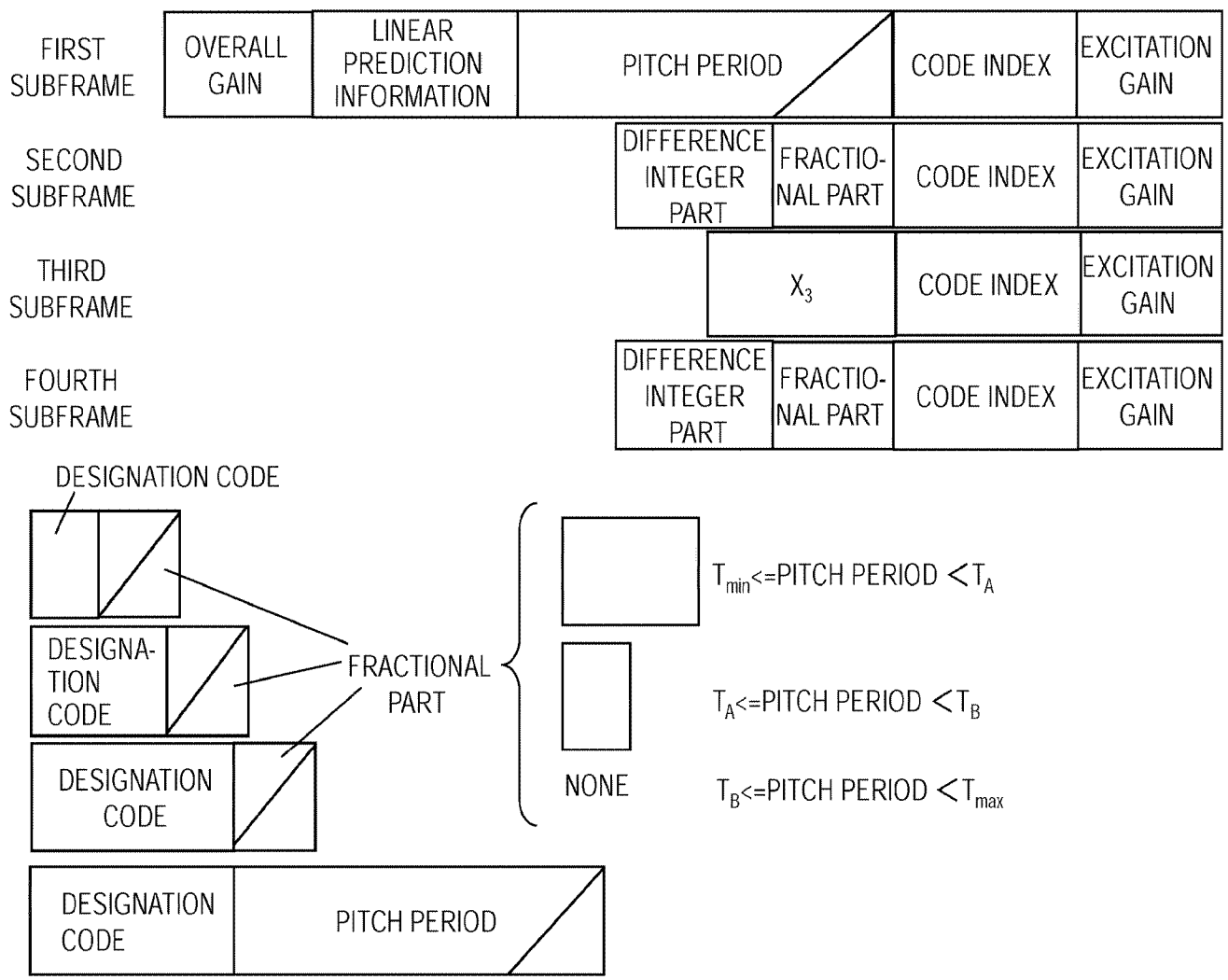
FIG. 10A is a view showing an example pitch period encoding method according to a third embodiment when time series signals are stationary (periodic)
FIGS. 10B and 10C are views showing examples of a code $X_3$ for a pitch period in a third subframe.

When it is determined in step S312 that the signals are stationary (periodic), the switch 117*c* sends the pitch periods $T=T_1$, $T_2$, $T_3$, $T_4$ to the pitch period encoding unit 317*e* under the control of the determination unit 317*b*. FIGS. 10A to 10C show example pitch period encoding methods in the third embodiment when the time series signals are stationary (periodic).

As shown as an example in FIG. 10A, the pitch period encoding unit 317*e* encodes the difference TD(1, 2) between the integer part of the pitch period $T_2$ in the second subframe and the integer part of the pitch period $T_1$ in the first subframe, and the difference TD(3, 4) between the integer part of the pitch period $T_4$ in the fourth subframe and the integer part of the pitch period $T_3$ in the third subframe (difference integer parts) separately, and encodes the values after the decimal point of the pitch periods $T_2$ and $T_4$ (fractional parts) separately. In addition, the pitch period encoding unit 317*e* encodes the pitch period $T_1$ of the first subframe in each subframe separately. The encoding method for the first, second, and fourth subframes may to be, for example, the same as in the conventional case. Furthermore, depending on the difference TD(1, 3), the pitch period encoding unit 317*e* either applies variable-length encoding to the difference TD(1, 3) between the integer part of the pitch period $T_3$ of the third subframe and the integer part of the pitch period $T_1$ of the first subframe (FIG. 10B), or encodes the pitch period $T_3$ of the third subframe in each subframe separately (FIG. 10C), to generate a code $X_3$ for the pitch period $T_3$ of the third subframe (FIG. 10A). When the difference TD(1, 3) is variable-length encoded, the fractional part of the pitch period $T_3$ is encoded with the number of bits corresponding to the magnitude of the integer part of the pitch period $T_3$. For example, when the integer part of the pitch period $T_3$ is equal to or larger than the minimum value $T_{min}$ and smaller than $T_A$, the pitch period encoding unit 317*e* encodes the fractional part with two bits; when the integer part of the pitch period $T_3$ is from $T_A$ to $T_B$, the pitch period encoding unit 317*e* encodes the fractional part with one bit; and when the integer part of the pitch period $T_3$ is equal to or larger than $T_B$ and up to the maximum value $T_{max}$, the pitch period encoding unit 317*e* does not encode the fractional part (FIG. 10B). With the above processing, the pitch period encoding unit 317*e* generates a code $C_T$ corresponding to the pitch periods $T=T_1$, $T_2$, $T_3$, $T_4$ and outputs the code. An example encoding method for the pitch period $T_3$ will be described below.

[Specific Case 1 of Encoding Method for Pitch Period $T_3$]

In this case, when the difference TD(1, 3), described above, is zero, a one-bit designation code (such as "1") is assigned as the code corresponding to the difference TD(1, 3). When the difference TD(1, 3) is either −1 or +1, a three-bit designation code (such as "000" or "001") is assigned as the code corresponding to the difference TD(1, 3). When the difference TD(1, 3) is another value, a code having a total of nine bits formed of a two-bit designation code (such as "01") indicating that the difference TD(1, 3) is another value and seven bits corresponding to the pitch period $T_3$ is generated. For example, the pitch period $T_3$ is encoded as shown below as an example.

TABLE 5

| Code | Difference TD(1, 3) | Number of bits | Expected frequency | Code length expectation |
|---|---|---|---|---|
| "1" | 0 | 1 | 0.5 | 0.5 |
| "000" | −1 | 3 | 0.1 | 0.3 |
| "001" | +1 | 3 | 0.1 | 0.3 |
| "01" + "VVVVVVV" | Others | 9 | 0.3 | 2.7 |
| | | | | 3.8 |

With the expected frequency indicated in Table 5, the code length expectation for the code used to express the pitch period $T_3$ can be reduced by 3.2 bits from 7 bits in the conventional case. The expected frequency in Table 5 is obtained if it is determined in step S312, described above, that the signals are stationary (periodic) only when the magnitude of the difference TD(1, 2) is smaller than 1 (when the difference TD(1, 2) is equal to zero). In the current case, it is expected that the frequency of frames where it is determined in step S312, described above, that the signals are stationary (periodic) is 25% of the whole, and the amount of code used to express the pitch period $T_3$ is reduced by 0.8 bits on average.

[Specific Case 2 of Encoding Method for Pitch Period $T_3$]

In this case, when the difference TD(1, 3), described above, is zero, a one-bit designation code (such as "1") that indicates that the difference TD(1, 3) is zero is assigned as the code corresponding to the difference TD(1, 3). When the difference TD(1, 3) is either −1 or +1, a three-bit designation code (such as "000" or "001") is assigned as the code corresponding to the difference TD(1, 3). When the difference TD(1, 3) is other than zero, −1, and +1 and can be expressed with four bits or less, a code having a total of seven bits formed of a three-bit designation code (such as "010") indicating that the difference TD(1, 3) is other than zero, −1, and +1 and can be expressed with four bits or less, and four bits expressing the difference TD(1, 3) is assigned to the difference TD(1, 3). When the difference TD(1, 3) is another value, a code having a total of 10 bits formed of a three-bit designation code (such as "001") indicating that the difference TD(1, 3) is another value, and seven bits corresponding to the pitch period $T_3$ is generated. For example, the pitch period $T_3$ is encoded as shown below as an example.

TABLE 6

| Code | Difference TD (1, 3) | Number of bits | Expected frequency | Code length expectation |
|---|---|---|---|---|
| "1" | 0 | 1 | 0.30 | 0.3 |
| "000" | −1 | 3 | 0.15 | 0.45 |
| "001" | +1 | 3 | 0.15 | 0.45 |
| "010" + "XXXX" | within 4 bits | 7 | 0.20 | 1.4 |
| "011" + "VVVVVVVV" | Others | 10 | 0.20 | 2.00 |
| | | | | 4.6 |

With the expected frequency indicated in Table 6, the code length expectation for the code used to express the pitch period $T_3$ can be reduced by 2.4 bits from 7 bits in the conventional case. The expected frequency in Table 6 is obtained if it is determined in step S312, described above, that the signals are stationary (periodic) only when the magnitude of the difference TD(1, 2) is smaller than 2 (when the difference TD(1, 2) is 0, −1, or 1). In the current case, it is expected that the frequency of frames where it is determined in step S312, described above, that the signals are stationary (periodic) is 50%, and the amount of code used to express the pitch period $T_3$ is reduced by 1.2 bits on average.

[Specific Case 3 of Encoding Method for Pitch Period $T_3$]

In this case, the same code assignment method as in the specific case 2 of the encoding method for the pitch period $T_3$ is used. However, it is determined in step S312, described above, that the signals are stationary (periodic) only when the magnitude of the difference TD(1, 2) and the magnitude of the difference TD(3, 4) are both smaller than 2 (when the differences TD(1, 2) and TD(3, 4) is 0, −1, or 1). In this case, the expected frequency is as shown below.

TABLE 7

| Code | Difference TD (1, 3) | Number of bits | Expected frequency | Code length expectation |
|---|---|---|---|---|
| "1" | 0 | 1 | 0.50 | 0.5 |
| "000" | −1 | 3 | 0.15 | 0.45 |
| "001" | +1 | 3 | 0.15 | 0.45 |
| "010" + "XXXX" | Within 4 bits | 7 | 0.1 | 0.7 |
| "011" + "VVVVVVVV" | Others | 10 | 0.1 | 1.00 |
| | | | | 3.1 |

With the expected frequency indicated in Table 7, the code length expectation for the code used to express the pitch period $T_3$ can be reduced by 3.9 bits from 7 bits in the conventional case. In the current case, it is expected that the frequency of frames where it is determined in step S312, described above, that the signals are stationary (periodic) is 24%, and the amount of code used to express the pitch period $T_3$ is reduced by 0.95 bits on average.

[Specific Case 4 of Encoding Method for Pitch Period $T_3$]

In this case, when the difference TD(1, 3), described above, is zero, a one-bit designation code (such as "1") that indicates that the difference TD(1, 3) is zero is assigned as the code corresponding to the difference TD(1, 3). When the difference TD(1, 3) is −1, a two-bit designation code (such as "01") is assigned as the code corresponding to the difference TD(1, 3). When the difference TD(1, 3) is +1, a three-bit designation code (such as "000") is assigned as the code corresponding to the difference TD(1, 3). When the difference TD(1, 3) is another value, a code having a total of 10 bits formed of a three-bit designation code (such as "001") indicating that the difference TD(1, 3) is another value, and seven bits corresponding to the pitch period $T_3$ is generated. For example, the pitch period $T_3$ is encoded as shown as an example below.

TABLE 8

| Code | Difference TD (1, 3) | Number of bits | Expected frequency | Code length expectation |
|---|---|---|---|---|
| "1" | 0 | 1 | 0.50 | 0.5 |
| "01" | −1 | 2 | 0.15 | 0.3 |
| "000" | +1 | 3 | 0.15 | 0.45 |
| "001" + "VVVVVVV" | Others | 10 | 0.2 | 2 |
| | | | | 3.25 |

With the expected frequency indicated in Table 8, the code length expectation for the code used to express the pitch period $T_3$ can be reduced by 3.75 bits from 7 bits in the conventional case. The expected frequency in Table 8 is obtained if it is determined in step S312, described above, that the signals are stationary (periodic) only when the magnitude of the difference TD(1, 2) and the magnitude of the difference TD(3, 4) are both smaller than 2 (when the difference TD(1, 2) and the difference TD(3, 4) is 0, −1, or 1) and that the signals are stationary (periodic) only when the pitch gain $T_2$ and the pitch gain $T_4$ are both equal to or larger than 0.7. In the current case, it is expected that the frequency of frames where it is determined in step S312, described above, that the signals are stationary (periodic) is 24%, and the amount of code used to express the pitch period $T_3$ is reduced by 0.95 bits on average.

[Specific Case 5 of Encoding Method for Pitch Period $T_3$]

In this case, the same code assignment method as in specific case 4 of the encoding method for the pitch period $T_3$ is used. However, it is determined in step S312, described above, that the signals are stationary (periodic) only when the pitch gain $T_2$ and the pitch gain $T_4$ are both equal to or larger than 0.7 irrespective of the differences TD(1, 2) and TD(3, 4). In this case, the expected frequency is as shown below.

TABLE 9

| Code | Difference TD (1, 3) | Number of bits | Expected frequency | Code length expectation |
|---|---|---|---|---|
| "01" | 0 | 2 | 0.3 | 0.6 |
| "001" | −1 | 3 | 0.1 | 0.3 |
| "000" | +1 | 3 | 0.1 | 0.3 |

TABLE 9-continued

| Code | Difference TD (1, 3) | Number of bits | Expected frequency | Code length expectation |
|---|---|---|---|---|
| "1 + "VVVVVVV" | Others | 8 | 0.5 | 4<br>5.2 |

With the expected frequency indicated in Table 9, the code length expectation for the code used to express the pitch period $T_3$ can be reduced by 1.8 bits from 7 bits in the conventional case. In the current case, it is expected that the frequency of frames where it is determined in step S312, described above, that the signals are stationary (periodic) is 40%, and the amount of code used to express the pitch period $T_3$ is reduced by 0.72 bits on average.

<Decoding Method>

The decoding method of the third embodiment will be described below with reference to FIG. 7B.

In the decoding method of the third embodiment, step S322, described below, is executed instead of step S122 of the first embodiment; step S323, described below, is executed instead of step S123 of the first embodiment; and step S324, described below, is executed instead of step S124 of the first embodiment. The other steps may be the same as those in the first embodiment or its modifications. Only the processing of steps S322, S323 and S324 of the present embodiment will be described below.

[Processing of Step S322]

In step S322, the determination unit 327*b* (FIG. 6) of the decoder 32 (FIG. 4) determines whether the time series signals x(n) (n=0, . . . , L−1) corresponding to the bit stream BS in the present frame were stationary (step S322). The determination in step S322 is performed by determining whether the index that indicates the level of stationarity of the time series signals x(n) (n=0, . . . , L−1) satisfies the condition indicating that the time series signals x(n) (n=0, . . . , L−1) are highly stationary. For this determination, information (LPC info, $C_T$, $g_p'$, and others) necessary for the determination and output from the separation unit 127*g* is input to the determination unit 327*b* and the same method as in step S312 performed by the encoder 31 is used. If the differences TD(1, 2) and TD(3, 4) are used as indexes for the determination, when they have been variable-length encoded, they need to be decoded and used for the determination in step S322.

[Processing of Step S323]

When it is determined in step S322 that the index that indicates the stationarity of the time series signals x(n) (n=0, . . . , L−1) corresponding to the bit stream BS does not satisfy the condition indicating that the time series signals x(n) (n=0, . . . , L−1) are highly stationary (when the signals were non-stationary), the switch 127*f* sends the code $C_T$ of the current frame to the pitch period decoding unit 327*d* under the control of the determination unit 327*b*. The pitch period decoding unit 327*d* decodes the code $C_T$ in decoding processing corresponding to the encoding processing executed by the pitch period encoding unit 317*d* (FIG. 5) and outputs the pitch periods $T'=T_1'$, $T_2'$, $T_3'$, $T_4'$ of the current frame (step S323).

[Processing of Step S324]

When it is determined in step S322 that the index that indicates the stationarity of the time series signals x(n) (n=0, . . . , L−1) corresponding to the bit stream BS satisfies the condition indicating that the time series signals x(n) (n=0, . . . , L−1) are highly stationary (when the signals were stationary), the switch 127*f* sends the code $C_T$ of the current frame to the pitch period decoding unit 327*e* under the control of the determination unit 327*b*. The pitch period decoding unit 327*e* decodes the code $C_T$ in decoding processing corresponding to the encoding processing executed by the pitch period encoding unit 317*e* (FIG. 5) and outputs the pitch periods $T'=T_1'$, $T_2'$, $T_3'$, $T_4'$ of the current frame (step S324).

First Modification of Third Embodiment

Figure 2B:
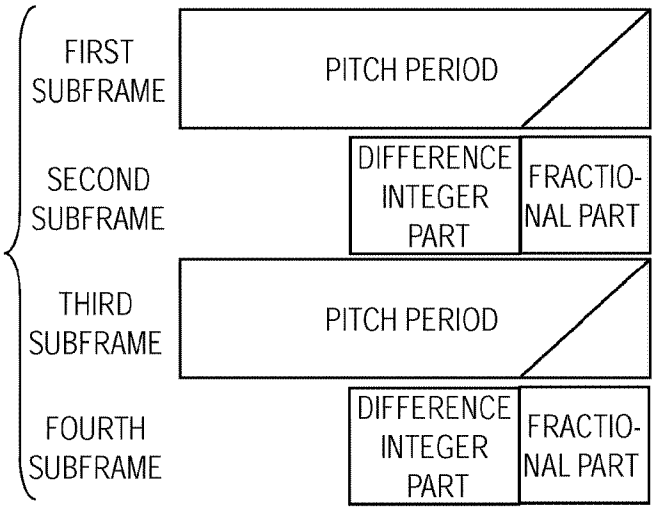
FIG.2B Related Art
FIG. 2B is a view illustrating codes corresponding to the pitch periods T having fractional resolution.
Figure 3:
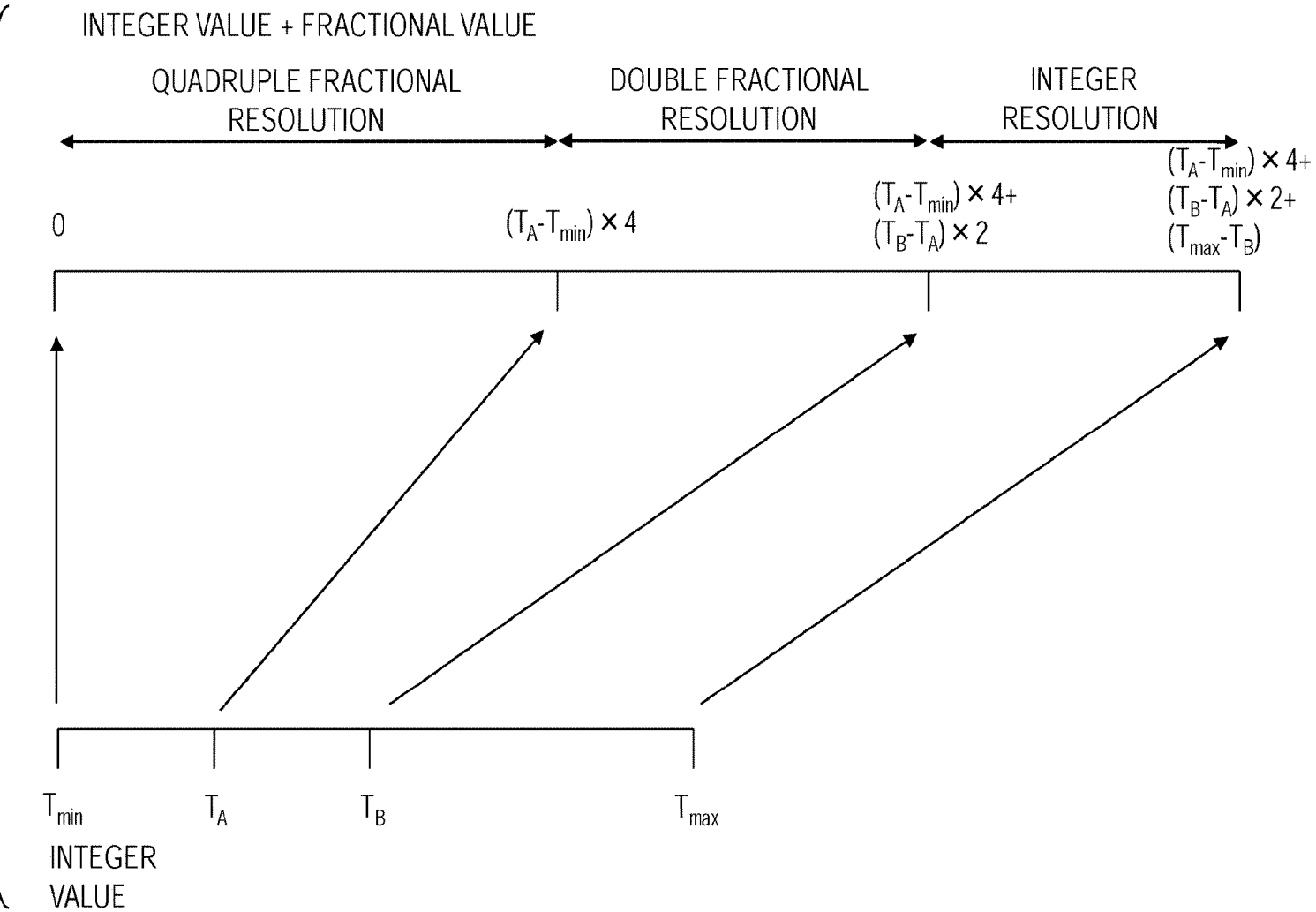
FIG.3 Related Art
FIG. 3 is a view illustrating an encoding method for the fractional part of a pitch period.

In the encoding processing of the third embodiment, when it is determined that the time series signals x(n) (n=0, . . . , L−1) of the current frame are highly stationary, the difference TD(1, 3) between the integer part of the pitch period $T_3$ of the third subframe included in the current frame and the integer part of the pitch period $T_1$ in the first subframe is variable-length encoded. When it is determined that the time series signals x(n) (n=0, . . . , L−1) of the current frame are highly stationary, however, instead of the difference TD(1, 3), the difference TD(2, 3) between the integer part of the pitch period $T_3$ of the third subframe included in the current frame and the integer part of the pitch period $T_2$ in the second subframe may be variable-length encoded. When the pitch period $T_2$ is encoded as the difference TD(1, 2) between the integer parts, as shown in FIG. 2B, the value obtained by adding the integer part of the pitch period $T_1$ to the difference TD(1, 2) is used as the integer part of the pitch period $T_2$.

Second Modification of Third Embodiment

In the third embodiment, when it is determined that the time series signals x(n) (n=0, . . . , L−1) of the current frame are highly stationary, the difference TD(1, 3) between the integer part of the pitch period $T_3$ of the third subframe included in the current frame and the integer part of the pitch period $T_1$ in the first subframe is variable-length encoded. However, instead of applying variable-length encoding to the difference TD(1, 3) between the integer parts, encoding may be performed such that the difference between the value obtained by removing the two lowest bits of the pitch period $T_3$ of the third subframe, which includes the fractional part, and the value obtained by removing the two lowest bits of the pitch period $T_1$ in the first subframe, which includes the fractional part, is variable-length encoded; and the two lowest bits of the pitch period $T_3$ are encoded instead of the fractional part of the pitch period $T_3$. In that case, when the integer part of the pitch period $T_3$ is equal to or larger than the minimum value $T_{min}$ and smaller than $T_A$, the two bits of the fractional part of the pitch period $T_3$ are encoded; when the integer part of the pitch period $T_3$ is from $T_A$ to $T_B$, the least significant bit of the integer part and the one bit of the fractional part of the pitch period $T_3$ are encoded; and when the integer part of the pitch period $T_3$ is from $T_B$ to the maximum value $T_{max}$, the two lowest bits of the integer part of the pitch period $T_3$ are encoded.

Third Modification of Third Embodiment

In the third embodiment, when it is determined that the time series signals x(n) (n=0, . . . , L−1) of the current frame are highly stationary, the difference TD(1, 3) between the integer part of the pitch period $T_3$ of the third subframe included in the current frame and the integer part of the pitch period $T_1$ in the first subframe is variable-length encoded. When it is determined that the time series signals x(n) (n=0, . . . , L−1) of the current frame are highly stationary, however, the total code length of the code obtained by applying variable-length encoding to the difference TD(1, 3) and the code of the fractional part of the pitch period $T_3$ may be compared with the code length of the code obtained by encoding the pitch period $T_3$ (integer part and fractional part) in each subframe separately, to select whichever code having a higher compression effect as the code for the pitch period $T_3$ of the third subframe.

When the code obtained by encoding the pitch period $T_3$ (integer part and fractional part) in each subframe separately is selected as the code for the pitch period $T_3$ of the third subframe, the total code length of the code obtained by applying variable-length encoding to the difference TD(3, 1) between the integer part of the pitch period $T_1$ of the first subframe included in the current frame and the integer part of the pitch period $T_3$ in the third subframe and the code of the fractional part of the pitch period $T_1$ may be compared with the code length of the code obtained by encoding the pitch period $T_1$ (integer part and fractional part) in each subframe separately, to select whichever code having a higher compression effect as the code for the pitch period $T_1$ of the first subframe.

The code length comparison described above may be performed by actually calculating the codes to be compared and using the code lengths of the codes, or by using the predictions of the code lengths. When a fixed-length side bit indicating which code has been selected is added, the code length of this side bit is also taken into account for the comparison.

Fourth Embodiment

Figure 11:
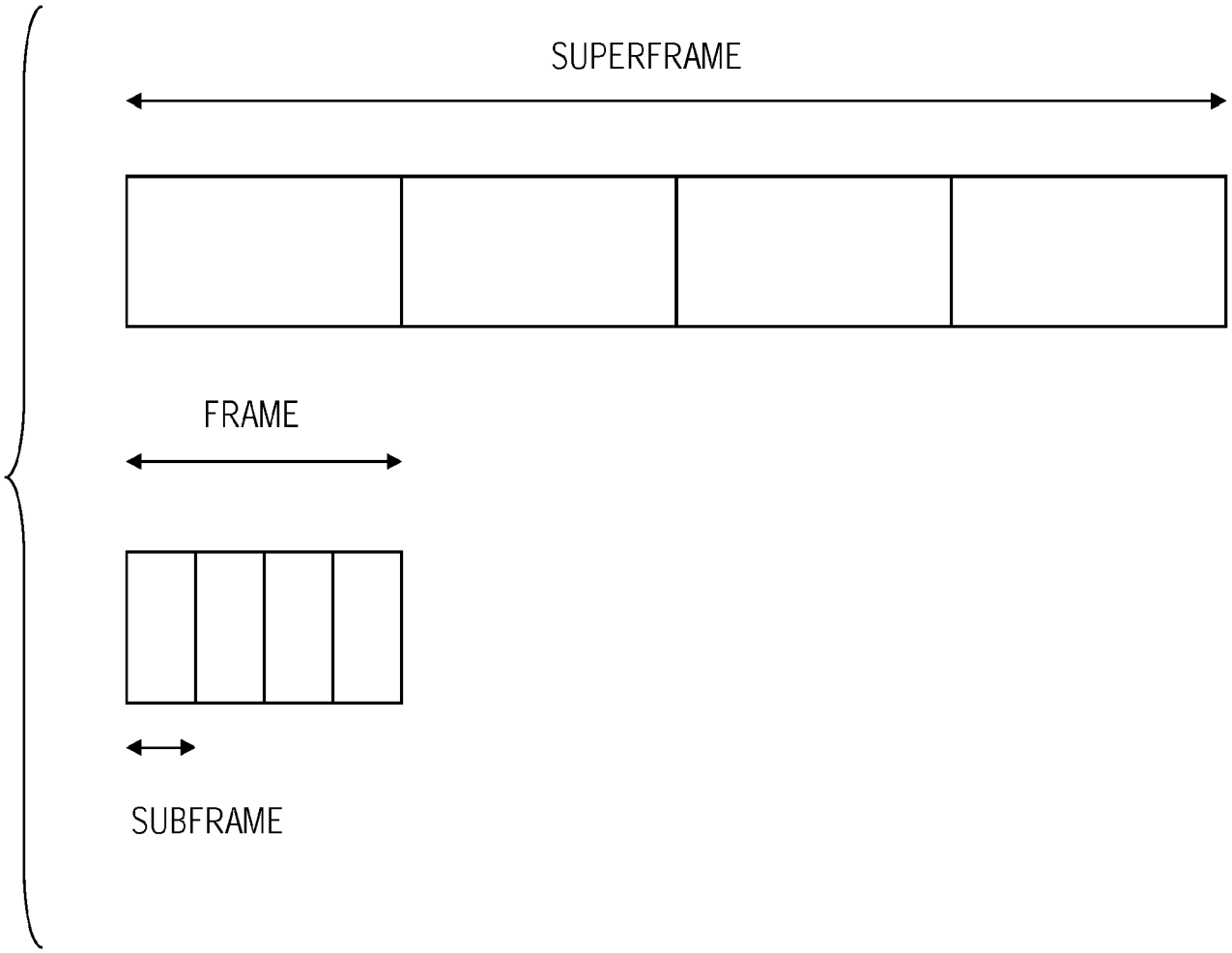
FIG. 11 is a view showing an example relationship between frames and a superframe.

In a fourth embodiment, the difference between values corresponding to pitch periods in subframes included in different frames and the difference is variable-length encoded. As shown as an example in FIG. 11, certain processing (such as long-term prediction or short-term prediction) is performed in each superframe formed of a plurality of frames in some cases. In such a case, the subframes included in an identical superframe may have high stationarity or high periodicity. Even different superframes may have high stationarity. In such a case, the difference between the pitch period of the first subframe in the current frame and the pitch period of the third subframe or the fourth subframe of a past frame located before the current frame becomes small in many cases. In the present embodiment, the difference between values corresponding to pitch periods in subframes included in different frames is obtained and the difference is variable-length encoded to reduce the length of the code.

In other words, also in the pitch period encoding processing of the fourth embodiment, when an index that indicates the level of periodicity and/or stationarity of the time series signals satisfies a condition that indicates high periodicity and/or high stationarity, the pitch period in a first predetermined time interval included in a predetermined time interval is encoded, and the difference between a value corresponding to the pitch period in a second predetermined time interval included in the predetermined time interval other than the first predetermined time interval and a value corresponding to the pitch period in a time interval included in the predetermined time interval other than the second predetermined time interval is variable-length encoded. Note that "the predetermined time interval" means a frame, "the first predetermined time interval" means a subframe in a past frame located before the current frame, "the second predetermined time interval" means the first subframe in the current frame, "the time interval other than the second predetermined time interval" means a subframe in the past frame located before the current frame, and "the value corresponding to the pitch period" means the integer part of the pitch period. For simplicity of description, a case will be described below in which "the first predetermined time interval" means the third subframe in the frame immediately before the current frame, "the second predetermined time interval" means the first subframe in the current frame, and "the time interval other than the second predetermined time interval" means the third subframe in the frame immediately before the current frame. However, these assignments do not limit the present invention. In the following description, differences from the embodiments described above will be mainly described.

<Configuration>

The configurations of an encoder 41 and a decoder 42 according to the fourth embodiment will be described below with reference to FIGS. 4 to 6.

As shown in FIG. 4 as an example, the encoder 41 of the fourth embodiment differs from the encoder 11 of the first embodiment in that the parameter encoding unit 117 is replaced with a parameter encoding unit 417. The decoder 42 of the fourth embodiment differs from the decoder 12 of the first embodiment in that the parameter decoding unit 127 is replaced with a parameter decoding unit 427.

As shown in FIG. 5 as an example, the parameter encoding unit 417 of the fourth embodiment differs from the parameter encoding unit 117 of the first embodiment in that the determination unit 117*b* is replaced with the determination unit 317*b*, the pitch period encoding unit 117*d* is replaced with a pitch period encoding unit 417*d*, and the pitch period encoding unit 117*e* is replaced with a pitch period encoding unit 417*e*. As shown in FIG. 6 as an example, the parameter decoding unit 427 of the fourth embodiment differs from the parameter decoding unit 127 of the first embodiment in that the determination unit 127*b* is replaced with the determination unit 327*b*, the pitch period decoding unit 127*d* is replaced with a pitch period decoding unit 427*d*, and the pitch period decoding unit 127*e* is replaced with a pitch period decoding unit 427*e*.

<Encoding Method>

The encoding method of the fourth embodiment will be described below with reference to FIG. 7A.

In the encoding method of the fourth embodiment, step S312, described earlier, is executed instead of step S112 of the first embodiment; step S413, described below, is executed instead of step S113 of the first embodiment; and step S414, described below, is executed instead of step S114 of the first embodiment. The other steps may be the same as those in the first embodiment or its modifications. Only the processing of step S413 and step S414 of the present embodiment will be described below.

[Processing of Step S413]

When it is determined in step S312 that the signals are non-stationary (non-periodic), the switch 117*c* sends the pitch periods $T=T_1$, $T_2$, $T_3$, $T_4$ to the pitch period encoding unit 417*d* (FIG. 5) under the control of the determination unit 317*b*. The pitch period encoding unit 417*d* generates a code $C_T$ corresponding to the pitch periods T of the current frame by using, for example, the same method (specific case 1 of step S413) as in the conventional case (FIGS. 2A and 2B), or the same method (specific case 2 of step S413) as in step S113 (FIG. 8B) of the first embodiment, and outputs the code (step S413).

[Processing of Step S414]

Figures 12A, 12B:
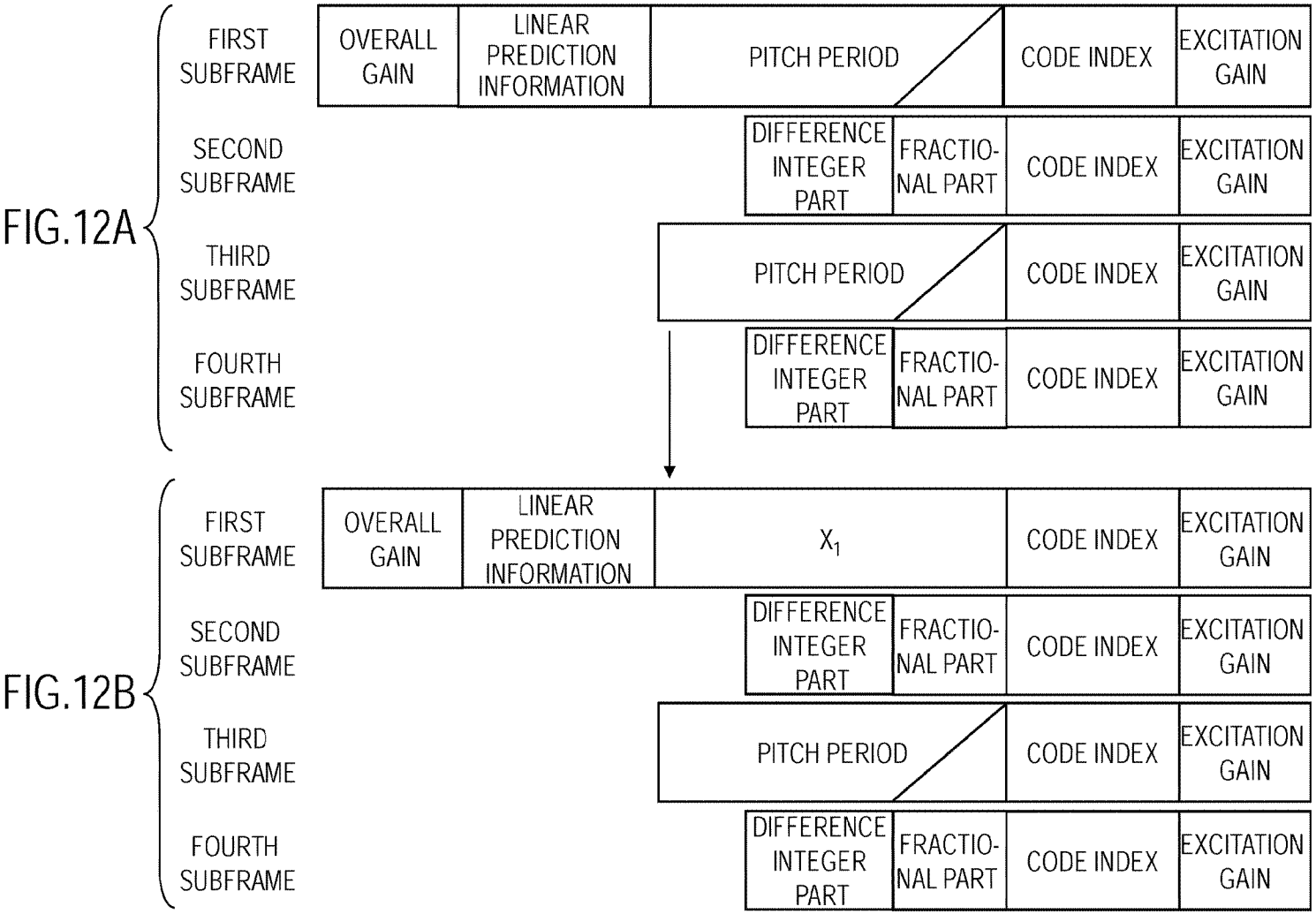
FIGS. 12A and 12B are views showing an example pitch period encoding method according to a fourth embodiment when time series signals are stationary (periodic)

When it is determined in step S312 that the signals are stationary (periodic), the switch 117c sends the pitch periods $T=T_1$, $T_2$, $T_3$, $T_4$ to the pitch period encoding unit 417e under the control of the determination unit 317b. FIGS. 12A and 12B show an example pitch period encoding method according to the fourth embodiment when the time series signals are stationary (periodic).

As shown as an example in FIG. 12B, the pitch period encoding unit 417e encodes the difference TD(1, 2) between the integer part of the pitch period $T_2$ in the second subframe of the current frame (FIG. 12B) and the integer part of the pitch period $T_1$ in the first subframe of the current frame, and the difference TD(3, 4) between the integer part of the pitch period $T_4$ in the fourth subframe of the current frame and the integer part of the pitch period $T_3$ in the third subframe of the current frame (difference integer parts) separately, and encodes the values after the decimal point of the pitch periods $T_2$ and $T_4$ (fractional parts) separately. In addition, the pitch period encoding unit 417e encodes the pitch period $T_3$ of the third subframe of the current frame in each subframe separately. The encoding method for the second, third, and fourth subframes may to be, for example, the same as in the conventional case.

Furthermore, the pitch period encoding unit 417e calculates the difference TD(3', 1) between the integer part of the pitch period $T_1$ in the first subframe of the current frame (FIG. 12B) and the integer part of the pitch period $T_3'$ in the third subframe of the frame (FIG. 12A) immediately before the current frame, which was input past to the pitch period encoding unit 417e. Depending on the difference TD(3', 1), the pitch period encoding unit 417e either applies variable-length encoding to the difference TD(3', 1) or encodes the pitch period $T_1$ of the first subframe of the current frame in each subframe separately, to generate a code $X_1$ for the pitch period $T_1$ in the first subframe of the current frame (FIG. 12B). This processing is the same as in the third embodiment except that the difference TD(1, 3) is replaced with the difference TD(3', 1). Instead of the difference TD(3', 1), the difference TD(4', 1) from the integer part of the pitch period $T_4'$ in the fourth subframe of the frame immediately before the current frame may be used. In that case, when the pitch period $T_4'$ in the fourth subframe of the frame immediately before the current frame has been encoded with the use of the difference TD(3', 4') between the integer parts of the pitch periods $T_3'$ and $T_4'$ in the third and fourth subframes of the frame immediately before the current frame, $T_4$ is obtained by adding the difference TD(3', 4') to the pitch period $T_3'$, and TD(4', 1) is calculated.

<Decoding Method>

The decoding method of the fourth embodiment will be described below with reference to FIG. 7B. In the decoding method of the fourth embodiment, step S322, described earlier, is executed instead of step S122 of the first embodiment; step S423, described below, is executed instead of step S123 of the first embodiment; and step S424, described below, is executed instead of step S124 of the first embodiment. The other steps may be the same as those in the first embodiment or its modifications. Only the processing of steps S423 and S424 of the present embodiment will be described below.

[Processing of Step S423]

When it is determined in step S322 that the index that indicates the stationarity of the time series signals x(n) (n=0, . . . , L−1) corresponding to the bit stream BS does not satisfy the condition indicating that the time series signals x(n) (n=0, . . . , L−1) are highly stationary (when the signals were non-stationary), the switch 127f sends the code $C_T$ of the current frame to the pitch period decoding unit 427d under the control of the determination unit 327b. The pitch period decoding unit 427d decodes the code $C_T$ in decoding processing corresponding to the encoding processing executed by the pitch period encoding unit 417d (FIG. 5) and outputs the pitch periods $T'=T_1'$, $T_2'$, $T_3'$, $T_4'$ of the current frame (step S423).

[Processing of Step S424]

When it is determined in step S322 that the index that indicates the stationarity of the time series signals x(n) (n=0, . . . , L−1) corresponding to the bit stream BS satisfies the condition indicating that the time series signals x(n) (n=0, . . . , L−1) are highly stationary (when the signals were stationary), the switch 127f sends the code $C_T$ of the current frame to the pitch period decoding unit 427e under the control of the determination unit 327b. The pitch period decoding unit 427e decodes the code $C_T$ in decoding processing corresponding to the encoding processing executed by the pitch period encoding unit 417e (FIG. 5) and outputs the pitch periods $T'=T_1'$, $T_2'$, $T_3'$, $T_4'$ of the current frame (step S424).

Fifth Embodiment

A combination of the above-described embodiments may be provided. A fifth embodiment is such an example.

<Configuration>

The configurations of an encoder 51 and a decoder 52 according to the fifth embodiment will be described below with reference to FIGS. 4 to 6.

As shown in FIG. 4 as an example, the encoder 51 of the fifth embodiment differs from the encoder 11 of the first embodiment in that the parameter encoding unit 117 is replaced with a parameter encoding unit 517. The decoder 52 of the fifth embodiment differs from the decoder 12 of the first embodiment in that the parameter decoding unit 127 is replaced with a parameter decoding unit 527.

As shown in FIG. 5 as an example, the parameter encoding unit 517 of the fifth embodiment differs from the parameter encoding unit 117 of the first embodiment in that the determination unit 117b is replaced with a determination unit 517b, the pitch period encoding unit 117d is replaced with a pitch period encoding unit 517d, and the pitch period encoding unit 117e is replaced with a pitch period encoding unit 517e. As shown in FIG. 6 as an example, the parameter decoding unit 527 of the fifth embodiment differs from the parameter decoding unit 127 of the first embodiment in that the determination unit 127b is replaced with a determination unit 527b, the pitch period decoding unit 127d is replaced with a pitch period decoding unit 527d, and the pitch period decoding unit 127e is replaced with a pitch period decoding unit 527e.

<Encoding Method>

Figure 13:
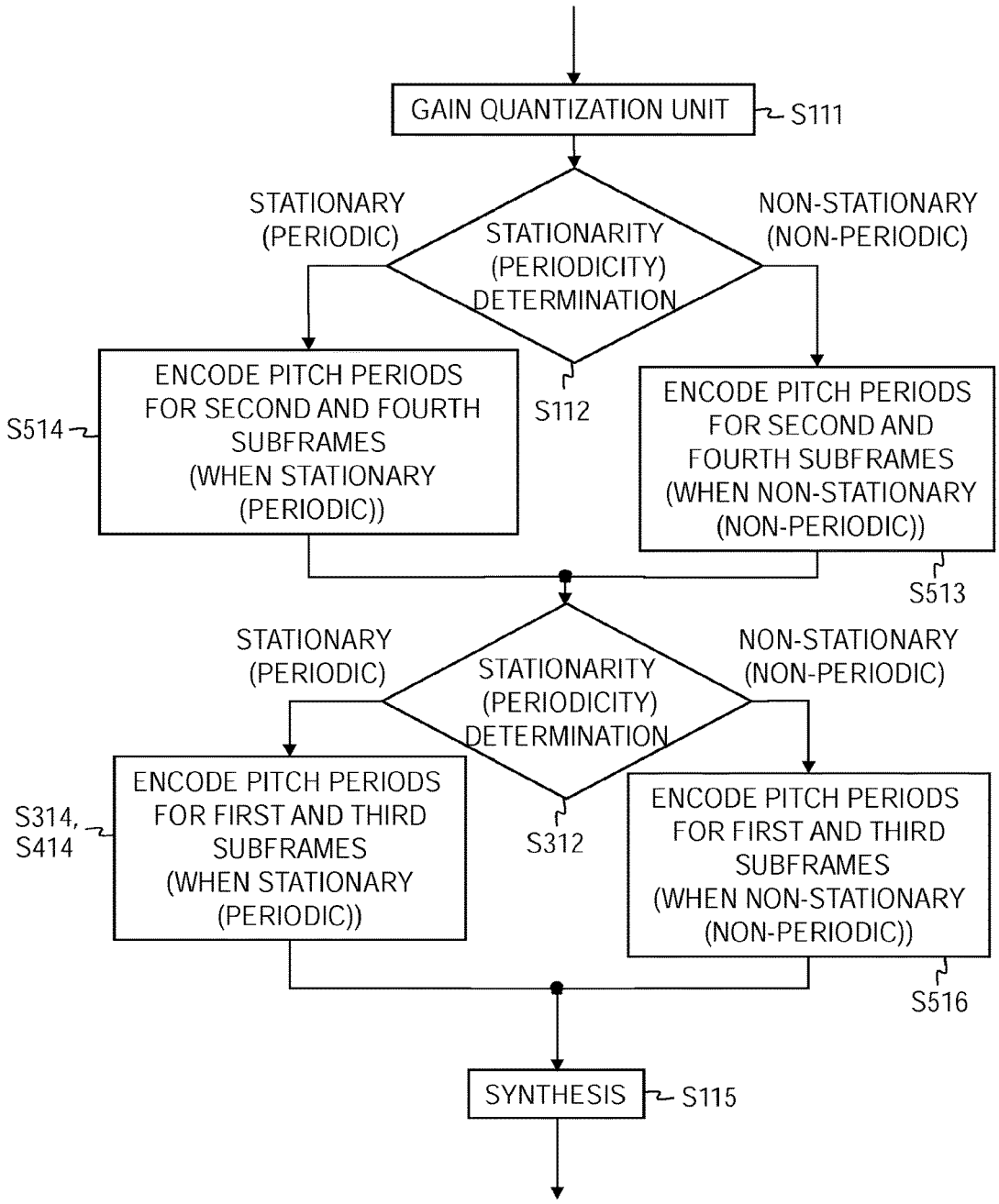
FIG. 13 is a flowchart illustrating an encoding method according to a fifth embodiment.

FIG. 13 is a flowchart illustrating an encoding method of the fifth embodiment.

After the processing of step S111 is executed, the determination unit 517b of the parameter encoding unit 517 (FIG. 5) determines in the determination processing of step S112, described earlier, whether the time series signals x(n) (n=0, . . . , L−1) of the current frame are stationary (periodic) or not.

When it is determined in this determination that the index that indicates the stationarity of the time series signals x(n) (n=0, . . . , L−1) does not satisfy the condition indicating that the time series signals x(n) (n=0, . . . , L−1) are highly stationary (periodic) (when it is determined that the signals are non-stationary or non-periodic), the switch 117*c* sends the pitch periods $T_2$ and $T_4$ to the pitch period encoding unit 517*d* under the control of the determination unit 517*b*. The pitch period encoding unit 517*d* sets the resolution used to express each of the pitch periods $T_2$ and $T_4$ to the integer resolution only and encodes the pitch periods $T_2$ and $T_4$ in each subframe separately (step S513).

Conversely, when it is determined that the index that indicates the stationarity of the time series signals x(n) (n=0, . . . , L−1) satisfies the condition indicating that the time series signals x(n) (n=0, . . . , L−1) are highly stationary (periodic) (when it is determined that the signals are stationary or periodic), the switch 117*c* sends the pitch periods $T_1$, $T_2$, $T_3$, and $T_4$ to the pitch period encoding unit 517*e* under the control of the determination unit 517*b*. The pitch period encoding unit 517*e* encodes the differences between the integer parts of the pitch periods $T_2$ and $T_4$ and the integer parts of the pitch periods $T_1$ and $T_3$, expressed at fractional resolution, and encodes the values after the decimal point of the pitch periods $T_2$ and $T_4$ separately with two bits (step S514).

Next, the determination unit 517*b* of the parameter encoding unit 517 determines in the determination processing of step S312, described earlier, whether the time series signals x(n) (n=0, . . . , L−1) of the current frame are stationary (periodic) or not.

When it is determined in this determination that the time series signals are non-stationary or non-periodic, the switch 117*c* sends the pitch periods $T_1$ and $T_3$ to the pitch period encoding unit 517*d* under the control of the determination unit 517*b*. The pitch period encoding unit 517*d* sets the resolution used to express each of the pitch periods $T_1$ and $T_3$ to the integer resolution only and encodes the pitch periods $T_1$ and $T_3$ in each subframe separately (step S516).

Conversely, when it is determined in this determination that the time series signals are stationary or periodic, the switch 117*c* sends the pitch periods $T_1$ and $T_3$ to the pitch period encoding unit 517*e* under the control of the determination unit 517*b*. The pitch period encoding unit 517*e* encodes the pitch periods $T_1$ and $T_3$ in the same way as in step S314 (or S414) of the third embodiment (or the fourth embodiment).

Then, the processing of step S115, described in the first embodiment, is executed.

Figure 14:
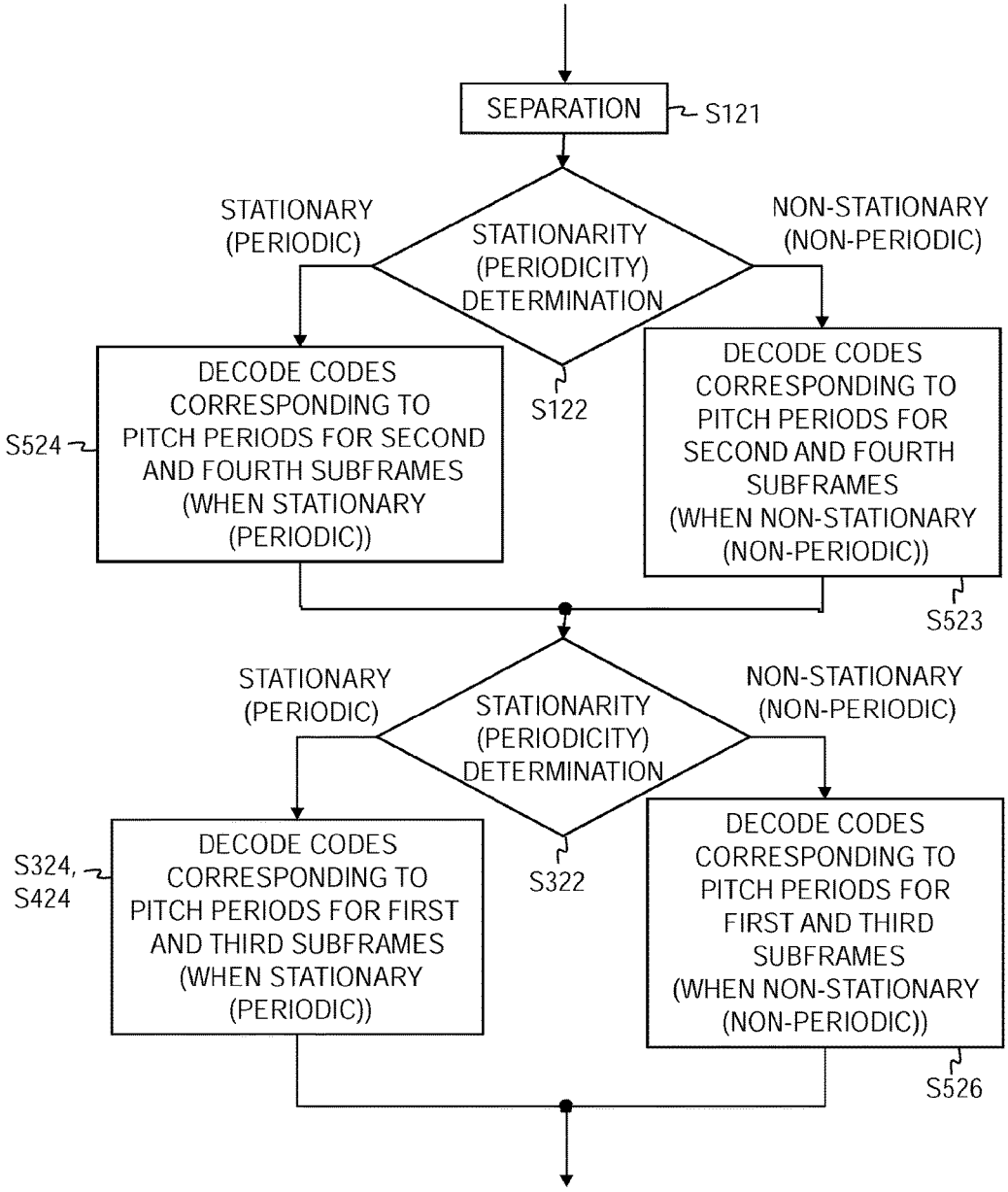
FIG. 14 is a flowchart illustrating a decoding method according to the fifth embodiment.

FIG. 14 is a flowchart illustrating a decoding method of the fifth embodiment.

After the processing of step S121 is executed, the determination unit 527*b* of the parameter decoding unit 527 (FIG. 6) determines in the determination processing of step S122, described earlier, whether the time series signals x(n) (n=0, . . . , L−1) corresponding to the bit stream BS of the current frame are stationary (periodic) or not.

When it is determined in this determination that the index that indicates the stationarity of the time series signals x(n) (n=0, . . . , L−1) does not satisfy the condition indicating that the time series signals x(n) (n=0, . . . , L−1) are highly stationary (periodic) (when it is determined that the signals were non-stationary or non-periodic), the switch 127*f* sends the code $C_T$ to the pitch period decoding unit 527*d* under the control of the determination unit 527*b*. The pitch period decoding unit 527*d* executes decoding processing corresponding to that of step S513 to calculate the pitch periods $T_2'$ and $T_4'$ of the second and fourth subframes (step S523).

Conversely, when it is determined that the index that indicates the stationarity of the time series signals x(n) (n=0, . . . , L−1) satisfies the condition indicating that the time series signals x(n) (n=0, . . . , L−1) are highly stationary (periodic) (when it is determined that the signals were stationary or periodic), the switch 127*f* sends the code $C_T$ to the pitch period decoding unit 527*e* under the control of the determination unit 527*b*. The pitch period decoding unit 527*e* executes decoding processing corresponding to that of step S514 to calculate the pitch periods $T_2'$ and $T_4'$ of the second and fourth subframes (step S524).

Next, the determination unit 527*b* determines in the determination processing of step S322, described earlier, whether the time series signals x(n) (n=0, . . . , L−1) corresponding to the bit stream BS of the current frame are stationary (periodic) or not.

When it is determined in this determination that the index that indicates the stationarity of the time series signals x(n) (n=0, . . . , L−1) does not satisfy the condition indicating that the time series signals x(n) (n=0, . . . , L−1) are highly stationary (periodic) (when it is determined that the signals were non-stationary or non-periodic), the switch 127*f* sends the code $C_T$ to the pitch period decoding unit 527*d* under the control of the determination unit 527*b*. The pitch period decoding unit 527*d* executes decoding processing corresponding to that of step S516 to calculate the pitch periods $T_1'$ and $T_3'$ of the first and third subframes (step S526).

Conversely, when it is determined that the index that indicates the stationarity of the time series signals x(n) (n=0, . . . , L−1) satisfies the condition indicating that the time series signals x(n) (n=0, . . . , L−1) are highly stationary (periodic) (when it is determined that the signals were stationary or periodic), the switch 127*f* sends the code $C_T$ to the pitch period decoding unit 527*e* under the control of the determination unit 527*b*. The pitch period decoding unit 527*e* executes decoding processing corresponding to that of step S314 (or step S414) to calculate the pitch periods $T_1'$ and $T_3'$ of the first and third subframes.

Since variable-length encoding depending on other parameters is used in the above-described processing, it is necessary to configure a bit stream that allows unique decoding. Among the elements of the bit stream shown as an example in FIG. 2A, it is necessary to make it possible to decode first the codes other than those of the pitch periods, and then, to decode the codes of the pitch periods $T_2'$ and $T_4'$ based on the decoded quantized pitch gains and linear prediction information. Then, the pitch periods $T_1'$ and $T_3'$ are obtained by decoding depending also on the pitch periods $T_2'$ and $T_4'$.

Sixth Embodiment

When the bit stream BS of each frame is transferred in packets, it is desirable that the code length (bit length) of one frame be fixed. There is no restriction on the configuration of bits in a frame in packet transfer. In a sixth embodiment, the code length of one frame is fixed and extra bits in a frame are used to improve coding quality in the frame.

<Configuration>

The configurations of an encoder 61 and a decoder 62 according to the sixth embodiment will be described below with reference to FIGS. 4 to 6.

As shown in FIG. 4 as an example, the encoder 61 of the sixth embodiment differs from the encoder 11 of the first embodiment in that the search unit 913 is replaced with a search unit 613; the fixed codebook 914 is replaced with a fixed codebook 614; the parameter encoding unit 117 is replaced with a parameter encoding unit 617; and a bit assignment unit 611 is added. The decoder 62 of the sixth embodiment differs from the decoder 12 of the first embodiment in that the parameter decoding unit 127 is replaced with a parameter decoding unit 627.

<Encoding Method>

The search unit 613 (FIG. 4) obtains the pitch periods $T_1$, $T_2$, and $T_3$ (integer parts and fractional parts) for the first to third subframes included in the current frame in the same way as in the conventional case, determines signal components c(n) formed of one or more signals having a value formed of a non-zero individual pulse read from the fixed codebook 614 and its positive or negative sign and one or more signals having a value of zero, identifies code indexes $C_{f1}$, $C_{f2}$, and $C_{f3}$ expressing those signal components c(n), and obtains pitch gains $g_{p1}$, $g_{p2}$, and $g_{p3}$ and fixed codebook gains $g_{c1}$, and $g_{c3}$. The fixed codebook 614 has the number of individual pulses for each subframe, the positions (potential positions) of the individual pulses allowed in each subframe, and a positive or negative sign (positive or negative sign candidate) allowed for each individual pulse (see "5.7 Algebraic codebook" in Non-patent literature 1, for example). The search unit 613 determines the signal components c(n) in the range specified in the fixed codebook 614 and identifies the code indexes $C_{f1}$, $C_{f2}$, and $C_{f3}$. Specifically, the search unit 613 selects the positions of the specified number of individual pulses from the positions allowed in the first to third subframes, selects a positive or negative sign for the individual pulse at each position from the allowed positive or negative sign, and identifies code indexes $C_{f1}$, $C_{f2}$, and $C_{f3}$ expressing the selected contents. The larger the number of individual pulses for each subframe is, the larger the number of bits in the code index becomes, increasing the coding resolution. In the present embodiment, such settings in the fixed codebook 614 are fixed for the first to third subframes. In other words, the number of individual pulses for each subframe, the positions of the individual pulses allowed in each subframe, and a positive or negative sign allowed for each individual pulse are the same in the first to third subframes.

The pitch gains $g_{p1}$, $g_{p2}$, and $g_{p3}$ and the fixed codebook gains $g_{c1}$, $g_{c2}$, and $g_{c3}$ for the first to third subframes are input to the gain quantization unit 617*a* (FIG. 5) of the parameter encoding unit 617. The gain quantization unit 617*a* applies vector quantization to these items in each subframe to generate a VQ gain code corresponding to the combination of a quantized value of a pitch gain and a quantized value of a fixed-codebook gain in each subframe. The larger the number of bits used to express the VQ gain code (referred to as the number of VQ gain code bits) is, the quantization interval (quantization step) can be made shorter, and the range of pitch gain or fixed-codebook gain to which vector quantization can be applied can be made larger, increasing the coding quality. In the present embodiment, the number of VQ gain code bits is fixed in advance for the first to third subframes (for example, seven bits (which can express 128 combinations of quantized values of pitch gains and fixed-codebook gains or values corresponding to fixed-codebook gains)). The gain quantization unit 617*a* outputs codes corresponding to the VQ gain codes (for example, codes obtained by applying compression encoding to the VQ gain codes) for the first to third subframes.

The search unit 613 (FIG. 4) obtains the pitch period $T_4$ (integer part and fractional part) for the fourth subframe included in the current frame in the same way as in the conventional case. The pitch periods $T_1$, $T_2$, $T_3$, and $T_4$ of the first to fourth subframes are input to the parameter encoding unit 617 (FIG. 5). The parameter encoding unit 617 encodes the integer parts of the pitch periods $T_1$, $T_2$, $T_3$, and $T_4$ in the same way as in the first to fifth embodiments, described above. For example, the parameter encoding unit 617 uses the VQ gain code(s) of all of the first to third subframes or one of them as index(es) indicating the level of stationarity of the time series signals x(n) (n=0, . . . , L−1) to encode the integer parts of the pitch periods $T_1$, $T_2$, $T_3$, and $T_4$ in the same way as in the embodiments described above and their modifications. The parameter encoding unit 617 may encode the integer parts of the pitch periods $T_1$, $T_2$, $T_3$, and $T_4$ in the same way as in the conventional technique.

The bit assignment unit 611 (FIG. 4) uses a fixed code length specified in advance for one frame, and the code lengths assigned in the current frame such as the code length of the linear prediction information LPC info of the current frame, the code length of a code corresponding to each integer part of the pitch periods $T_1$, $T_2$, $T_3$, and $T_4$, the code length of the code indexes $C_{f1}$, $C_{f2}$, and $C_{f3}$, and the code length of a code corresponding to the VQ gain code for each of the first to third subframes, to determine the assignment of code lengths which has not yet been determined in the current frame. The bit assignment unit 611 of the present embodiment determines the resolutions of the fractional parts of the pitch periods $T_1$, $T_2$, $T_3$, and $T_4$ (see FIG. 3), the number of individual pulses for the fourth subframe, and the number of VQ gain code bits for the fourth subframe. Some of these items may be fixed.

The higher the resolution of the fractional part of each pitch period is, the longer the code length assigned to a code corresponding to the fractional part of the pitch period becomes, increasing the coding quality. The larger the number of individual pulses for the fourth subframe is, the longer the code length assigned to the code index $C_{f4}$ for the fourth subframe becomes, increasing the coding quality of the fourth subframe. The larger the number of VQ gain code bits for the fourth subframe is, the longer the code length assigned to a code corresponding to the VQ gain code for the fourth subframe becomes, increasing the coding quality of the fourth subframe. In such a code length assignment, as many bits as possible among bits for which assignment has not been determined in the current frame are assigned to a code corresponding to the fractional part of each pitch period, the code index $C_{f4}$ for the fourth subframe, and a code corresponding to the VQ gain code for the fourth subframe. It is preferred that all the bits for which assignment has not been determined in the current frame are assigned to a code corresponding to the fractional part of each pitch period, the code index $C_{f4}$ for the fourth subframe, and a code corresponding to the VQ gain code for the fourth subframe. Such a code length assignment is performed according to a rule determined in advance.

Information indicating the resolutions of the fractional parts of the pitch periods $T_1$, $T_2$, $T_3$, and $T_4$ for the first to fourth subframes, the resolution being determined by the bit assignment unit 611, is input to the parameter encoding unit 617. The parameter encoding unit 617 encodes the fractional parts of the pitch periods $T_1$, $T_2$, $T_3$, and $T_4$ for the first to fourth subframes at the resolutions indicated by this information to generate codes corresponding to the fractional parts of the pitch periods $T_1$, $T_2$, $T_3$, and $T_4$.

Information indicating the number of individual pulses for the fourth subframe, the number being determined by the bit assignment unit 611, is input to the search unit 613 (FIG. 4). The search unit 613 uses analysis for the fourth subframe included in the current frame to determine a signal component c(n) for the fourth subframe, formed of combinations of the individual pulses, the number thereof being indicated by the information, and positive or negative signs of the individual pulses (to determine combinations of the positions of the individual pulses and positive and negative signs of the individual pulses) to identify the code index $C_{f4}$ expressing the signal component, and obtains pitch gain $g_{p4}$ and fixed-codebook gain $g_{c4}$. This analysis is conducted in the same way as in the conventional case except that the pitch period $T_4$ obtained before for the fourth subframe is fixed.

The information indicating the number of VQ gain code bits for the fourth subframe, determined by the bit assignment unit 611, and the pitch gain $g_{p4}$ and the fixed-codebook gain $g_{c4}$ obtained by the search unit 613 are input to the gain quantization unit 617*a* of the parameter encoding unit 617 (FIG. 5). The gain quantization unit 617*a* applies vector quantization to the pitch gain $g_{p4}$ and the fixed-codebook gain $g_{c4}$ with the number of VQ gain code bits indicated by the information indicating the number of bits to obtain a VQ gain code having that number of VQ gain code bits, for the fourth subframe, and outputs a code corresponding to the VQ gain code for the fourth subframe (for example, codes obtained by applying compression encoding to the VQ gain codes).

The linear prediction information LPC info of the current frame, the code indexes $C_f=C_{f1}$, $C_{f2}$, $C_{f3}$, $C_{f4}$, the code $C_T$ corresponding to the pitch periods $T_1$, $T_2$, $T_3$, and $T_4$ (integer parts and fractional parts) for the first to fourth subframes, and the codes corresponding to the VQ gain codes for the first to fourth subframes are input to the synthesis unit 117*g*. The synthesis unit 117*g* synthesizes these items according to the sequence determined in advance, generates a bit stream BS for which the code length per frame is fixed, and outputs the bit stream. If the total code length per frame of the information input to the synthesis unit 117*g* is smaller than the fixed code length per frame, a side bit and other bits may be added to the bit stream BS.

<Decoding Method>

The bit stream BS is input to the parameter decoding unit 627 (FIG. 6) of the decoder 62. The parameter decoding unit 627 first obtains the linear prediction information LPC info, the code indexes $C_{f1}$, $C_{f2}$, and $C_{f3}$ for the first to third subframes, the code corresponding to the integer parts of the pitch periods $T_1$, $T_2$, $T_3$, and $T_4$ for the first to fourth subframes, and the codes corresponding to the VQ gain codes for the first to third subframes from the bit stream BS. The parameter decoding unit 627 can identify the code length assignment determined by the bit assignment unit 611 from the total code length of these items, and can obtain the code corresponding to the fractional parts of the pitch periods $T_1$, $T_2$, $T_3$, and $T_4$ for the first to fourth subframes, the code index $C_{f4}$ for the fourth subframe, and the code corresponding to the VQ gain code for the fourth subframe from the bit stream BS. The parameter decoding unit 627 also obtains the quantized pitch gains $g_p'=g_{p1}'$, $g_{p2}'$, $g_{p3}'$, $g_{p4}'$ and the quantized fixed-codebook gains $g_c'=g_{c1}'$, $g_{c2}'$, $g_{c3}'$, $g_{c4}'$ from the codes corresponding to the VQ gain codes for the first to fourth subframes. The processing to be performed thereafter is the same as in the first to fifth embodiments.

First Modification of Sixth Embodiment

In a modification of the sixth embodiment, a search unit 613' (FIG. 4) may search for the pitch period (integer part and fractional part) of the current subframe according to a search method corresponding to the VQ gain code of a past subframe located before the current subframe to obtain the pitch periods $T_2$, $T_3$, and $T_4$ (integer parts and fractional parts) of the second to fourth subframes, instead of obtaining the pitch periods $T_2$, $T_3$, and $T_4$ (integer parts and fractional parts) of the second to fourth subframes in the same way as in the conventional case by using the search unit 613. For example, the search unit 613' may search for the pitch period $T_2$ (integer part and fractional part) of the second subframe according to a search method corresponding to the VQ gain code of the first subframe, search for the pitch period $T_3$ (integer part and fractional part) of the third subframe according to a search method corresponding to the VQ gain codes of the first and second subframes, and search for the pitch period $T_4$ (integer part and fractional part) of the fourth subframe according to a search method corresponding to the VQ gain codes of the first to third subframes. Specifically, for example, the search unit 613' applies the determination criterion 1 or the determination criterion 2 of specific case 3 of step S112 to the VQ gain code of a past subframe to determine whether the time series signals are stationary (periodic) in the current subframe, and changes the search range of the pitch period of the current subframe according to the result. For example, when it is determined that the time series signals are non-stationary (non-periodic), since the adaptive signal components contribute just a little, the search unit 613' narrows the search range of the pitch period or lowers the search resolution of the fractional part of the pitch period as compared with the case where it is determined that the time series signals are stationary (periodic). Alternatively, for example, when it is determined that the time series signals are stationary (periodic), the integer part and the fractional part of each pitch period are searched for; and, when it is determined that the time series signals are non-stationary (non-periodic), only the integer part of each pitch period is searched for, and the fractional part is not searched for.

Second Modification of Sixth Embodiment

In a modification of the sixth embodiment, a bit assignment unit 611' may determine the resolutions of the fractional parts of the pitch periods in the second and third subframes according to the VQ gain code of a past subframe. For example, the bit assignment unit 611' determines the resolution of the fractional part of the pitch period $T_1$ in the first subframe, determines the resolution of the fractional part of the pitch period $T_2$ in the second subframe according to the VQ gain code for the first subframe, and determines the resolution of the fractional part of the pitch period $T_3$ in the third subframe according to the VQ gain codes for the first and second subframes, in the same way as in the first to fifth embodiments and the conventional technique. Specifically, for example, the bit assignment unit 611' applies the determination criterion 1 or the determination criterion 2 of specific case 3 of step S112 to the VQ gain code of a past subframe to determine whether the time series signals are stationary (periodic) in the current subframe, and determines the resolutions of the fractional parts of the pitch periods in the second and third subframes according to the result. Specifically, for example, when it is determined that the time series signals are non-stationary (non-periodic), since the adaptive signal components contribute just a little, the bit assignment unit 611' lowers the resolution of the fractional part of the pitch period as compared with the case where it is determined that the time series signals are stationary (periodic). For example, when it is determined that the time series signals are stationary (periodic), the bit assignment unit 611' encodes the fractional part of a pitch period at fractional resolution; and, when it is determined that the time series signals are non-stationary (non-periodic), the bit assignment unit 611' encodes the pitch period at the integer resolution.

The bit assignment unit 611' further uses a fixed code length per frame specified in advance, and the code lengths assigned in the current frame, such as the code length of the linear prediction information LPC info of the current frame, the code length of a code corresponding to each integer part of the pitch periods $T_1$, $T_2$, $T_3$, and $T_4$, the code length of a code corresponding to each fractional part of the pitch periods $T_1$, $T_2$, and $T_3$, the code length of the code indexes $C_{f1}$, $C_{f2}$, and $C_{f3}$, and the code length of codes corresponding to the VQ gain codes for the first to third subframes, to determine the assignment of code lengths which has not yet been determined in the current frame. For example, the bit assignment unit 611' determines the resolution of the fractional part of the pitch period $T_4$ in the fourth subframe, the number of individual pulses for the fourth subframe, and the number of VQ gain code bits for the fourth subframe. In this code length assignment, as many bits as possible among bits for which assignment has not been determined in the current frame are assigned to a code corresponding to the fractional part of the pitch period $T_4$ of the fourth subframe, the code index $C_{f4}$ for the fourth subframe, and a code corresponding to the VQ gain code for the fourth subframe. It is preferred that all the bits for which assignment has not been determined in the current frame are assigned to a code corresponding to the fractional part of the pitch period $T_4$ of the fourth subframe, the code index $C_{f4}$ for the fourth subframe, and a code corresponding to the VQ gain code for the fourth subframe.

Third Modification of Sixth Embodiment

In another modification of the sixth embodiment, a bit assignment unit 611" may determine the numbers of VQ gain code bits for the second and third subframes according to the VQ gain code of a past subframe. For example, the bit assignment unit 611" sets the number of VQ gain code bits for the first subframe to a fixed value, determines the number of VQ gain code bits for the second subframe according to the VQ gain code for the first subframe, and determines the number of VQ gain code bits for the third subframe according to the VQ gain codes for the first and second subframes. Specifically, for example, the bit assignment unit 611" applies the determination criterion 1 or the determination criterion 2 of specific case 3 of step S112 to the VQ gain code of a past subframe to determine whether the time series signals are stationary (periodic) in the current subframe, and determines the numbers of VQ gain code bits for the second and third subframes according to the result. Specifically, for example, when it is determined that the time series signals are non-stationary (non-periodic), since the adaptive signal components contribute just a little, the bit assignment unit 611" lowers the numbers of VQ gain code bits as compared with a case where it is determined that the time series signals are stationary (periodic).

Then, the bit assignment unit 611" uses a fixed code length per frame specified in advance, and the code lengths assigned in the current frame, such as the code length of the linear prediction information LPC info of the current frame, the code length of a code corresponding to each integer part of the pitch periods $T_1$, $T_2$, $T_3$, and $T_4$, the code length of the code indexes $C_{f1}$, $C_{f2}$, and $C_{f3}$, and the code length of a code corresponding to the VQ gain code for each of the first to third subframes, to determine the assignment of code lengths which has not yet been determined in the current frame, such as the number of VQ gain code bits for the fourth subframe, in the same way as in the sixth embodiment.

Fourth Modification of Sixth Embodiment

In a modification of the sixth embodiment, a fixed code length per frame specified in advance and the code lengths assigned in the current frame, such as the code length of the linear prediction information LPC info of the current frame, the code length of a code corresponding to each integer part of the pitch periods $T_1$, $T_2$, $T_3$, and $T_4$, the code length of the code indexes $C_{f1}$, $C_{f2}$, and $C_{f3}$, and the code length of a code corresponding to the VQ gain code for each of the first to third subframes, may be used to change the number of times the pitch gain and the fixed-codebook gain are updated (the number of updates of the VQ gain code) for the fourth subframe according to the code length which has not yet been assigned in the current frame. For example, when the code length which has not yet been assigned in the current frame is longer than a specified value, the pitch gain and the fixed-codebook gain may be updated twice in the fourth subframe, and a VQ gain code corresponding to the combination of a quantization value of the pitch gain and a quantization value of the fixed-codebook gain may be generated in each updating process.

Other Modifications

Figure 15A:
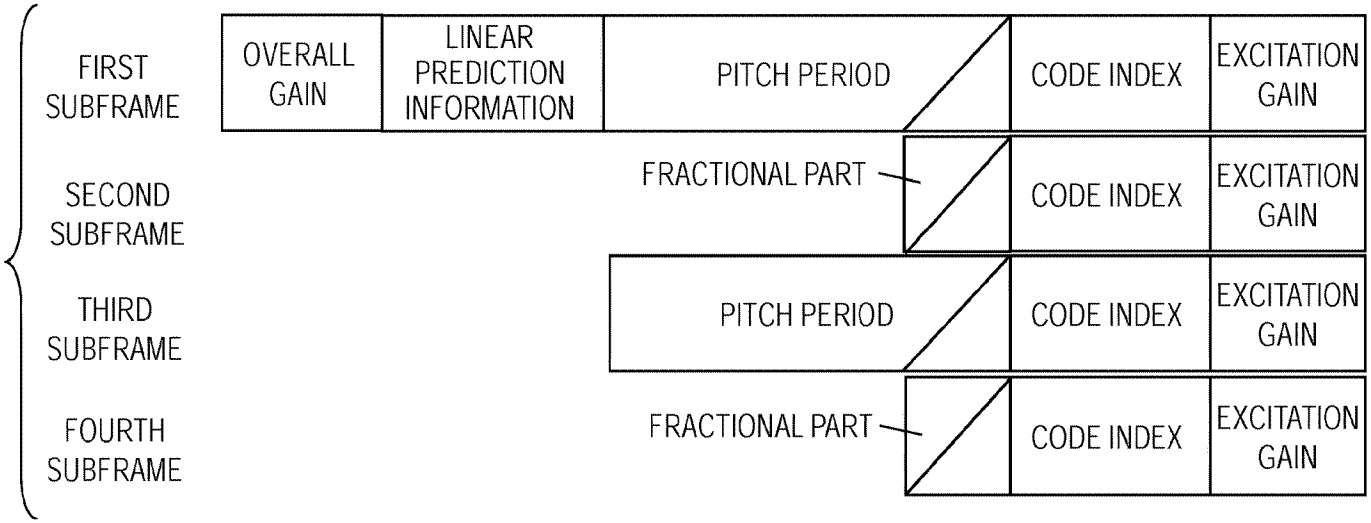
FIG. 15A is a view illustrating a modification of the pitch period encoding method.
Figure 15B:
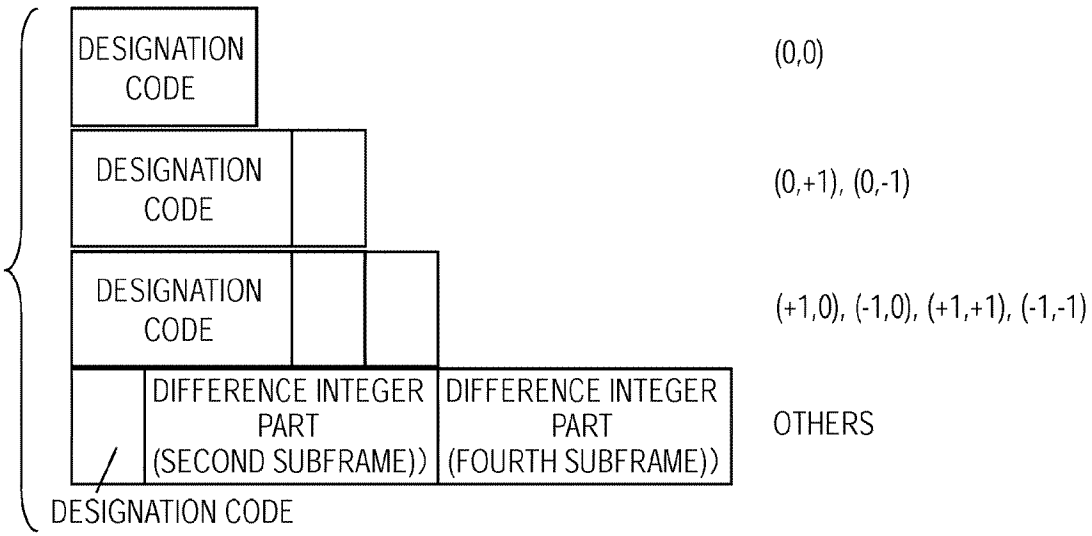
FIG. 15B is a view illustrating variable-length codes corresponding to the integer parts of pitch periods in second and fourth subframes.

The present invention is not limited to the above-described embodiments. For example, in each of the above-described embodiments, instead of encoding the fractional parts of the pitch periods in the second and fourth subframes with a fixed bit length (see FIGS. 9A and 9B, for example), each of the fractional parts of the pitch periods in the second and fourth subframes may be encoded at one resolution ranging from the quadruple fractional resolution to the integer resolution, depending on the value of the integer part of the corresponding pitch period, in the same way as for the first and third subframes (see FIGS. 15A and 15B, for example). For example, encoding may be performed such that, when the integer part of the pitch period $T_2$ is equal to or larger than the minimum value $T_{min}$ and smaller than $T_A$, the fractional part of the pitch period $T_2$ is encoded with two bits; when the integer part of the pitch period $T_2$ is from $T_A$ to $T_B$, the fractional part of the pitch period $T_2$ is encoded with one bit; and, when the integer part of the pitch period $T_2$ is from $T_B$ to the maximum value $T_{max}$, the fractional part of the pitch period $T_2$ is not encoded (for example, the same applies to the pitch period $T_3$). With this encoding, the average number of bits can be reduced while the performance is almost not affected. In the configuration shown in FIGS. 2A and 2B, instead of encoding the fractional parts of the pitch periods in the second and fourth subframes with a fixed bit length, each of the fractional parts of the pitch periods in the second and fourth subframes may be encoded at one resolution ranging from the quadruple fractional resolution to the integer resolution, depending on the value of the integer part of the corresponding pitch period, in the same way as for the first and third subframes.

Figures 16A, 16B, 16C:
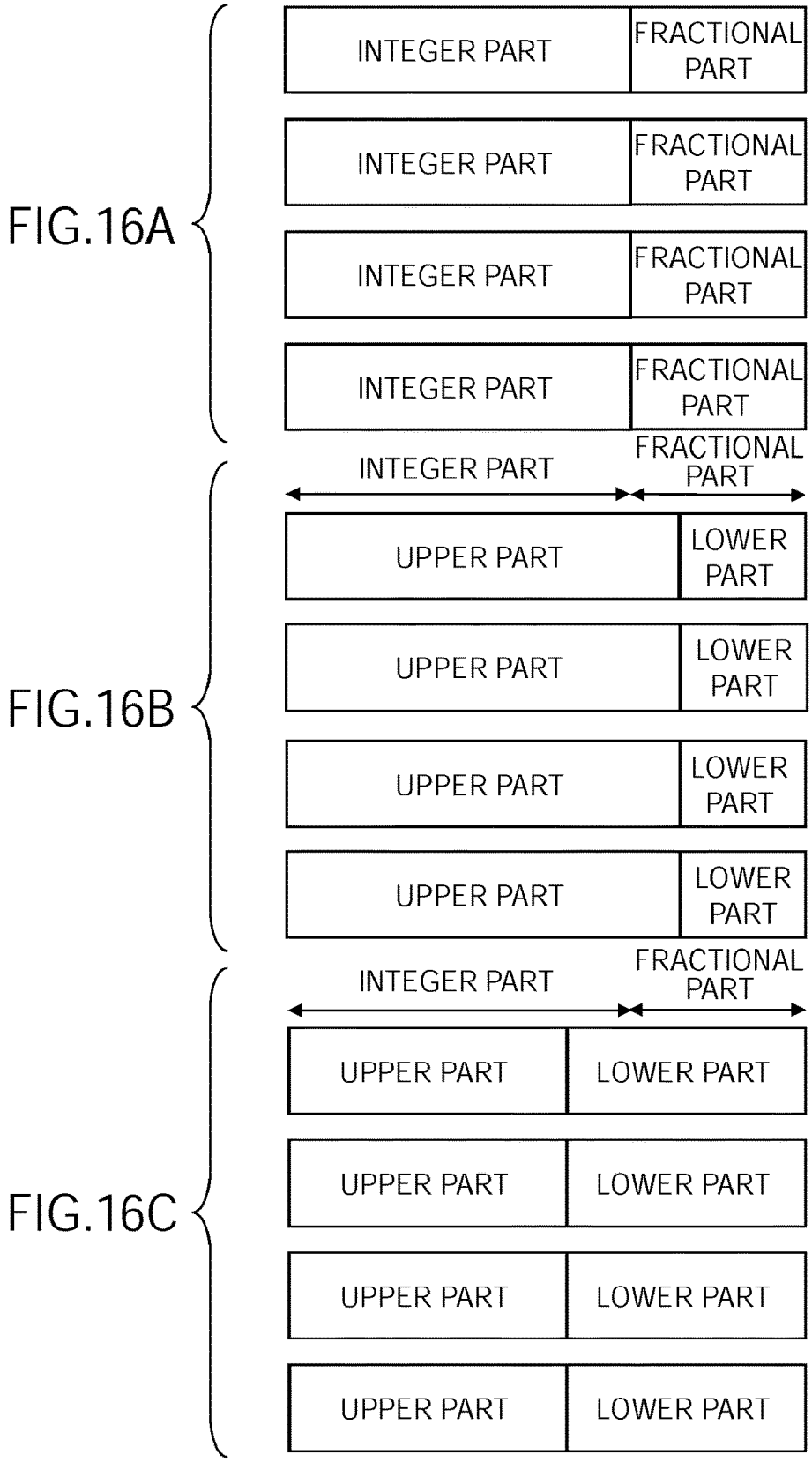
FIGS. 16A to 16C are views illustrating modifications of the pitch period encoding method.
Figure 17A:
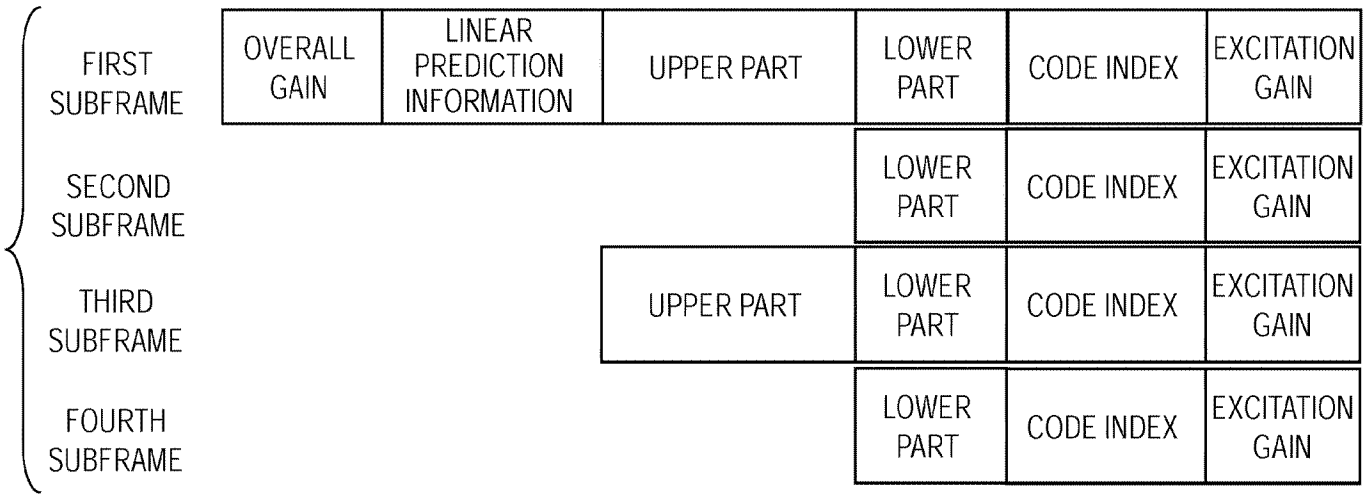
FIG. 17A is a view illustrating a modification of the pitch period encoding method.
Figure 17B:
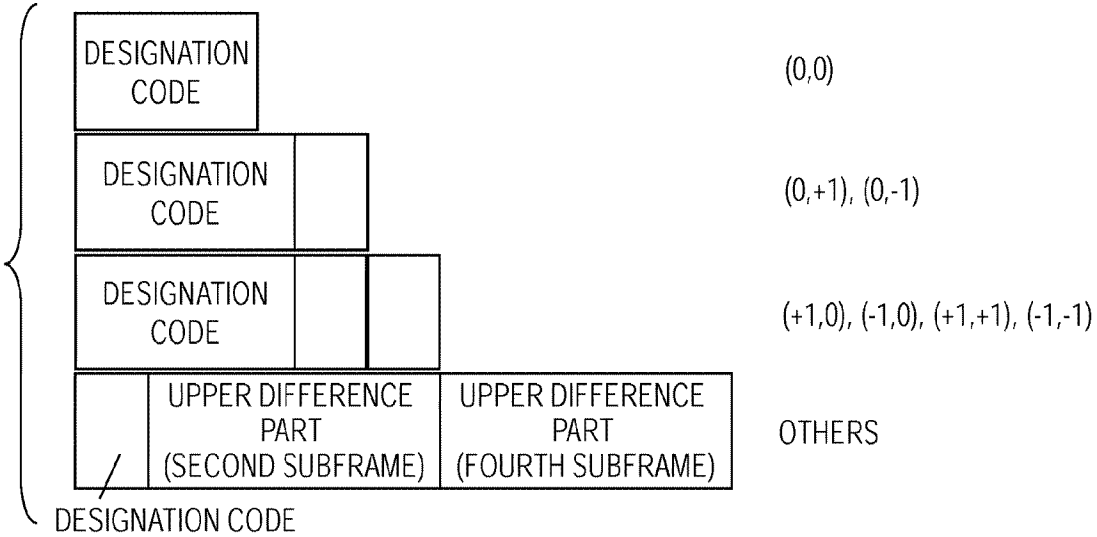
FIG. 17B is a view illustrating variable-length codes corresponding to the integer parts of pitch periods in second and fourth subframes.

In each of the above-described embodiments, the difference $TD(\alpha, \beta)$ is either (the integer part of the pitch period $T_\alpha$)−(the integer part of the pitch period $T_\beta$), or (the integer part of the pitch period $T_\beta$)−(the integer part of the pitch period $T_\alpha$). When the integer parts and the fractional parts of the pitch periods are expressed with fixed bit lengths, as shown in FIG. 16A, however, the difference $TD'(\alpha, \beta)$ between the upper parts of pitch periods [(the upper part of the pitch period $T_\alpha$)−(the upper part of the pitch period $T_\beta$), or (the upper part of the pitch period $T_\beta$)−(the upper part of the pitch period $T_\alpha$)] may be used, instead of the difference TD(α, β). The upper part of a pitch period means the value of a fixed number of upper bits in the pitch period expressed with a fixed bit length, and the lower part of the pitch period means a fixed number of lower bits remaining in the pitch period. The upper part of a pitch period may be the bits formed of all the bits of the integer part of the pitch period and some of the bits of the fractional part (for example, a fixed number of upper bits or a fixed number of lower bits of the fractional part) (see FIG. 16B, for example), or may be some of the bits of the integer part of the pitch period (for example, a fixed number of upper bits or a fixed number of lower bits of the integer part) (see FIG. 16C, for example). When the difference TD'(α, β) between the upper parts of pitch periods is used instead of the difference TD(α, β) between the integer parts of the pitch periods, the numerical value of the lower part of each pitch period is encoded, for example, directly. When the difference TD'(α, β) between the upper parts of pitch periods is used instead of the difference TD(α, β) between the integer parts of the pitch periods in the configuration shown in FIGS. 9A and 9B, codes for the pitch periods are configured, for example, as shown in FIGS. 17A and 17B.

Figure 9A:
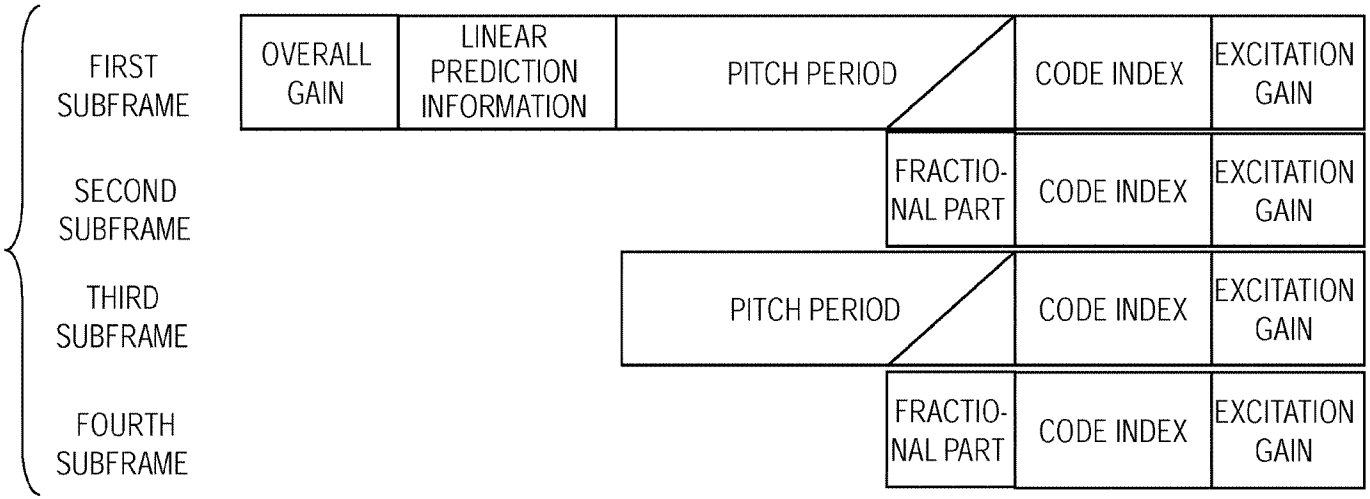
FIG. 9A is a view illustrating example structures of codes corresponding to pitch periods.
Figure 9B:
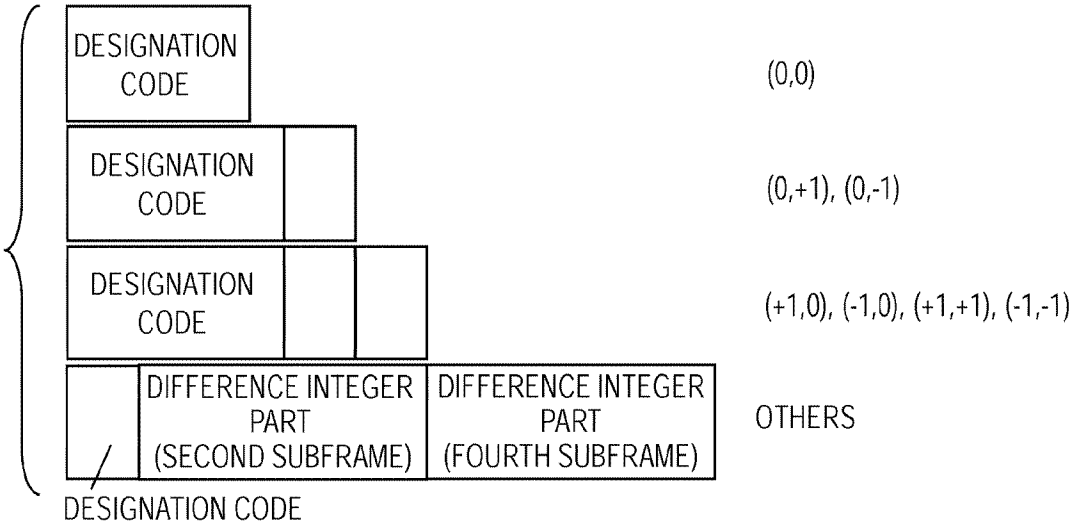
FIG. 9B is a view illustrating variable-length codes corresponding to the integer parts of pitch periods in second and fourth subframes.

Unlike the configuration shown in FIGS. 9A and 9B, where a value obtained by integrating the difference TD(1, 2) and the difference TD(3, 4) of the integer parts of the pitch periods is variable-length encoded according to the values of the difference TD(1, 2) and the difference TD(3, 4), a value obtained by integrating a difference TD(4', 1) and a difference TD(2, 3) of the integer parts of the pitch periods may be variable-length encoded according to the values of the difference TD(4', 1) and the difference TD(2, 3), where the difference TD(4', 1) is the difference between the integer part of the pitch period of the fourth subframe in the frame immediately before the current frame and the integer part of the pitch period of the first subframe in the current frame. In that case, instead of the difference TD(α, β) between the integer parts of pitch periods, the difference TD'(α, β) between the upper parts of the pitch periods may be used.

The search unit may directly obtain a value corresponding to the quantized pitch gain and a value corresponding to the quantized fixed-codebook gain, instead of obtaining the pitch gain and the fixed-codebook gain first, followed by a value corresponding to the quantized pitch gain and a value corresponding to the quantized fixed-codebook gain.

The processing based on whether the condition indicating the time series signals are highly periodic and/or highly stationary is satisfied or not, that is, based on the determination for selecting one of two classes, has been described so far. The processing can be extended such that the level of periodicity and/or stationarity is divided into three classes or more, and the resolutions used to express the pitch periods and/or the pitch period encoding mode are switched according to the class.

Each type of processing described above may be executed not only time sequentially according to the order of description but also in parallel or individually when necessary or according to the processing capabilities of the apparatuses that execute the processing. Appropriate changes can be made to the present invention without departing from the scope of the present invention.

When the configurations described above are implemented by a computer, the processing details of the functions that should be provided by hardware entities are described in a program. When the program is executed by a computer, the processing functions of the hardware entities are implemented on the computer.

The program containing the processing details can be recorded in a computer-readable recording medium. The computer-readable recording medium can be any type of medium, such as a magnetic storage device, an optical disc, a magneto-optical storage medium, or a semiconductor memory.

The program is distributed by selling, transferring, or lending a portable recording medium such as a DVD or a CD-ROM with the program recorded on it, for example. The program may also be distributed by storing the program in a storage unit of a server computer and transferring the program from the server computer to another computer through the network.

A computer that executes this type of program first stores the program recorded on the portable recording medium or the program transferred from the server computer in its storage unit. Then, the computer reads the program stored in its storage unit and executes processing in accordance with the read program. In a different program execution form, the computer may read the program directly from the portable recording medium and execute processing in accordance with the program, or the computer may execute processing in accordance with the program each time the computer receives the program transferred from the server computer. Alternatively, the above-described processing may be executed by a so-called application service provider (ASP) service, in which the processing functions are implemented just by giving program execution instructions and obtaining the results without transferring the program from the server computer to the computer. In the embodiments, the program of this form includes information that is provided for use in processing by the computer and is treated correspondingly as a program (something that is not a direct instruction to the computer but is data or the like that has characteristics that determine the processing executed by the computer).

In the description given above, the hardware entities are implemented by executing the predetermined program on the computer, but at least a part of the processing may be implemented by hardware.

DESCRIPTION OF REFERENCE NUMERALS

11, 21, 31, 41, 51: Encoders
12, 22, 32, 42, 52: Decoders
117, 217, 317, 417, 517: Parameter encoding units
127, 227, 327, 427, 527: Parameter decoding units

What is claimed is:

1. An encoding method comprising steps of:
(A) obtaining pitch periods corresponding to time series signals of subframes included in a frame; and
(B) encoding the pitch periods to obtain and output a code corresponding to the pitch periods;
wherein the step (B) comprises
encoding the pitch periods of a part of the subframes included in the frame to obtain and output the code when an index that indicates a level of stationarity of the time series signals of the frame does not satisfy the condition that indicates high stationarity, and otherwise
encoding the pitch periods of all of the subframes included in the frame to obtain and output the code when the index satisfies the condition that indicates high stationarity.

2. An encoding method comprising steps of:
(A) obtaining pitch periods corresponding to time series signals included in a predetermined time interval; and (B) outputting a code corresponding to the pitch periods;

wherein the step (B) comprises outputting the code obtained by encoding the pitch periods corresponding to time series signals included in each first time interval when an index that indicates a level of stationarity of the time series signals does not satisfy the condition that indicates high stationarity, and otherwise outputting the code obtained by encoding the pitch periods corresponding to time series signals included in each second time interval which is shorter than the first time interval when the index satisfies the condition that indicates high stationarity;

wherein the code is obtained by encoding the pitch periods expressed at a first quantization resolution when the index does not satisfy the condition that indicates high stationarity, otherwise the code is obtained by encoding the pitch periods expressed at a second quantization resolution which is higher than the first quantization resolution when the index satisfies the condition that indicates high stationarity.

3. A non-transitory computer readable recording medium having stored therein a program causing a computer to execute processing of the encoding method according to claim 1 or 2.

4. A decoding method comprising steps of:

receiving a code corresponding to a frame; and decoding a pitch code included in the code to obtain pitch periods of subframes included in the frame;

wherein the pitch code is decoded to obtain each of the pitch periods for a part of the subframes included in the frame, when an index that indicates a level of stationarity, the index being included in or obtained from the code corresponding to the frame, does not satisfy the condition that indicates high stationarity; and the pitch code is decoded to obtain each of the pitch periods for all of the subframes included in the frame, when the index satisfies the condition that indicates high stationarity.

5. A decoding method comprising steps of:

receiving a code corresponding to a predetermined time interval; and decoding a pitch code included in the code to obtain pitch periods corresponding to the predetermined time interval;

wherein the pitch code corresponding to the pitch periods is decoded with a first decoding mode that obtains each of the pitch periods in each first time interval, when an index that indicates a level of stationarity, the index being included in or obtained from the code corresponding to the predetermined time interval, does not satisfy the condition that indicates high stationarity; and otherwise the pitch code corresponding to the pitch periods is decoded with a second decoding mode that obtains each of the pitch periods in each second time interval which is shorter than the first time interval, when the index satisfies the condition that indicates high stationarity;

wherein each of the pitch periods expressed at a first quantization resolution is obtained with the first decoding mode when the index does not satisfy the condition that indicates high stationarity; and otherwise each of the pitch periods expressed at a second quantization resolution which is higher than the first quantization resolution is obtained with the second decoding mode when the index satisfies the condition that indicates high stationarity.

6. A non-transitory computer readable recording medium having stored therein a program causing a computer to execute processing of the decoding method according to claim 4 or 5.

7. An encoder which obtains pitch periods corresponding to time series signals of subframes included in a frame; and encodes the pitch periods to obtain and output a code corresponding to the pitch periods;

wherein the encoder encodes the pitch periods of a part of the subframes included in the frame to obtain and output the code when an index that indicates a level of stationarity of the time series signals of the frame does not satisfy the condition that indicates high stationarity, and otherwise the encoder encodes the pitch periods of all of the subframes included in the frame to obtain and output the code when the index satisfies the condition that indicates high stationarity.

8. An encoder which obtains pitch periods corresponding to time series signals included in a predetermined time interval; and outputs a code corresponding to the pitch periods;

wherein the code obtained by encoding the pitch periods corresponding to time series signals included in each first time interval is output when an index that indicates a level of stationarity of the time series signals does not satisfy the condition that indicates high stationarity, and the code obtained by encoding the pitch periods corresponding to time series signals included in each second time interval which is shorter than the first time interval is output when the index satisfies the condition that indicates high stationarity;

wherein the code is obtained by encoding the pitch periods expressed at a first quantization resolution when the index does not satisfy the condition that indicates high stationarity, and otherwise the code is obtained by encoding the pitch periods expressed at a second quantization resolution which is higher than the first quantization resolution when the index satisfies the condition that indicates high stationarity.

9. A decoder which receives of a code corresponding to a frame; and decodes a pitch code included in the code to obtain pitch periods of subframes included in the frame;

wherein the pitch code is decoded to obtain each of the pitch periods for a part of the subframes included in the frame, when an index that indicates a level of stationarity, the index being included in or obtained from the code corresponding to the frame, does not satisfy the condition that indicates high stationarity; otherwise the pitch code is decoded to obtain each of the pitch periods for all of the subframes included in the frame, when the index satisfies the condition that indicates high stationarity.

10. A decoder which receives of a code corresponding to a predetermined time interval; and decodes a pitch code included in the code to obtain pitch periods corresponding to the predetermined time interval;

wherein the pitch code corresponding to the pitch periods is decoded with a first decoding mode that obtains each of the pitch periods in each first time interval, when an index that indicates a level of stationarity, the index being included in or obtained from the code corresponding to the predetermined time interval, does not satisfy the condition that indicates high stationarity;

the pitch code corresponding to the pitch periods is decoded with a second decoding mode that obtains each of the pitch periods in each second time interval which is shorter than the first time interval, when the index satisfies the condition that indicates high stationarity;

wherein each of the pitch periods expressed at a first quantization resolution is obtained with the first decoding mode when the index does not satisfy the condition that indicates high stationarity; and otherwise each of the pitch periods expressed at a second quantization resolution which is higher than the first quantization resolution is obtained with the second decoding mode when the index satisfies the condition that indicates high stationarity.

* * * * *